US007681874B2

(12) United States Patent
Kusumi

(10) Patent No.: US 7,681,874 B2
(45) Date of Patent: Mar. 23, 2010

(54) SHEET CONVEYING DEVICE, AND IMAGE FORMING APPARATUS INCLUDING SAME

(75) Inventor: Tadashi Kusumi, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/073,099

(22) Filed: Feb. 29, 2008

(65) Prior Publication Data

US 2008/0211165 A1 Sep. 4, 2008

(30) Foreign Application Priority Data

Mar. 2, 2007 (JP) ..... 2007-053064

(51) Int. Cl.
*B65H 5/22* (2006.01)

(52) U.S. Cl. ..... 271/6; 271/7; 271/10.1; 271/10.15; 271/225; 271/184

(58) Field of Classification Search ..... 271/6, 271/7, 272, 275, 198, 10.07, 10.1, 10.15
See application file for complete search history.

(56) References Cited

U.S. PATENT DOCUMENTS

2008/0038039 A1* 2/2008 Watase et al. ..... 400/642

FOREIGN PATENT DOCUMENTS

JP 02-248962 10/1990
JP 10-129883 5/1998
JP 2004-338923 12/2004
JP 2005-001771 1/2005
JP 2005-089008 4/2005

* cited by examiner

*Primary Examiner*—David H Bollinger
(74) *Attorney, Agent, or Firm*—Harness, Dickey & Pierce, P.L.C.

(57) ABSTRACT

A sheet conveying device, that can be included in an image forming apparatus, includes a first conveying unit to convey a sheet in a first sheet conveying direction, a second conveying unit to convey the sheet conveyed by the first conveying unit in a second sheet conveying direction that is different from the first sheet conveying direction, a first sheet conveying path provided between the first conveying unit and the second conveying unit, a belt-type sheet conveying unit to the holding section of the second conveying unit, and a positioning control mechanism to move and position the first supporting member and the second supporting member in respective directions different from each other. The belt-type sheet conveying unit includes a belt, a first rotary belt holding member, a second rotary belt holding member, a first supporting member, and a second supporting member.

18 Claims, 27 Drawing Sheets

SHEET CONVEYING DEVICE, AND IMAGE FORMING APPARATUS INCLUDING SAME

PRIORITY STATEMENT

The present patent application claims priority under 35 U.S.C. §119 from Japanese Patent Application No. 2007-053064 filed on Mar. 2, 2007 in the Japan Patent Office, the contents and disclosure of which are hereby incorporated by reference herein in their entirety.

BACKGROUND

1. Field

Example embodiments of the present patent application generally relate to a sheet conveying device effectively conveying various types of sheets, an image forming apparatus such as a copier, a facsimile machine, a printer, a printing machine, an inkjet recording device, an image reading device such as a scanner provided with the sheet conveying device, and/or a multifunctional machine combining functions of at least two of the above.

2. Discussion of the Related Art

In order to reduce the overall sizes and dimensions of related-art image forming apparatuses including copiers, such as plain paper copiers or PPC and electrophotographic copiers, facsimile machines, printers such as laser beam printers, printing machines, and inkjet recording devices, the sizes of conveying or feeding units provided therein also tend to be reduced.

For example, a conveying unit is used for conveying a recording medium or a sheet-type recording medium onto which an image is formed (hereinafter, referred to as "sheet"). The sheet is fed from a sheet storing unit or a sheet accommodating unit in which sheets are stacked and is conveyed therefrom to a main body of an image forming apparatus.

Hereinafter, a description is given of a sheet storing unit that stores stack of sheets therein.

There is a technique for handling recording media or sheets. For example, the related-art image forming apparatuses generally accommodate sheets having various sizes. In such a related-art image forming apparatus, recording media or sheets of different sizes (or referred to as a "sheet size") and different types (or referred to as a "sheet type") are previously stored in multiple sheet storing units corresponding to respective sizes and types. A sheet may be fed from the sheet storing unit selected manually by a user or automatically by an image forming apparatus. In such a configuration, each sheet storage unit occupies a large space in the related-art image forming apparatus, and therefore, it is particularly necessary to reduce the size of the related-art conveying unit.

One approach is to have a sheet conveying path, provided between the sheet storing unit and a main body of a related-art image forming apparatus, to considerably bend or change its direction midway depending on the relative positions of the sheet storing unit and the main body, so as to reduce the space occupied by the sheet conveying path. Thus, the sheet conveying path is provided with a curved section in order to change the sheet conveying direction in a continuous and smooth manner. The curved section includes a relatively small curvature radius so as to convey a regular-sized recording sheet normally used in the related-art image forming apparatus.

In this technique used in a sheet conveying device of a related-art image forming apparatus, sheet feed trays serving as sheet storing units are arranged beneath a main body of the related-art image forming apparatus. Given numbers of sheets of given sheet sizes and sheet types are stacked in the sheet storing units. In between the sheet storing units and the main body of the related-art image forming apparatus, a sheet conveying unit is provided for extracting a sheet in a substantially horizontal direction from the selected sheet storing unit and feeding the extracted sheet in an upward direction toward the main body of the image forming apparatus disposed above.

A sheet in a sheet storing unit is separated from the stack of sheets by a related-art feed reverse roller (FRR) sheet separation mechanism, and is sent to the main body of the related-art image forming unit through a sheet conveying path provided with a curved section including an upper guide plate and a lower guide plate, each of which serves as a guide member for fixing a curved section. As the sheet is conveyed or travels further on, the sheet is pressed from above by the upper guide plate. The sheet is conveyed by an elastically deformable guide piece positioned at the outlet end of the lower guide plate and reaches a pair of conveying rollers. Hereinafter, the upper guide plate and the lower guide plate are referred to as the "curve fixing guide member."

However, in the sheet conveying device with the above-described configuration, the following problem arises when conveying a specific type of sheet with high rigidity, such as a cardboard recording paper or an envelope. That is, when the sheet bends and moves along the curved section, such a highly rigid recording paper or special paper receives a much greater resistance compared to a regular sheet such as a plain paper used for copying. This is because the curved section in the sheet conveying path has a small radius. As a result, the highly rigid sheet cannot smoothly move along the sheet conveying path, causing a paper jam or a conveyance failure. Thus, the sheet feeding operation cannot be reliably performed.

In order to facilitate the understanding of the related art and its problems, a description is now given of further details of the above-described conveyance operation.

When the leading edge of the sheet in the sheet conveying direction reaches the curve fixing guide member configured with the upper guide plate and the lower guide plate, the front half of the sheet including the leading edge of the sheet curves or bends in its thickness direction. Accordingly, when a highly rigid sheet is conveyed, a large force resists this bending action, in such a manner that a large resistance obstructs the sheet conveying operation. As a result, the leading edge of the highly rigid sheet may not reach the pair of conveying rollers at the downstream side of the sheet conveying direction, with the result that the sheet may be conveyed only by a pair of rollers on the upstream side thereof. However, when the sheet is bent by the guide member, the conveying force of the pair of rollers alone may be insufficient for conveying the highly rigid sheet counter to the resistance caused by the bending action. As a result, the following conveyance failures may be caused. Specifically, the sheet is caused to move in an oblique manner because the centerline of the highly rigid sheet does not match the centerline of the sheet conveying path, or a paper jam occurs because the highly rigid sheet is caught inside the guide member and stops moving.

Accordingly, the above-described sheet conveying device with the above-described technique has been proposed. In the sheet conveying device, a sheet is sent out from a first conveying member then conveyed to a second conveying member disposed downstream of the first conveying member in the conveying direction and substantially vertically above the first conveying member. A pair of linear guide members is provided between the first conveying member and the second conveying member, and the sheet is conveyed while guided by these linear guide members. In this sheet conveying device, the guide members do not have curved shapes but have linear shapes, and therefore, the conveyance load can be maintained at a low level. That is, the conveyance load can be prevented from rising abruptly so that conveyance failures such as a paper jam or oblique movements can be prevented.

That is, according to the above-described sheet conveying device, the conveyed sheet is not deformed or bent only at one position, but is deformed at two positions, i.e., near the front and rear ends of the linear guide members in the sheet conveying direction. Furthermore, the linear guide members are disposed obliquely at substantially intermediate angles, so that the sheet may bend by the same amount at the above-described two positions. Therefore, the conveyance load may be prevented from rising abruptly. Specifically, the sheet may change its traveling direction by bending at the two positions, namely, when the sheet is passed from the pair of rollers located at the upstream side of the sheet conveying or travel direction to the linear guide member, and when the sheet is passed from the linear guide member to the pair of rollers located at the downstream side of the sheet travel direction. Thus, the sheet bends by smaller extents at these two positions than when the sheet abruptly bends at one position only. Thus, the resistance caused by the bending action of the sheet can be reduced at each of the two positions, thereby preventing the conveyance load from rising abruptly.

Another type of sheet conveying device with a first conveying member and a second conveying member having substantially the same configurations as the above-described sheet conveying device employing the second technique is described as follows.

This sheet conveying device employing the second technique includes a reverse guide member provided at an incline between the first conveying member and the second conveying member. This reverse guide member is configured to move toward the second conveying member.

In this sheet conveying device, when the trailing edge of the sheet contacts the reverse guide member, the reverse guide member shifts its position in a direction substantially according to the trailing edge of the sheet. This shift makes it possible to absorb the shock or impact caused when the trailing edge of the sheet contacts the reverse guide member. Hence, a flipping noise can be reduced.

Yet another type of sheet conveying device with a technique different from the above-described technique has been proposed. Hereinafter, the above-described technique is referred to as a "first technique", and the following technique is referred to as a "second technique." This sheet conveying device employing this technique or the second technique includes two or more units for storing sheets, and each of the sheet storing units is provided with a sheet conveying path and a sheet conveying unit. The ends of the sheet conveying paths merge into a common conveying path. Each of the sheet conveying paths has a curved section at the end thereof, at which each sheet conveying path merges with the common conveying path. At least one of the sheet conveying paths provided for a sheet storing unit that stores or accommodates highly rigid sheets has a first curved section with a larger curvature radius than those of the other sheet conveying paths.

Therefore, in this sheet conveying device, highly rigid sheets are caused to bend more moderately compared to plain paper sheets. A highly rigid sheet moves along the sheet conveying path and passes via the first curved section having a large curvature radius, so that the sheet may not bend as much as a plain paper sheet passing via a curved section having a smaller curvature radius. Accordingly, it is possible to reduce the resistance while conveying a highly rigid sheet, so that the sheet can be conveyed to the common conveying path without being suspended or stopped.

Now, a sheet reversing unit employing another technique, or a third technique, is described. The sheet reversing unit is provided in a related-art image forming apparatus. This sheet reversing unit includes a pair of reverse rollers and a reverse conveying path for conveying and guiding a sheet received from the pair of reverse rollers. The reverse conveying path includes a redirection section for changing the direction of conveying a sheet. Rotatable members or rollers are arranged inside the redirection section in a direction orthogonal or perpendicular to the sheet conveying direction, so that a sheet sent into the reverse conveying path can be sent out while abutting the rollers.

According to this sheet reversing unit, when a sheet is sent inside, it is ensured that the portion of the sheet inside the redirection section contacts the rollers, and the rollers are caused to rotate by or following the movement of the sheet in the sheet conveying direction. Thus, compared to a related-art guiding plate, the conveying resistance can be reduced. Specifically, it is possible to eliminate a frictional resistance occurring between a fixed guide member and the moving sheet while changing the conveying direction of the sheet at the redirection section.

However, the sheet conveying device using the first technique merely provides a fixed guide member for guiding a conveyed sheet, and thus does not eliminate the speed difference between the moving conveyed sheet and the fixed guide member. Accordingly, regardless of the shape or position of the guide member, resistance occurs in such a direction as to obstruct the sheet from being conveyed, which generating a conveyance load.

That is, this related-art configuration is insufficient for preventing conveyance failures or paper jams. Although the linear guide member can reduce the conveyance load from rising abruptly, a conveyance load is generated nonetheless. Particularly when conveying a highly rigid sheet, such as a cardboard recording paper or an envelope, conveyance failures and paper jams frequently occur and flipping noises made by the trailing edge of the sheet increase considerably.

Furthermore, as described in reference to the sheet conveying device with the first technique, the reverse guide member can shift or change its position in a direction according to the trailing edge of the sheet contacting the reverse guide member. However, the reverse guide member merely functions as a fixed guide member in terms of changing the direction of the sheet. Accordingly, as with the related-art configuration described above, this related-art technique does not eliminate the relative speed difference between the sheet and the reverse guide member when changing the direction of the sheet and guiding the sheet, thus generating a conveyance load. Particularly when conveying a highly rigid sheet, such as a cardboard recording paper or an envelope, conveyance failures and paper jams frequently occur and flipping noises caused by the trailing edge of the sheet increase considerably.

Furthermore, as described in reference to the sheet conveying device with the second technique, the sheet conveying path with a large curvature radius dedicated to highly rigid sheets makes it possible for sheets traveling therethrough to bend moderately so as to reduce the conveyance resistance applied by the sheet conveying path to the sheet. However, a conveyance load is still generated nonetheless, and therefore, particularly when conveying a highly rigid sheet, such as a cardboard recording paper or an envelope, conveyance failures and paper jams frequently occur.

Furthermore, as described in reference to the sheet reversing unit with this technique or the third technique, movable members such as rollers are provided at given positions inside the redirection section of the sheet conveying path. Therefore, in the process of conveying the sheet, the frictional resistance between the sheet and the guide member can be effectively reduced while the internal rollers are supporting the middle portion of the sheet between the leading edge and the trailing edge. However, there are no measures provided for reducing the conveyance load before and after the sheet is supported by the internal rollers, i.e., when the sheet is in contact with the sheet conveying path outside the redirection section. Furthermore, no particular description is made of movements of the leading edge and the trailing edge of the sheet while being conveyed. Particularly when conveying a highly rigid sheet such as a cardboard recording paper or an envelope, conveyance failures and paper jams frequently occur and flipping noises caused by the trailing edge of the sheet increase considerably.

In light of the foregoing, the inventors of the present patent application have previously proposed to provide a sheet conveying device and an image forming apparatus including a sheet conveying device that can eliminate the drawbacks of the above-described techniques, specifically, by providing a sheet conveying device that is compact and space-saving, that includes a simple configuration achieved at low cost, and that can handle various types of sheets, and an image forming apparatus that includes such sheet conveying device.

However, to put the above-described configuration to practical use, the following additional technique may be needed.

That is, the above-described sheet conveying device may include a conveying unit including a grip roller and a belt-type conveying unit having a conveyor belt. The grip roller and the conveyor belt are disposed facing and continuously pressed against each other. The area of contact between the grip roller and the conveyor belt may form a nip contact or a sheet holding section for holding a sheet when conveyed thereto. Such contact between the grip roller and the conveyor belt may generate frictional resistance, and therefore the surfaces of the grip roller and the conveyor belt may be abraded over time.

Accordingly, the position of the holding section between the grip roller and the belt-type conveying unit, which is a pressing direction of the belt-type conveying unit, may become unstable and thus displaced, and as a result possibly altering a sheet conveying direction of the leading edge of a sheet after the sheet passes the sheet holding section or nip contact.

SUMMARY

In light of the foregoing, the inventors of the present application propose to provide, in at least one embodiment, a sheet conveying device and an image forming apparatus including a sheet conveying device that can reduce or even eliminate at least one of the drawbacks of the above-described techniques. In at least one embodiment, a sheet conveying device is provided that is compact and space-saving, that includes a simple configuration achieved at low cost, that can handle various types of sheets, and that can convey various types of sheets in a stable transfer quality and increase flexibility of the design thereof, and an image forming apparatus that includes such sheet conveying device.

One or more embodiments of the present patent application have been made, taking the above-described circumstances into consideration.

An embodiment of the present patent application provides a sheet conveying device that includes a first conveying unit, a second conveying unit, a first conveying path, a belt-type sheet conveying unit, and a positioning control mechanism. The first conveying unit is configured to convey a sheet in a first sheet conveying direction. The second conveying unit that is disposed on a downstream side of the first conveying unit in the first sheet conveying direction is configured to convey the sheet conveyed by the first conveying unit in a second sheet conveying direction, which is different from the first sheet conveying direction. The second conveying unit is provided with a sheet holding section to hold and convey the sheet. The first sheet conveying path is provided between the first conveying unit and the second conveying unit. The belt-type sheet conveying unit that is disposed on an outer side of the first sheet conveying path is configured to convey a sheet to the sheet holding section of the second conveying unit. The belt-type sheet conveying unit includes a belt to convey the sheet to the sheet holding section of the second conveying unit, a first rotary belt holding member, disposed facing the sheet holding section of the second conveying unit, to rotatably hold the belt, a second rotary belt holding member disposed facing the first rotary belt holding member, a first supporting member to rotatably support the first rotary belt holding member, and a second supporting member to rotatably support the second rotary belt holding member. The positioning control mechanism is configured to move and position the first supporting member and the second supporting member in respective directions different from each other.

The above-described sheet conveying device may further include a space holding unit to hold the first supporting member and the second supporting member a given constant distance apart.

The positioning control mechanism may include a first positioning control part to control a positioning of the first supporting member and a second positioning control part to control a positioning of the second supporting member. With this configuration, the second positioning control part may control a position in a direction perpendicular to a line segment connecting an axial center of a rotary feed drive member of the second conveying unit disposed opposite the first rotary belt holding member, and an axial center of the first supporting member.

An angle of contact between a leading edge of a sheet and a conveying surface of the belt-type sheet conveying unit during positioning control is an acute angle.

The above-described sheet conveying device may further include a second sheet conveying path different from the first sheet conveying path and provided upstream of the second conveying unit to join the first sheet conveying path at an upstream side of the second conveying unit. With this configuration, the positioning control mechanism may include a first positioning part to control a positioning of the first supporting member and a second positioning part to control a positioning of the second supporting member. Further, with this configuration, the belt of the belt-type sheet conveying unit may include a conveying surface disposed along the second sheet conveying path. Furthermore, with this configuration, the second positioning control part may control a position of the second supporting member in a direction parallel to a conveying surface of the second sheet conveying path.

The positioning control mechanism may include a first positioning control part to control a positioning of the first supporting member and a second positioning control part to control a positioning of the second supporting member. With this configuration, the first positioning control part that is disposed facing the first rotary belt holding member may control the first rotary belt holding member with respect to the rotary feed drive member of the second conveying unit along a pressing direction.

The belt-type sheet conveying unit may be configured as multiple belt-type sheet conveying units disposed discontinuously in a sheet width direction. With this configuration, the multiple belt-type sheet conveying units may be integrally mounted in a holder.

At least one embodiment of the present patent application provides an image forming apparatus that includes a main body unit configured to perform an image forming operation and a sheet conveying device. The sheet conveying device includes a first conveying unit, a second conveying unit, a first sheet conveying path, a belt-type sheet conveying unit, and a positioning control mechanism. The first conveying unit is configured to convey a sheet in a first sheet conveying direction. The second conveying unit that is disposed on a downstream side of the first conveying unit in the first sheet conveying direction is configured to convey the sheet conveyed by the first conveying unit in a second sheet conveying direction, which is different from the first sheet conveying direction. The second conveying unit is provided with a sheet holding section to hold and convey the sheet. The first sheet conveying path is provided between the first conveying unit and the second conveying unit. The belt-type sheet conveying unit that is disposed on an outer side of the first sheet conveying path is configured to convey a sheet to the sheet holding section of the second conveying unit. The belt-type sheet conveying unit includes a belt to convey the sheet to the sheet holding section of the second conveying unit, a first rotary belt holding member disposed facing the sheet holding section of the second conveying unit to rotatably hold the belt, a second rotary belt holding member disposed facing the first rotary belt holding member, a first supporting member to rotatably support the first rotary belt holding member, and a second supporting member to rotatably support the second rotary belt holding member. The positioning control mechanism is configured to move and position the first supporting member and the second supporting member in respective directions different from each other.

BRIEF DESCRIPTION OF THE DRAWINGS

The accompanying drawings are intended to depict example embodiments of the present patent application and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
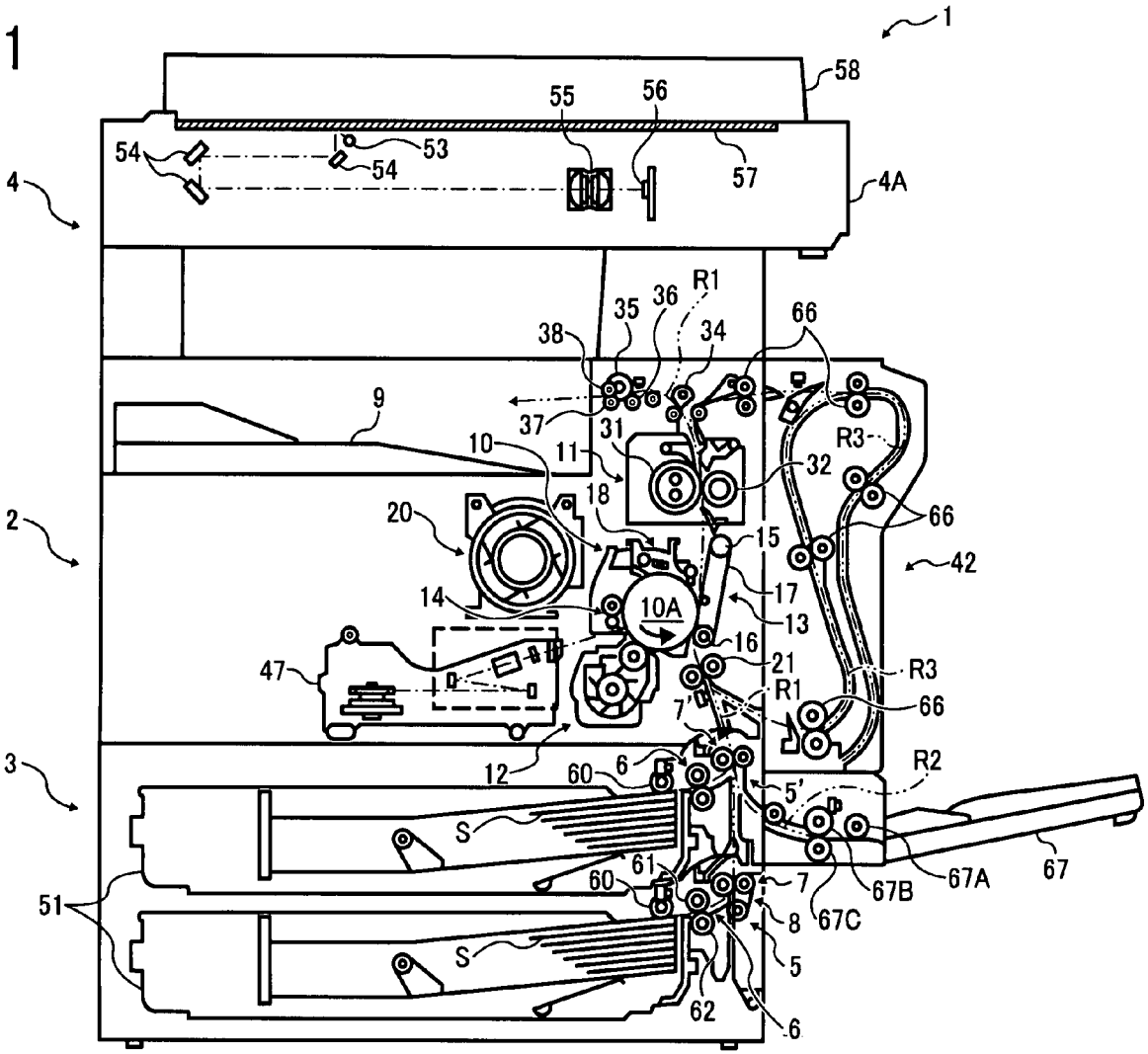
FIG. 1 is a cross-sectional view of a schematic entire configuration of an image forming apparatus, according to an example embodiment of the prevent invention.

It will be understood that if an element or layer is referred to as being "on", "against", "connected to" or "coupled to" another element or layer, then it may be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" may encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing example embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

Now, example embodiments of the present patent application are described in detail below with reference to the accompanying drawings.

Descriptions are given, with reference to the accompanying drawings, of examples, example embodiments, modification of example embodiments, etc., of a sheet conveying device according to the present patent application, and an image forming apparatus including the same. Elements having the same functions and shapes are denoted by the same reference numerals throughout the patent application and redundant descriptions are omitted. Elements that do not require descriptions may be omitted from the drawings as a matter of convenience. Reference numerals of elements extracted from the patent publications are in parentheses so as to be distinguished from those of example embodiments of the present application.

FIGS. 1 through 10 show schematic configurations and functions of examples of sheet conveying devices to which the present patent application is applied, and an image forming apparatus including the same.

Referring to FIG. 1, an overall configuration of a copier 1 serving as an image forming apparatus is described according to an example of the present patent application.

The copier 1 is a monochrome copier that scans an image from a face of an original document and forms a copied image onto various sheet-type recording media such as recording papers, transfer papers, paper sheets, and overhead projector (OHP) transparencies. Hereinafter, a recording medium is referred to as a "sheet."

The copier 1 includes a main body 2 thereof, a sheet feeding device 3 on which the main body 2 of the copier 1 is mounted, and an image scanning device 4 attached on the main body 2 of the copier 1.

The main body 2 of the copier 1 includes an image forming section or image forming unit for performing a given image forming process based on a scanned original image.

The sheet feeding device 3 supplies one sheet S at a time to the main body 2 of the copier 1.

The image scanning device 4 serves as an image reading device to scan or read an original image and send image data or information of the original image to the main body 2 of the copier 1.

A sheet eject tray 9 is provided at the upper portion of the main body 2 of the copier 1, forming a space beneath the image scanning device 4. Sheets that have passed through the main body 2 of the copier 1 are ejected to and stacked on the sheet eject tray 9.

A sheet conveying path R1 extends from the sheet feeding device 3 to the sheet eject tray 9. A large proportion of the sheet conveying path R1 may extend between the sheet feeding device 3 and the upper portion of the main body 2 in a substantially vertical direction with respect to a substantially horizontal direction.

Sheet conveying units including pairs of conveying rollers and pairs of subordinate rollers may be provided along the sheet conveying path R1 with given intervals therebetween determined according to the smallest size of sheet S. Some of these sheet conveying units may be configured to sandwich or hold the sheet S to ensure that the sheet S continues to be conveyed along the sheet conveying path R1.

Furthermore, the sheet feeding device 3 includes a sheet conveying device 5 configured to feed and convey the sheets S stored in paper trays of the sheet feeding device 3 to a pair of registration rollers 21 disposed in the sheet conveying path R1.

Figure 2:
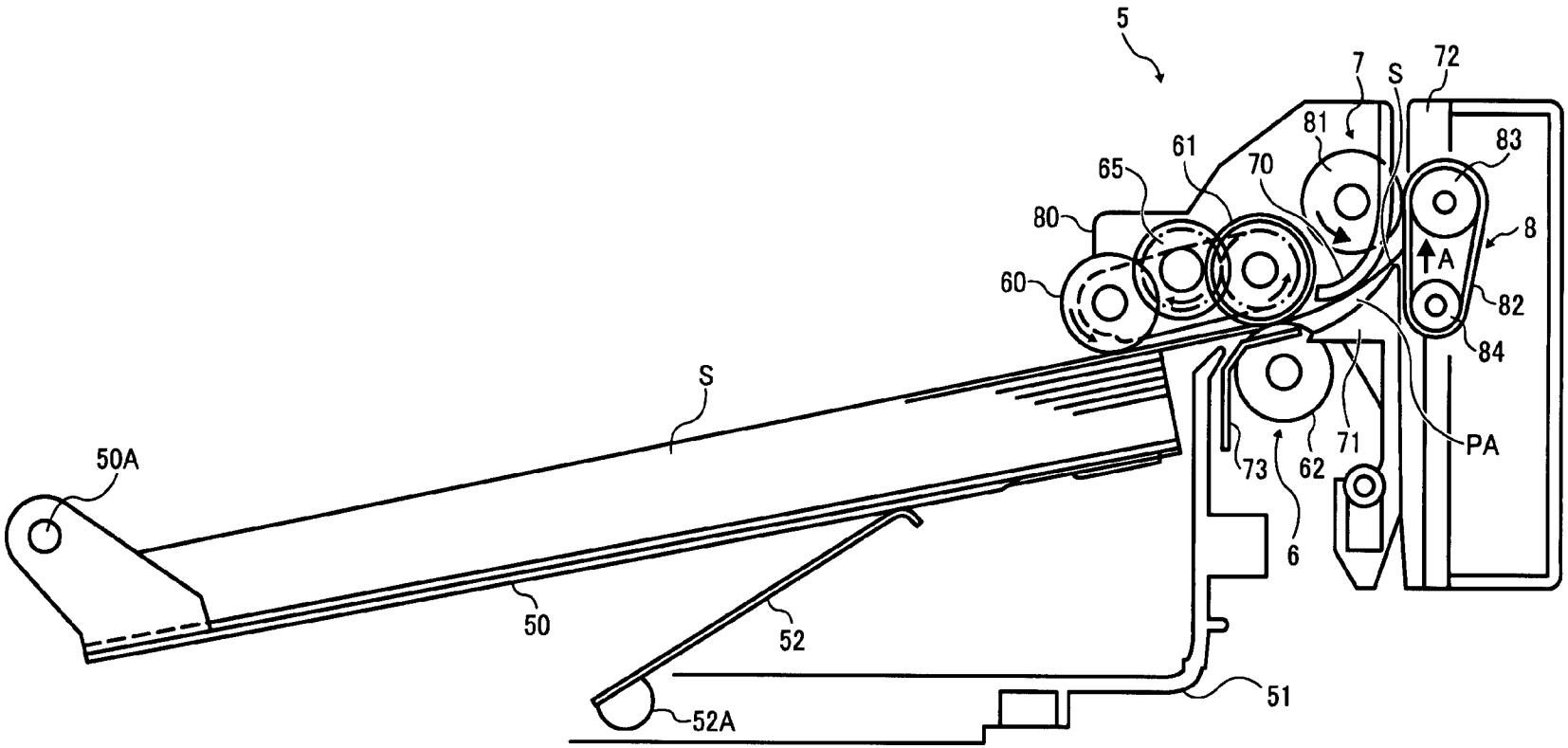
FIG. 2 is an enlarged cross-sectional view of a sheet conveying device, according to an example embodiment of the present patent application, of the image forming apparatus of FIG. 1.

Inside the main body 2 of the copier 1 in FIG. 2, a photoconductor unit 10 serving as an image forming device and a fixing device 11 serving as an image fixing device, both of which are included in the image forming section, are disposed in this order from the upstream side toward the downstream side of the sheet conveying path R1. As the sheet S is conveyed from the upstream side toward the downstream side of the sheet conveying path R1, the photoconductor unit 10 may transfer a toner image that is generated onto the sheet S and the fixing device 11 may fix the transferred toner image onto the sheet S. The sheet S on which the fixed toner image is formed may be ejected onto the eject tray 9 that is disposed at the end of the sheet conveying path R1.

The photoconductor unit 10 includes a single drum-type photoconductor 10A serving as an image carrier. The photoconductor 10A is supported by a side panel, not shown, inside the main body 2 of the copier 1 so as to rotate around a substantially horizontal axis.

The photoconductor 10A may have a cylindrical shape of a given diameter and a generally known configuration. The photoconductor 10A may receive a rotational driving force from a driving source such as a motor provided on one end of the photoconductor 10A, either on the photoconductor unit 10 side or on the main body 2 of the copier 1. Accordingly, the photoconductor 10A may rotate in a direction indicated by an arrow shown in FIG. 1 at a steady and constant speed.

Around the photoconductor 10A, image forming elements are disposed in the following order in the direction indicated by the arrow, which is an order of a developing device 12, a transfer device 13, a photoconductor cleaning device 18, a discharging device, not shown, and a charging device 14. Within a range corresponding to one rotation period of the photoconductor 10A in the counterclockwise direction, given operation positions such as a developing position of the developing device 12, a transferring position of the transfer device 13, a cleaning position of the photoconductor cleaning device 18, a discharging position of the discharging device, and a charging position of the charging device may be determined from upstream to downstream positions.

Between the charging position and the developing position, there is a latent image forming position. An exposing device 47 is provided at a position somewhat spaced apart from and diagonally downward from the photoconductor 10A. At the latent image forming position, the exposing device 47 may emit a given laser beam to irradiate the photoconductor 10A so as to form an invisible latent image thereon according to image data. In synchronization with the rotation of the photoconductor 10A in the counterclockwise direction, the above-described image forming components and the exposing device 47 may perform interlinked operations so as to execute a sequence of an image forming process in cooperation with each other.

The developing device 12 has an appropriate, generally known configuration including a developing roller for generating a toner brush by causing toner particles to stand erect on the surface of the developing device 12 in a radial direction. The developing device 12 may cause the toner particles at the tips of the toner brush to adhere onto the latent image formed on a given position on the surface of the photoconductor 10A, as the latent image moves in a circumferential direction of the photoconductor 10A and pass through the developing position in accordance with the rotation of the photoconductor 10A. Accordingly, the invisible latent image may be turned into a visible and monochrome toner image.

The transfer device 13 in FIG. 1 includes two supporting rollers 15 and 16 spaced apart from each other in a substantially vertical direction and a transfer belt 17, which is an endless belt stretched around the supporting rollers 15 and 16. The transfer device 13 may transfer the toner image from the circumferential surface of the photoconductor 10A onto the sheet S, and convey the sheet S onto which an unfixed toner image is transferred to the downstream side of the sheet conveying path R1. Specifically, a portion of the lower supporting roller 16 where the transfer belt 17 may be stretched around may be pressed against a substantially diagonally downward right portion of the photoconductor 10A, and the transferring position may correspond to a position at which the surface of the photoconductor 10A and the surface of the transfer belt 17 contact to each other. The upper supporting roller 15 may be disposed in front of the inlet of the fixing device 11.

The photoconductor cleaning device 18 may include either one or both of a blade, not shown, and a rotating brush, not shown. The blade may have a blade edge at the tip thereof that abuts against the cleaning position on the photoconductor 10A while maintaining a given pressure level. The rotating brush may contact the cleaning position and be caused to rotate following the rotation of the photoconductor 10A. The photoconductor cleaning device 18 may remove toner or foreign materials remaining on the surface of the photoconductor 10A after the transfer operation.

The discharge device is primarily configured with a lamp that can emit a light beam of a given light intensity. This lamp may emit a light beam used for the discharging operation onto the discharging position to neutralize the charged surface of the photoconductor 10A passing by the discharging position. Accordingly, the discharge device can initialize the surface potential of the photoconductor 10A that had passed by the transferring portion.

The fixing device 11 includes a heating roller 31 with a built-in electrothermal heater serving as a heat source and a pressing roller 32 facing and pressed against the heating roller 31 in a substantially horizontal direction. When the heating roller 31 is rotated by a driving source, not shown, such as a motor, the pressing roller 32 in contact with the heating roller 31 may be caused to rotate following the rotation of the heating roller 31. At the same time, the portion at which the heating roller 31 and the pressing roller 32 contact with each other along a width direction perpendicular to the sheet travel direction may have a given heating temperature and given pressure so as to function as a nip contact for fixing the toner image onto the sheet.

In FIG. 1, the main body 2 of the copier 1 further includes a toner storing container 20, which is a toner bottle storing unused toner and/or new toner. A toner conveying path, not shown, may extend from the toner storing container 20 to the developing device 12. When the developing device 12 has consumed the toner provided therein and there is a toner shortage, the newly replenished toner may be supplied from the toner storing container 20 into the developing device 12.

The sheet feeding device 3 is provided beneath the main body 2 of the copier 1, so that the sheet size can be chosen automatically or according to a user's manual input. The sheet feeding device 3 of FIG. 1 includes multiple sheet feeding cassettes 51 serving as sheet storing units arranged in multiple stages. Each of the sheet feeding cassettes 51 can be individually pulled outside of the sheet feeding device 3 so that an appropriate number of sheets having a size according to the individual sheet feeding cassette 51 can be replenished. Different types of sheets S that are of various sheet sizes and oriented in vertical or horizontal directions with respect to the sheet conveying direction are stacked and/or stored in the sheet feeding cassettes 51.

The image scanning device 4 includes a main body 4A thereof serving as a framework of the image scanning device 4. On top of the main body 4A, an exposure glass 57 is disposed across a given range. A scanning unit may be housed inside the main body 4A of the image scanning device 4 for optically scanning an original image by scanning the given range of the exposure glass 57. The scanning unit primarily includes at least a first moving member 53, second moving members 54, and an image forming lens 55, and a scanning sensor 56 such as a CCD.

The image scanning device 4 includes a platen cover 58 configured to open and close between a closed position covering the exposure glass 57 and an open position. The platen cover 58 is disposed on the top surfaced of the main body 4A of the image scanning device 4. The platen cover 58 has larger length/width sizes than those of the exposure glass 57, and one side thereof is fixed to the top surface of the main body 4A of the image scanning device 4 so as to freely open and close.

On the basis of the above-described configuration, the copier 1 may be operated as described below.

First, in order to make a copy of an original document with the copier 1, a user manually opens the platen cover 58 of the image scanning device 4 from the closed position to the open position, places and sets the original document on the exposure glass 57, and then manually brings the platen cover 58 to the closed position, so that the platen cover 58 can press the original document set on the exposure glass 57 from above. Accordingly, the original document spreads out in a planar manner in close contact with the exposure glass 57 so that the original document face can be scanned accurately, and the original document can be fixed on the exposure glass 57.

As the user presses a start key of an operation panel section, not shown, initially provided in the copier 1, a scanning operation of the image scanning device 4 immediately starts, and a driving mechanism, not shown, causes the first moving member 53 and the second moving member 54 to travel. A light beam from a light source of the first moving member 53 may be emitted toward the original document, and the light beam may be reflected from a surface of the original document and is directed toward the second moving member 54. The light beam may then be reflected by a mirror of the second moving member 54, and the light beam may enter the scanning sensor 56 via the imaging lens 55. As a result, the image of the original document can photo-electrically be converted and scanned by the scanning sensor 56.

When the start key is pressed, the photoconductor 10A of the photoconductor unit 10 starts rotating and an operation starts for forming a toner image on the photoconductor 10A based on the scanned original image. Specifically, as the photoconductor 10A rotates, a given position on the circumferential surface of the photoconductor 10A may sequentially pass by the respective positions between the charging device 14, the exposing device 47, the developing device 12, the transfer device 13, the photoconductor cleaning device 18, and the discharging device. Accordingly, the given position on the photoconductor 10A may be charged to a given charged status, a latent image may be generated thereon, and the latent image may be turned into a visible toner image. The toner image may then be transferred onto the sheet S, residual toner may be removed from the photoconductor 10A, and the charged status may be cancelled. Thus, one cycle of operations may be completed in the above-described order of the developing device 12, the transfer device 13, the photoconductor cleaning device 18, the charging device, and the charging device 14. The above-described cycle of the image forming operation may be continued until the toner image is created in an area of a given size on the circumferential surface of the photoconductor 10A in the rotational direction, according to the size of the image to be formed.

When the start key is pressed, one sheet S may be extracted from the sheet feeding cassette 51 in the sheet feeding device 3 corresponding to the sheet feeding stage storing the type of sheet S selected automatically or manually, and the extracted sheet S may be fed to the sheet conveying path R1 via a given sheet conveying path, which may be a branch of the sheet conveying path R1, by the sheet conveying device 5 attached to the corresponding sheet feeding stage of the sheet feeding device 3. This sheet S may be conveyed in a substantially vertically upward direction through the sheet conveying path R1 in the main body 2 of the copier 1 by conveying rollers, and may temporarily be stopped when the leading edge of the sheet S abuts against the pair of registration rollers 21 that serves as a registration unit to correct a positional condition of a sheet.

When performing a manual sheet feeding operation, the sheet S may set on the manual sheet feeding tray 67, and may be rolled out by the rotation of the sheet feeding roller 67A provided for the manual sheet feeding tray 67. When multiple sheets S are stacked and set on the manual sheet feeding tray 67, the separating rollers 67B and 67C may separate the sheets S one by one. The sheet S may travel via a manual sheet conveying path R2 and the sheet conveying path R1 in this order, and temporarily stop when the leading edge of the sheet S abuts against the pair of registration rollers 21.

The pair of registration rollers 21 may start rotating at an accurate timing in synchronization with the relative movement of the toner image on the rotating photoconductor 10A so as to convey the sheet S, which has temporarily been stopped, into the transferring position. As a result, the toner image may be transferred onto the sheet S by the transfer device 13.

The sheet S, onto which an unfixed monochrome toner image is transferred, may then be conveyed to the fixing device 11 by the transfer belt 17 of the transfer device 13 serving as part of the sheet conveying path R1. The sheet S may pass through a nip contact of the fixing device 11. The nip contact may apply given heat and pressure onto the sheet S so that the image can be fixed onto the sheet S. The sheet S with the fixed image may be guided by a switching claw 34 to the sheet conveying path R1 that extends to the sheet eject tray 9, be ejected onto the sheet eject tray 9 by eject rollers 35, 36, 37, and 38, and be stacked on the sheet eject tray 9. The user can retrieve or take out the sheet S stacked on the sheet eject tray 9 through an opening, which is located between the sheet eject tray 9 and the image scanning device 4 facing the front of the copier 1.

When a double-sided copy mode is selected by a user input, the sheet S with an image fixed on one side thereof may be guided by the switching claw 34 to be conveyed toward the sheet reversing device 42. Multiple pairs of rollers 66 and guiding members, not shown, disposed inside the sheet reversing device 42 may convey the sheet S back and forth along a reverse conveying path R3 to reverse the faces or sides of the sheet S. Then, the sheet S may be conveyed from a position in front of the photoconductor unit 10 back to the sheet conveying path R1 through the pair of registration rollers 21. The sheet S may be conveyed upward along the sheet conveying path R1 and be guided to the transferring position once again, at which an image is transferred and fixed this time onto the backside or the other side of the sheet S. Finally, the sheet S may be ejected onto the sheet eject tray 9 by the eject rollers 35, 36, 37, and 38.

Now, detailed configuration and functions of the sheet conveying device 5 are described according to an example of the present patent application, with reference to FIGS. 1 through 5.

Figure 3:
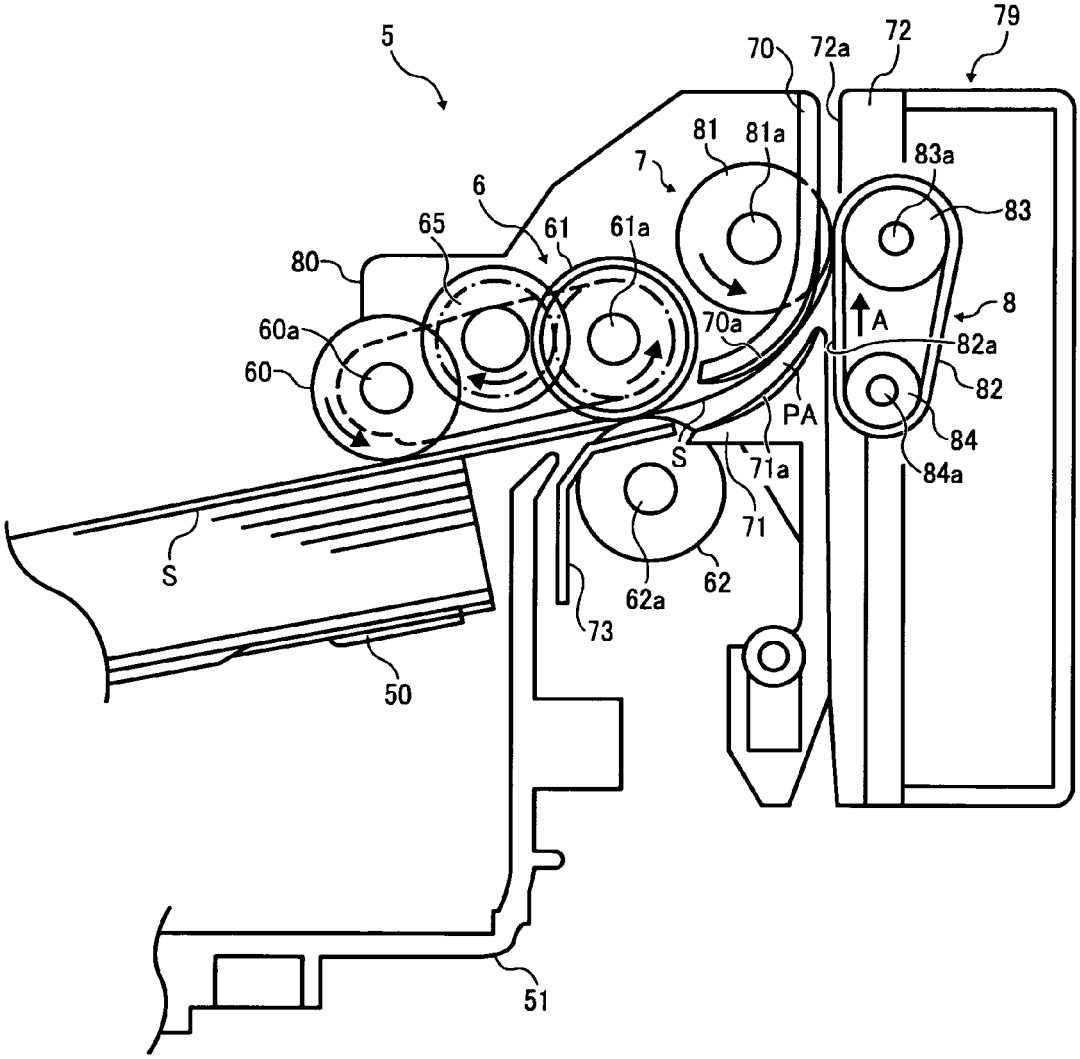
FIG. 3 is an enlarged cross-sectional view of the sheet conveying device of FIG. 2.

As shown in FIGS. 2 and 3, the sheet conveying device 5 according to this example of the present patent application may extract one sheet S from the stack of sheets S accommodated or stored in the sheet feeding cassette 51 of a given stage (in this example, the lower stage) in the sheet feeding device 3 shown in FIG. 1, change the sheet conveying direction of the fed sheet S, and convey the sheet S in a direction perpendicular to a substantially horizontal direction or a substantially vertically upward direction to the pair of registration rollers 21 disposed in the main body 2 of the copier 1.

The sheet conveying device 5 primarily includes a first conveying unit 6, a second conveying unit 7, and a first sheet conveying path PA.

The first conveying unit 6 may convey the sheet S one by one.

The second conveying unit 7 may be disposed on a downstream side of the first conveying unit 6 in the sheet conveying direction. The second conveying unit 7 may convey the sheet S received from the first conveying unit 6 in a sheet conveying direction different from the sheet conveying direction of the first conveying unit 6.

The first sheet conveying path PA may be provided between the first conveying unit 6 and the second conveying unit 7.

In the sheet conveying device 5, the first conveying unit 6 may serve as a first conveying unit and the second conveying unit 7 may serve as a second conveying unit to hold and convey the sheet S or as a pair of rotary feed members.

For example, the first conveying unit 6 includes two rotary feed members disposed facing each other, namely a feed roller 61 and a reverse roller 62, and serve as a first pair of rotary feed members.

The second conveying unit 7 includes two rotary feed members disposed facing each other, namely a grip roller 81 and a conveyor belt 82 stretched around a roller-type pulley 83 and a roller-type pulley 84, and serve as a second pair of rotary feed members.

At least one of the first conveying unit 6 and the second conveying unit 7 includes a belt-type conveying unit 8 serving as a belt-type sheet conveying unit provided with the conveyor belt 82 to move and guide (convey) the sheet S toward a sheet holding section or nip contact of the second conveying unit 7 while keeping the leading edge of the sheet S in contact with the conveyor belt 82. A conveying surface 82*a*, which is a belt traveling surface on the conveyor belt 82 of the belt-type conveying unit 8, is disposed along an outer side of the first conveying path PA.

As described above, the sheet conveying direction of the first pair of rotary feed members including the feed roller 61 and the reverse roller 62 is different from the sheet conveying direction of the second pair of rotary feed members including the grip roller 81 and the conveyor belt 82. Specifically, the sheet conveying direction of the first pair of rotary feed members is substantially horizontal and directed to a diagonally upward right position, whereas the sheet conveying direction of the second pair of rotary feed members is directed in a substantially vertically upward direction, as viewed in FIGS. 2 and 3. Accordingly, the first sheet conveying path PA provided between the first conveying unit 6 and the second conveying unit 7 includes a curved section with a small radius, which can cause the sheet conveying direction to change abruptly in the first sheet conveying path PA.

Figure 4:
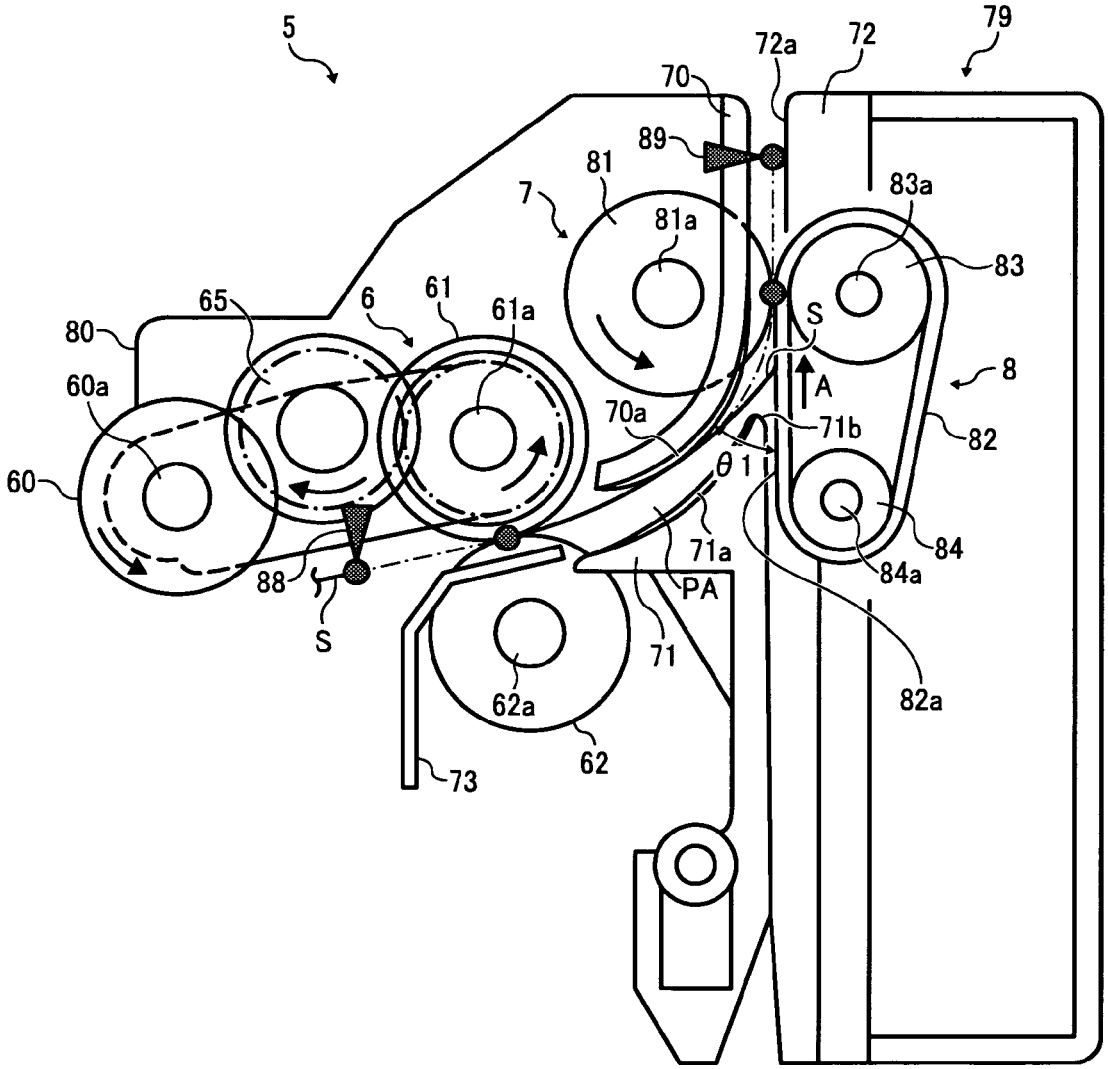
FIG. 4 is an enlarged cross-sectional view of relevant parts, with one conveying path, of the sheet conveying device of FIG. 2.

A more specific description is given of the sheet conveying directions of the first and second conveying units 6 and 7 with reference to FIG. 4.

As shown in FIG. 4, the sheet conveying direction orthogonally intersecting the center of the nip contact of the first conveying unit 6 is substantially horizontal with respect to a line connecting three points, which are the rotational center of the feed roller 61, the rotational center of reverse roller 62, and the sheet holding section (also referred to as "nip contact") of the feed roller 61 and the reverse roller 62.

Similarly, the sheet conveying direction orthogonally intersecting the center of the nip contact of the second conveying unit 7 is substantially vertical with respect to a line connecting three points, which are the rotational center of the grip roller 81, the rotational center of the roller-type pulley 83, and the sheet holding section or the nip contact of the grip roller 81 and the conveyor belt 82.

That is, the sheet travel direction may change in the first sheet conveying path PA provided between the first conveying unit 6 and the second conveying unit 7. The first sheet conveying path PA includes two opposite surfaces that define the orientation of the conveyed sheet S in the thickness direction of the sheet S. When the sheet S is sent out from the first conveying unit 6, the leading edge of the sheet S may abut against a conveying guide surface, which is one of the above-described two surfaces. The conveying guide surface may move continuously and constantly within a given range, starting at least from the position at which the sheet S abuts against the conveying guide surface, along the lengthwise direction of the sheet conveying direction, toward the sheet holding section of the second conveying unit 7. This conveying and guiding surface corresponds to the belt traveling surface or the conveying surface 82*a* of the conveyor belt 82 of the belt-type conveying unit 8. In the example embodiment of the present patent application, the area surrounded by an extended line along the sheet travel direction of the first conveying unit 6 and an extended line along the sheet travel direction of the second conveying unit 7 may be referred to as an "inner area." The rest of the areas may be referred to as an "outer area." In addition, "inner side" and "outer side" refer to a side closer toward the inner area and a side closer toward the outer area, respectively. The conveying surface 82*a* of the conveyor belt 82, which is the planar belt traveling surface used for conveying a sheet, may be disposed along the outer edge of the inner area, and substantially intersect the sheet travel direction.

As shown in FIGS. 3 and 4, the belt-type conveying unit 8 primarily includes the conveyor belt 82, and the roller-type pulley 83, and the roller-type pulley 84. The pulleys 83 and 84 may be a pair of rotary belt holding members for rotatably holding the conveyor belt 82.

The roller-type pulley 83 serves as a first rotary belt holding member. The roller-type pulley 83 may be disposed opposite to the sheet holding section or nip contact formed between the grip roller 81 and the conveyor belt 82, so as to movably retain and span the conveyor belt 82.

The roller-type pulley 84 serves as a second rotary belt holding member. The roller-type pulley 84 may be disposed opposite to the roller-type pulley 83 and at an upstream side of the sheet conveying direction of the second conveying unit 7. In this example of the present patent application, the conveyor belt 82 as the second rotary belt holding member is disposed in a single unit. However, the second rotary belt holding member is not limited in a single unit. That is, a plurality of second rotary belt holding members can be applied to the present patent application.

It may be useful that the belt-type conveying unit 8 is disposed in such a manner that the leading edge of the sheet S conveyed from the first conveying unit 6 abuts against or contacts the conveying surface 82*a* of the conveyor belt 82, at portions of the conveying surface 82*a* other than portions at which the conveyor belt 82 is held by the roller-type pulley 83 and the roller-type pulley 84. As shown in FIG. 3, the belt-type conveying unit 8 is disposed in such a manner that the axial center of the roller-type pulley 84 or a center of a pulley shaft 84*a* is disposed above the bottom edge of the reverse roller 62 and beneath the height of a downstream end 71*b* of a guide surface 71*a* of a conveying guide member 71. Accordingly, the leading edge of the sheet S may collide with the abdominal portion (i.e., an "effective conveying portion") of the conveyor belt 82, where the conveyor belt 82 constantly and appropriately becomes elastically displaced and/or deformed (when colliding with the sheet S), so that the leading edge of the sheet S does not bounce back. Hence, it is ensured that the leading edge of the sheet S is kept in abutment with the conveying surface 82*a* (also referred to as "belt conveying surface 82*a*") of the conveyor belt 82, so that the effects described below can be achieved.

By contrast, in a case in which the belt-type conveying unit 8 is disposed in such a manner that the leading edge of the sheet S abuts or contacts the conveyor belt 82 at the portions at which the conveyor belt 82 is held by or in contact with the roller-type pulley 83 and the roller-type pulley 84, the following inconvenience may occur. That is, the hardness of the portions at which the conveyor belt 82 is held by the roller-type pulley 83 and the roller-type pulley 84 may generally be greater than the abdominal portion of the conveyor belt 82, and thus the positions may not become elastically displaced and/or deformed as much as the abdominal portion. Hence, this arrangement is disadvantageous as the sheet S bounces back from the conveyor belt 82 because the conveyor belt 82 may not be constantly and appropriately become elastically displaced and/or deformed when the leading edge of the sheet S abuts against the portions at which the conveyor belt 82 is held by the roller-type pulleys 83 and 84. The same disadvantage may be applied to other examples and modified example according to the present patent application described below (hereinafter, also described as "the same disadvantage may be applied to other examples").

Furthermore, as shown in FIG. 4, it may be useful that the belt-type conveying unit 8 is disposed in such a manner that the leading edge of the sheet S conveyed from the first conveying unit 6 approaches the conveying surface 82*a* at an acute collision angle θ1. By arranging the belt-type conveying unit 8 in such a manner, the leading edge of the sheet S may constantly abut the abdominal portion of the conveyer belt 82. Accordingly, it is ensured that the leading edge of the sheet S is kept in contact with the conveying surface 82*a*, so that the effects described below can be achieved.

In a case in which the belt-type conveying unit 8 is disposed in such a manner that the leading edge of the sheet S approaches the conveying surface 82*a* at a substantially perpendicular or orthogonal collision angle, the leading edge of the sheet S may abut against the conveying surface 82*a* in an irregular manner. For example, the sheet S may bend in the opposite direction to which the conveyor belt 82 is moving or the sheet S may bounce back from the conveyer belt 82. Hence, this arrangement is disadvantageous and the same disadvantage may be applied to other examples.

Each of the sheet feeding cassettes 51 in the stages of the sheet feeding device 3 may have a planar shape large enough to store the maximum size of the sheet S used in the copier 1. Each of the sheet feeding cassettes 51 is a substantially flat box with an upper opening and a bottom plate 50 provided at the bottom thereof serves as a sheet stacking unit. The rear end of the bottom plate 50, which is located on the left side as viewed in FIG. 2, is fixed to a horizontal shaft 50A supported by the sheet feeding cassette 51 so that the bottom plate 50 can freely rotate within a given angle range, i.e., so as to pivot back and forth or to oscillate. The free end of the bottom plate 50, which is located on the right side as viewed in FIG. 2, can pivot back and forth about the horizontal shaft 50A inside the sheet feeding cassette 51.

At the bottom of the sheet feeding cassette 51, there is a hollow section of a given shape. A rising arm 52 is provided in the hollow section. The rear end of the rising arm 52 is fixed to a horizontal shaft 52A so that the rising arm 52 can freely rotate within a given angle range, i.e., so as to pivot back and forth, in the hollow section. The horizontal shaft 52A may receive a driving force from a rotational driving source, not shown, causing the horizontal shaft 52A to rotate in arbitrary directions. As the horizontal shaft 52A rotates, the rising arm 52 may be caused to pivot about the horizontal shaft 52A to come to a given tilted position. Accordingly, the free end of the rising arm 52 may push up the bottom plate 50 so that one edge of the topmost face of the sheet S stacked on the bottom plate 50 can be maintained at a given height.

As described above, the sheet feeding cassette 51 stacks or stores the sheets S on the bottom plate 50 and stored therein. Furthermore, the free end of the bottom plate 50 on the right side as shown in FIG. 2 may rise so that the bottom plate 50 may tilt and the sheet S stacked thereon can be pushed up. Therefore, even if the sheets S are fed out one by one and the number of stacked sheet decreases, the topmost surface of the sheets S can constantly be maintained at a given height.

As described above, the sheet feeding cassette 51 can be freely attached to or detached from the main unit of the sheet feeding device 3, namely, the sheet feeding cassette 51 can be inserted in or removed from the main unit of the sheet feeding device 3. For example, the sheet feeding cassette 51 can be set at an inserted position in the main unit of the sheet feeding device 3 as shown in FIG. 1 so that the sheet feeding can be performed. The sheet feeding cassette 51 can be pulled out and detached from the main unit of the sheet feeding device 3 toward the front as shown in FIG. 1 to a detached position, so that sheets S can be supplied or sheets S can be replaced with sheets S of a different size.

At least the first conveying unit 6, the second conveying unit 7, and the first sheet conveying path PA formed between the first conveying unit 6 and the second conveying unit 7 may remain in the main body 2 of the copier 1 even when the sheet feeding cassette 51 is pulled out. The copier 1 serving as an image forming apparatus of an example is an in-body paper eject type (i.e., the sheet eject tray 9 is located within the main body 2 of the copier 1). However, when the belt-type conveying unit 8 serving as the belt-type sheet conveying unit is provided, the curved section of the sheet conveying path of this example can be kept equal to or less than that employing a general technique. Hence, the width of the image forming apparatus or the copier 1 does not need to be increased, so that the advantage of the in-body paper eject type may not be diminished.

A pickup roller 60, which is shown in FIG. 3, is axially rotatably supported by a housing 80, shown in FIGS. 3 and 4, which includes the outer shape of a structure provided on the main unit of the sheet feeding device 3, in such a manner that the pickup roller 60 contacts the topmost face of the sheets S raised to the given height. On an extended line along the direction to which the pickup roller 60 extracts the sheet S, a sheet separation mechanism may be provided for separating one sheet S from the stack of sheets S and for feeding out the separated sheet S. In the sheet separation mechanism, the feed roller 61 and the reverse roller 62 may contact each other by a given pressure level to form a nip contact therebetween.

As illustrated in FIG. 3, the pickup roller 60 may be a known roller that is integrally fixed around a shaft 60*a* that is integrally formed with a cored bar, not shown, and is supported together with the shaft 60*a* so as to freely rotate. Alternatively, a one-way clutch, not shown, can be provided between the shaft 60*a* and the cored bar, and the pickup roller 60 can be supported so as to freely rotate with respect to the shaft 60*a* when the pickup roller 60 is not driven. The circumferential section of the pickup roller 60 including its circumferential surface is made of a soft and highly frictional material such as rubber, which has a high frictional coefficient with respect to the sheet S, so as to easily pick up the sheet S by contacting the sheet S. Furthermore, in order to increase the frictional resistance, substantially sawtooth-shaped projections can be formed over the entire circumferential surface of the pickup roller 60.

There are various sheet separation mechanisms for separating a sheet S from a stack of sheets S to prevent multi-feeding of sheets, i.e., to prevent plural sheets from being sent out at once. In this example, the FRR sheet separation mechanism, which is a return separating method, is employed. Specifically, when two or more sheets S are picked up by the pickup roller 60, one sheet in contact with the feed roller 61 may be separated from the other sheet in contact with the reverse roller 62. The feed roller 61 may continue to send the sheet S in contact therewith in the sheet conveying direction while the reverse roller 62 returns the other sheet in the opposite direction to the sheet conveying direction, back to the original position on the stack of sheets. Furthermore, the reverse roller 62 may be disposed not to obstruct the sheet conveying operation performed by the feed roller 61.

Figure 5:
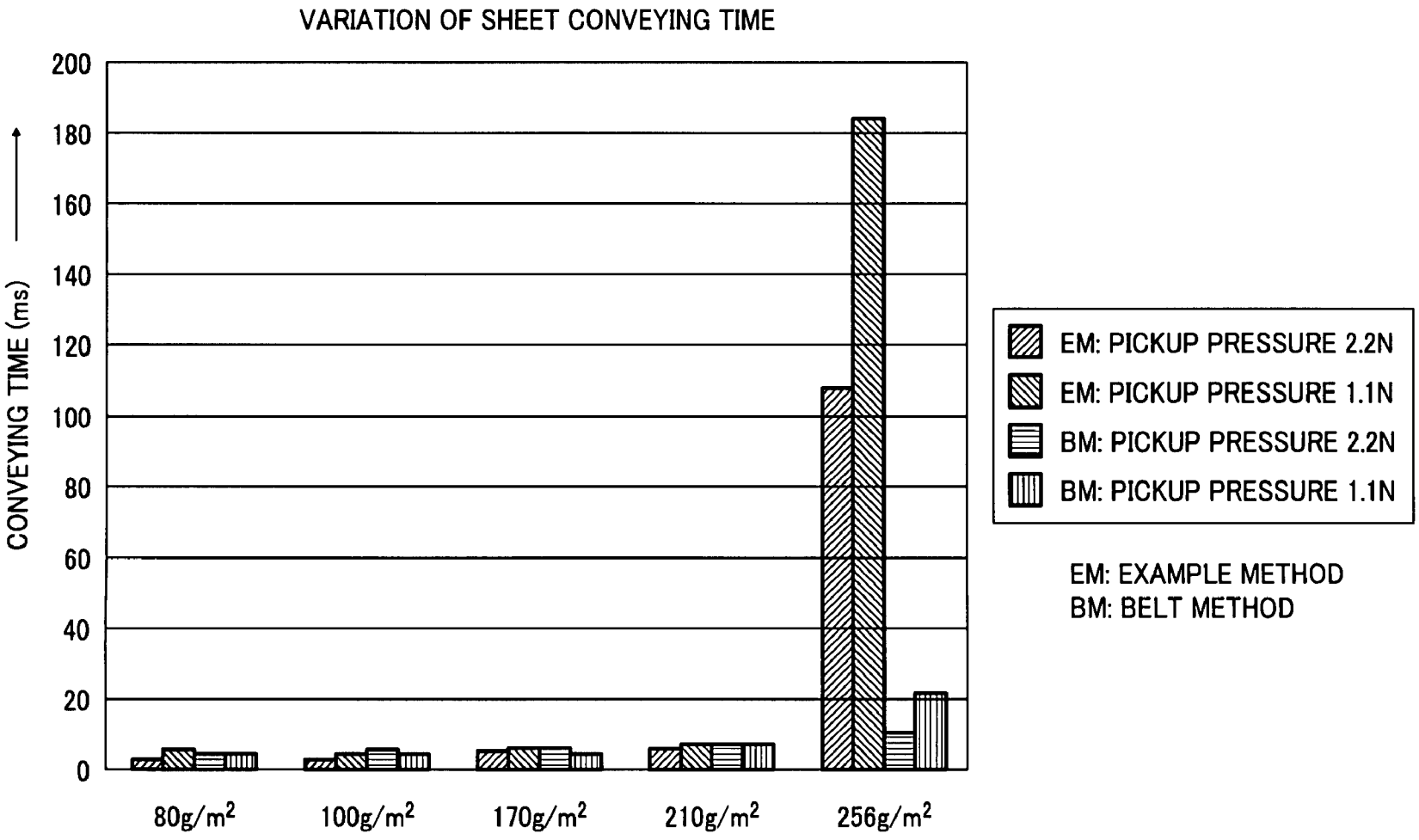
FIG. 5 is a graph showing test results indicating the variation in conveying time with the sheet conveying device of FIG. 2.

For example, the FRR sheet separation mechanism as a sheet separating mechanism includes the feed roller 61 that is rotated in the forward direction of the sheet conveying direction and the reverse roller 62 that is rotated in the reverse direction by receiving a rotational driving force in the reverse direction via a torque limiter, which may correspond to a torque limiter 62*b* shown in FIG. 5. The feed roller 61 may contact the top face of the topmost sheet S fed out from the bottom plate 50, while the reverse roller 62 contacts the bottom face of at least one sheet S under the feed roller 61.

The feed roller 61 can be a roller that is integrally fixed around a shaft 61*a* that is integrally formed with a cored bar, not shown, and is supported together with the shaft 61*a* so as to freely rotate. Alternatively, the feed roller 61 can be supported in a similar manner to the pickup roller 60.

Similarly to the pickup roller 60, the circumferential section of the feed roller 61, including its circumferential surface, is made of a soft and highly frictional material such as rubber, which has a high frictional coefficient with respect to the sheet S, so as to easily convey the sheet S in the sheet travel direction by contacting the sheet S. Furthermore, in order to increase the frictional resistance, substantially sawtooth-shaped projections can be formed over the entire circumferential surface of the feed roller 61.

The reverse roller 62 is integrally formed with a cored bar, not shown, and is supported together with a reverse roller driving shaft 62*a* by the housing 80 so as to freely rotate by receiving a rotational driving force via the torque limiter 62*b* (see FIG. 5).

In the FRR sheet separation mechanism, the reverse roller 62 may receive a low level of torque in a direction opposite to that of the rotational direction of the feed roller 61 via the torque limiter 62*b*. Therefore, when the reverse roller 62 is held in contact with the feed roller 61, or when one sheet S enters in between the feed roller 61 and the reverse roller 62, the reverse roller 62 may rotate following the rotation of the feed roller 61. That is, the function of the torque limiter 62*b* may cause the reverse roller 62 to slip on the reverse roller driving shaft 62*a*, so that the reverse roller 62 can rotate in a forward direction of the sheet feeding direction, similarly to the feed roller 61. Conversely, when the reverse roller 62 is separated from the feed roller 61 or when two or more sheets S enter in between the feed roller 61 and the reverse roller 62, the reverse roller 62 may rotate in the opposite direction. Therefore, when more than one sheet S enters in between the feed roller 61 and the reverse roller 62, the reverse roller 62 may return the sheet S other than the topmost sheet S in contact with the feed roller 61, i.e., the sheets S in contact with the reverse roller 62, toward the upstream side of the sheet conveying direction. Accordingly, it is possible to prevent multi-feeding of sheets S or feeding more than one sheet S at once.

Therefore, the conveying force applied from the reverse roller 62 to the sheet S in contact therewith is large enough in the reverse direction for returning the sheet S to its original position on the stack of sheets S. However, this conveying force is sufficiently smaller than the conveying force applied from the feed roller 61 to the sheet S for conveying the sheet S in the forward direction, so as not to obstruct the feed roller 61 from conveying the sheet S in the forward direction. Due to the above-described configuration, the conveying force applied from the feed roller 61 to the sheet S can be reduced by the opposite conveying force applied from the reverse roller 62 to the sheet S.

As shown in FIGS. 2 through 4, the sheet conveying device 5 further includes an idler gear 65 that is joined to a driving shaft that outputs a rotational driving force from a driving source provided in the main unit of the sheet feeding device 3. The idler gear 65 may distribute and transmit a rotational driving force supplied from the sheet feeding device 3 through the engagement of gears or through a belt to the pickup roller 60 and the feed roller 61 to rotate then at given speeds.

At a diagonally upper position of the feed roller 61, the grip roller 81 is provided as the other rotary conveyance member of the second pair of rotary conveyance members including the second conveying unit 7. The grip roller 81 is rotatably supported by the housing 80 via a rotational driving shaft 81*a* integrally provided with the grip roller 81. Similarly to the feed roller 61, the circumferential section of the grip roller 81 including its circumferential surface is made of a soft and highly frictional material such as rubber, which has a high frictional coefficient with respect to the sheet S, so as to easily convey the sheet S in the sheet conveying direction by contacting the sheet S.

The pulley 83 is provided in the vicinity of the grip roller 81. The pulley 83 is axially rotatably supported by the housing 80 so as to contact the circumferential surface of the grip roller 81 via the conveyor belt 82, facing the grip roller 81 in a horizontal direction.

The pulley 83 is integrally formed with a pulley shaft 83*a*, and is rotatably supported together with the pulley shaft 83*a* by the housing 80. The pulley 84 is disposed at a diagonally downward left position of the pulley 83, and is axially rotatably supported by the housing 80. The pulley 84 is integrally formed with the pulley shaft 84*a*, and is rotatably supported and held together with the pulley shaft 84*a* by the housing 80. The pulleys 83 and 84 serve as the first and second rotary belt holding members for rotatably holding the conveyor belt 82. Both of the pulley shaft 83*a* and the pulley shaft 84*a* may be formed in a single continuous axis, and formed by a material such as iron.

The arrangement of the belt-type conveying unit 8 is not limited to the above-described descriptions. The belt-type conveying unit 8 can be arranged as follows. For example, as shown in FIG. 3, the sheet conveying device 5 further includes an opening and closing guide 79 that opens and closes with respect to the housing 80, as a part of the sheet conveying device 5, which is shown in FIGS. 13A and 13B.

Figure 13A:
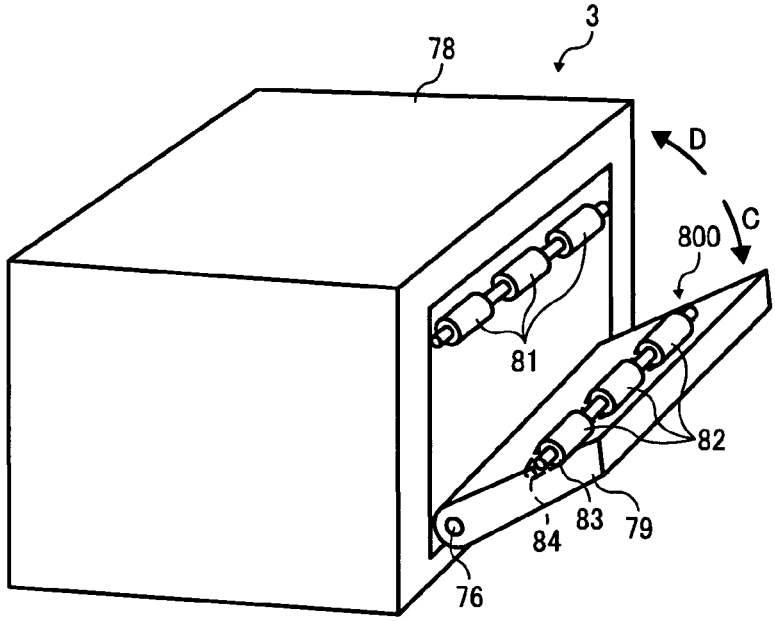
FIG. 13A is a perspective view of a sheet feeding device including the sheet conveying device of FIG. 2.
Figure 13B:
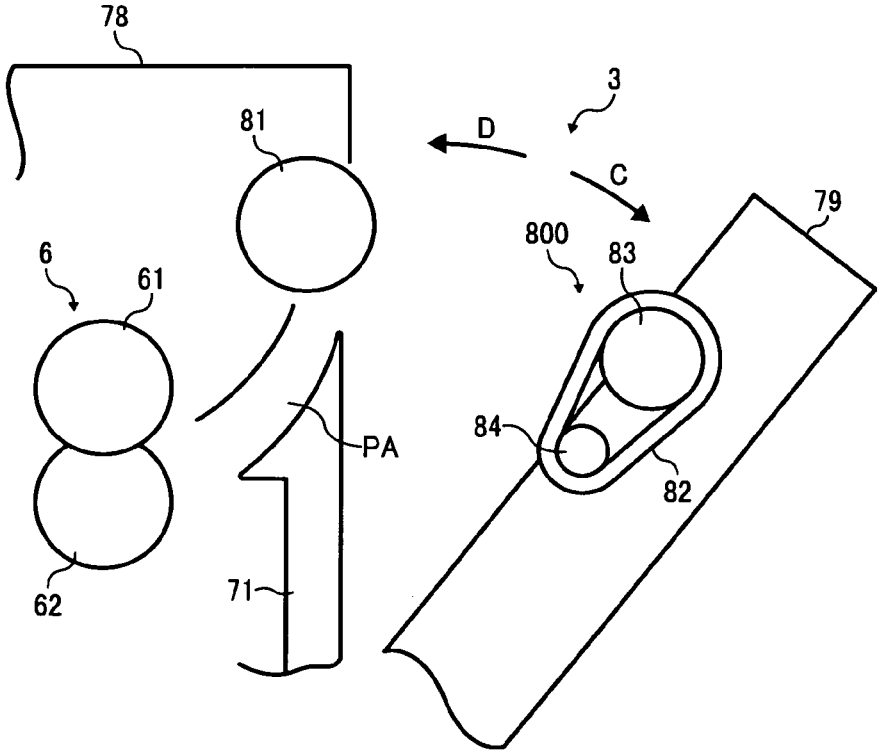
FIG. 13B is a partial cross-sectional view of the sheet feeding device of FIG. 13A.

As shown in FIGS. 13A and 13B, the sheet feeding device 3 includes a main body 78 having the opening and closing guide 79 serving as an opening and closing unit. The opening and closing guide 79 may separate a vertical conveying path directing vertically upward, which serves as a common conveying path corresponding to the second sheet conveying path PB. The opening and closing guide 79 may cause the conveyor belt 82 to be contacted and separated with respect to the grip roller 81 by pivoting around a fulcrum shaft, not shown, disposed below the housing 80. Therefore, the opening and closing guide 79 of the sheet feeding device 3 having the configuration shown in FIGS. 13A and 13B may make it easier for a user to resolve a paper jam in the first sheet conveying path PA or the vertical conveying path extending substantially upward and can effectively remove a jammed paper or papers therefrom.

The pulleys 83 and 84 and their respective pulley shafts 83*a* and 84*a* are rotatably supported by the opening and closing guide 79 when the sheet conveying device 5 of the copier 1 is provided with the opening and closing guide 79.

The conveyor belt 82 is formed as an endless belt stretched around the pulleys 83 and 84, as described above. The axes of the pulleys 83 and 84 are spaced apart by a given distance. The linear belt traveling surface or the conveying surface 82*a* of the conveyor belt 82 between the pulleys 83 and 84 is disposed at a position to ensure that the linear belt traveling surface thereof is caused to contact the leading edge of the sheet S sent out from the first conveying unit 6. As described above, the circumferential surface, which is the conveying surface 82*a*, of the conveyor belt 82 stretched around the circumferential surface of the pulley 83 may directly contact the circumferential surface of the grip roller 81 at a given pressure level. The portion at which the conveyor belt 82 contacts the grip roller 81 corresponds to the sheet holding section or nip contact.

For example, a pressing member, not shown, may be attached to a bearing member or supporting member, not shown, for supporting the pulley shaft 83*a*. This forcing unit may press the conveyor belt 82 against the grip roller 81.

The conveyor belt 82 is made of an elastic material such as rubber. The frictional coefficient of the surface of the conveyor belt 82 may be specified at a given value with respect to the conveyed sheets S. The frictional coefficient is defined by characteristics of the material of the conveyor belt 82 itself or by treating the surface with an appropriate process. For example, the frictional coefficient may be specified to ensure that an outer circumferential surface or the conveying surface 82*a* of the conveyor belt 82 may transmit a conveying and propelling force to the face of the sheet S in contact with the conveyor belt 82, without allowing the sheet face to slip along the conveying surface 82*a* of the conveyor belt 82.

The belt width of the conveyor belt 82 in a sheet width direction perpendicular or orthogonal to the sheet conveying direction may be at least substantially equal to the width of a maximum size sheet to be conveyed. That is, the belt width of the conveyor belt 82 may substantially be equal to or wider than the width of a maximum size sheet to be conveyed. The sizes in the sheet width direction or axial lengthwise direction of the pulleys 83 and 84 around which the conveyor belt 82 is stretched and the grip roller 81 facing and contacting the conveyor belt 82 are equal to or larger than the above-described belt width of the conveyor belt 82. Hence, it is ensured that the entire width of the sheet S sent out from the first conveying unit 6 contacts the conveyor belt 82, so that the contact area therebetween can be increased. Accordingly, it is possible to increase the conveying and propelling force for conveying the sheet S in conveying direction. The conveying and propelling force may constantly be transmitted to the sheet S from the conveyor belt 82 moving in the sheet travel direction.

A rotational driving source, not shown, such as an electric motor provided specifically for rotating the grip roller 81 is connected to the rotational driving shaft 81*a* of the grip roller 81 via a driving force transmitting unit, not shown, such as a gear or a belt. For example, see a driving mechanism 22 shown in FIGS. 11 and 12. The grip roller 81 may be rotated by receiving a rotational driving force of a given rotational speed from the rotational driving source via the driving force transmitting unit. Accordingly, the grip roller 81 serves as a rotary feed drive member, while the conveyor belt 82 in contact with the grip roller 81 may act as a subordinate belt that is caused to move following the rotation of the grip roller 81 serving as the rotary feed drive member, and the pulley 83 supporting the contact portion between the conveyor belt 82 and the grip roller 81 from inside the belt may act as a subordinate roller that is caused to rotate via the subordinate belt or the conveyor belt 82. As a matter of course, the pulley 84 may also act as a subordinate roller that is caused to rotate via the subordinate belt or the conveyor belt 82.

Figure 11:
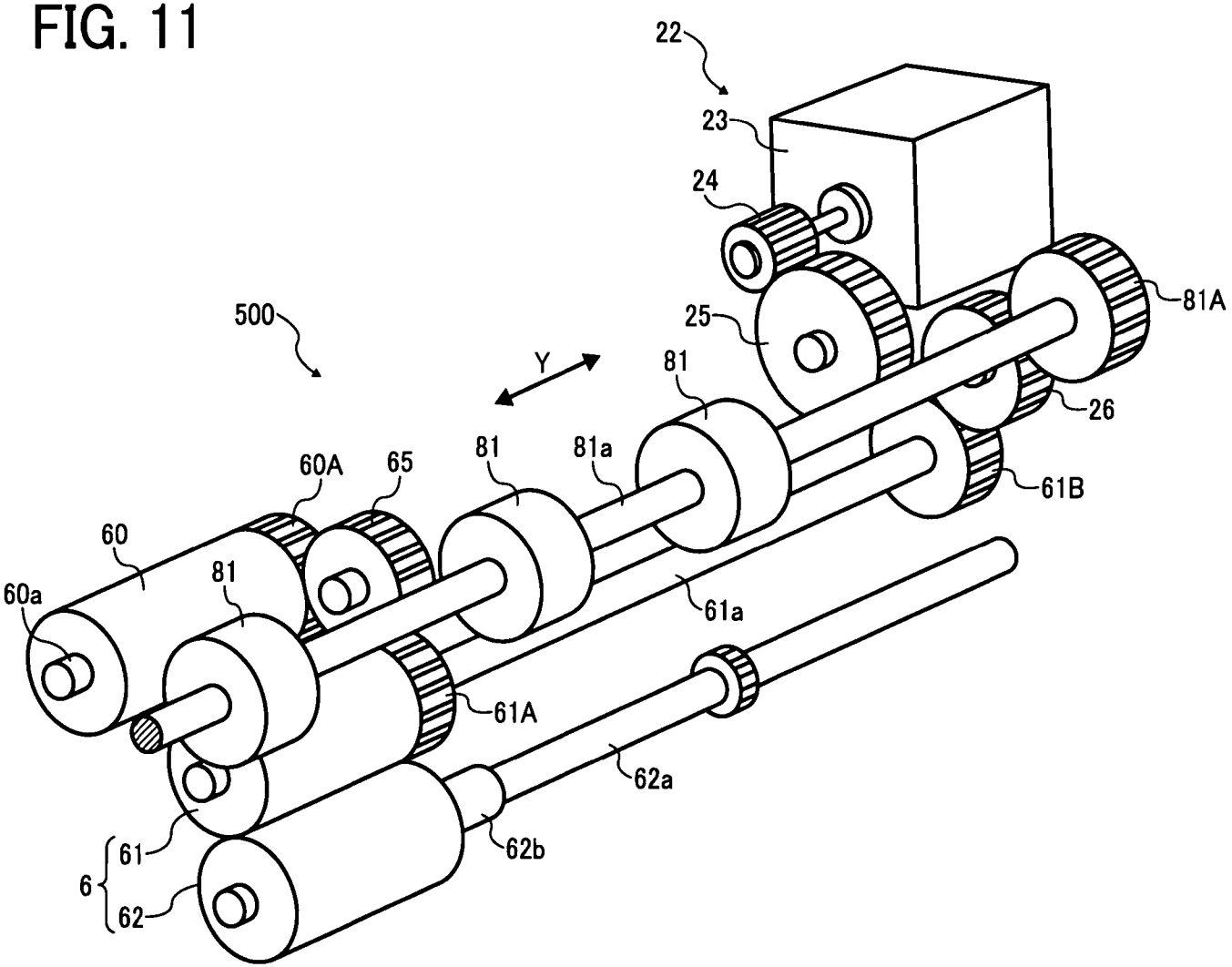
FIG. 11 is a schematic perspective view of a driving mechanism of the sheet conveying device of FIG. 2.
Figure 12:
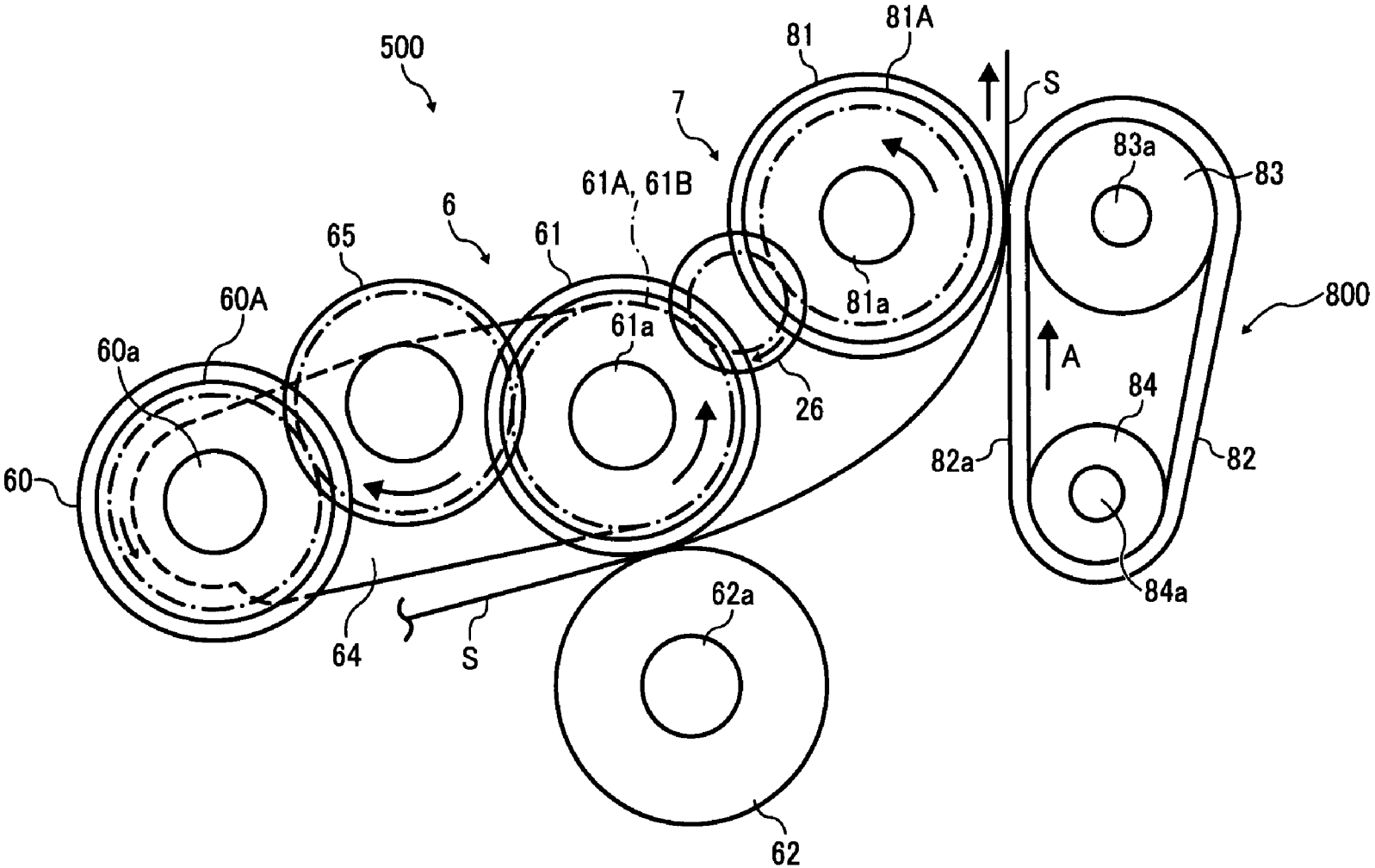
FIG. 12 is a schematic front view of relevant parts of the driving mechanism of FIG. 11.

Alternatively, a driving force transmitting unit and/or other corresponding parts for driving the grip roller 81 may be removed from the driving mechanism 22 shown in FIGS. 11 and 12 so as to cause the grip roller 81 as a rotated member and a driving mechanism, not shown, may drive the conveyor belt 82.

As shown in FIGS. 2 through 4, a conveying guide member 70 is positioned in the inner area of the sheet conveying device 5, including a curved guide surface 70*a* (FIGS. 3 and 4) swelling in a substantially downward direction with which the sheet S comes in contact. The conveying guide member 71 is positioned in the outer area of the sheet conveying device 5, including the guide surface 71*a* curved in a caved-in or concave shape in accordance with the conveying guiding member 70. Furthermore, the conveying guide member 71 is spaced apart with a given gap from the guide surface 70*a* of the conveying guiding member 70. The conveying guiding members 70 and 71 are both fixed to the housing 80. Accordingly, the first sheet conveying path PA is formed between the first conveying unit 6 and the second conveying unit 7, by arranging the guide surface 70*a* of the conveying guide member 70, the guide surface 71*a* of the conveying guide member 71 facing the conveying guiding member 70, and the conveying surface 82*a* of the conveyor belt 82 as described above.

As shown in FIGS. 3 through 5, the conveying guide member 72 is positioned along the outer side of the vertical conveying path extending substantially upward from the second conveying unit 7. The conveying guide member 72 includes a guide surface 72*a* that moves in a vertical direction facing the guide surface 70*a* with a given gap or a given opening gap with respect to the guide surface 70*a*.

A conveying guide member 73 may provide a sheet conveying path from the sheet feeding cassette 51 to the sheet holding section or nip contact between the feed roller 61 and the reverse roller 62, and provide an inlet for guiding the sheet S into the nip contact.

Accordingly, the vertical conveying path communicating with or connected to the sheet conveying path R1 is formed by the vertical conveying guide surface 72*a* of the conveying guide member 72 and the guide surface 70*a* of the conveying guiding member 70. The curved surface or guide surface 70*a* of the conveying guiding member 70 may swell in a substantially downward direction (toward the conveying guide member 71 provided on the outer side), beneath a line connecting the nip contacts of the first conveying unit 6 and the second conveying unit 7. The degree of swelling is defined so that the sheet S can moderately bend to ensure that the leading edge of the sheet S reaches the conveying surface 82*a* of the conveyor belt 82.

As shown in FIG. 1, the configuration of the upper stage of the sheet feeding device 3 is the same as that of a known technique. The difference from the lower stage described above is that a sheet conveying device 5' is employed instead of the sheet conveying device 5. The sheet conveying device 5' is different from the sheet conveying device 5 in that the sheet conveying device 5 employs the second conveying unit 7' instead of the second conveying unit 7. The second conveying unit 7' is different from the second conveying unit 7 in that the second pair of rotary conveyance members only includes the grip roller 81 and a subordinate roller that is caused to rotate following the rotation of the grip roller 81, which is practically the same size and shape as the pulley 83. The sheet feeding cassette 51 of the upper stage and the sheet conveying device 5' can be used for sheets S of a relatively low rigidity such as plain paper and not for sheets S of a relatively high rigidity such as cardboard recording papers or envelopes.

Next, a description is given of a sheet feeding operation of feeding a sheet S from a given stage in the sheet feeding device 3 and a conveying operation of conveying the sheet S of the sheet conveying device 5 that starts in conjunction with the sheet feeding operation.

As shown in FIG. 2, the sheets S stacked on the bottom plate 50 may be raised by the pivoting and rising movement of the rising arm 52 so that the topmost face can be located at a given height. First, the pickup roller 60 rotates to extract the topmost sheet S, and sends the topmost sheet S to the sheet separation mechanism including the feed roller 61 and the reverse roller 62. In the sheet separation mechanism, the feed roller 61 and the reverse roller 62 may cooperate with each other to separate only the topmost sheet from the others. The separated sheet S may be conveyed to the downstream side of the sheet conveying path. As shown in FIGS. 2 and 3, the leading edge of the sheet S may be guided and moved as the conveyor belt 82 travels in the direction indicated by the arrow while being kept in contact with the belt conveying surface 82*a*. When the leading edge of the sheet S reaches the nip contact between the grip roller 81 and the conveyor belt 82, the grip roller 81 and the conveyor belt 82 may hold the sheet S and convey the sheet S further vertically upward, and finally send out the sheet S in a vertical manner.

For example, the leading edge of the sheet S is held by the nip contact of the feed roller 61 and the reverse roller 62, sent out from the nip contact, and then reaches and contacts the belt conveying surface 82*a* of the conveyor belt 82 as shown in FIG. 2.

As shown in FIG. 3, as the conveying surface 82*a* of the conveyor belt 82 may move in the sheet travel direction by the movement of the conveyor belt 82 in the direction indicated by an arrow "A", the sheet S may gradually bend starting from the leading edge thereof. As the sheet S bends further, the contact area between the belt conveying surface 82*a* and the face of the sheet S may become larger. Hence, even if the sheet S is a highly rigid sheet, a sufficient amount of conveying and propelling force can be applied from the belt conveying surface 82*a* to the face of the sheet S in order to convey the sheet S in the sheet travel direction. When conveyance resistance is generated while the highly rigid sheet S is being conveyed and considerably bent, the conveying and propelling force applied to the sheet S by the first conveying unit 6 alone may be insufficient for conveying the sheet S. This insufficiency can be thoroughly compensated for by the conveying and propelling force applied to the sheet S from the belt-type conveying unit 8. Thus, it is possible to prevent conveyance failures of the sheet S at least between the first conveying unit 6 and the second conveying unit 7 so that the leading edge of the sheet S can reach the nip contact of the second conveying unit 7.

The conveying surface 82*a* of the conveyor belt 82 may continuously extend to the nip contact of the second conveying unit 7, thus ensuring that the leading edge of the sheet S in contact with the conveying surface 82*a* smoothly and constantly reaches the sheet holding section or nip contact. In other words, a highly rigid sheet S being conveyed by the first conveying unit 6 may be caused to bend moderately so that the leading edge of the sheet S may be more reliably contact the belt conveying surface 82*a*. The belt conveying surface 82*a* may apply an active conveying and guiding effect to the leading edge of the sheet S in contact thereto. Accordingly, the sheet S may receive a second conveying and propelling force from the belt conveying surface 82*a* for moving in the sheet conveying direction. Subsequently, the sheet S may be caused to bend even further so as to reach the sheet holding section of the second conveying unit 7.

After the leading edge of the sheet S has reached the second conveying unit 7, the sheet S is held and conveyed by both the first conveying unit 6 and the second conveying unit 7. Thus, a sufficient amount of conveying force may be applied to the sheet S from both the first conveying unit 6 and the second conveying unit 7. Therefore, it is possible to continue to convey the highly rigid sheet S in a smooth manner. After the trailing edge of the sheet S has been separated from the first conveying unit 6, the sheet S can no longer receive a conveying force from the first conveying unit 6. However, this loss may be compensated for by the conveying and propelling force from the belt conveying surface 82*a* applied once again to the sheet S, depending on how the sheet S is contacting the belt conveying surface 82*a* between the sheet holding section of the second conveying unit 7 and the trailing edge of the sheet S.

Furthermore, the sheet S may gradually become less bent. Therefore, it is possible to continue to convey the sheet S even after the trailing edge of the sheet S has been separated from the first conveying unit 6. Accordingly, in the sheet conveying device 5, it may be more reliable that the sheet S from the first conveying unit 6 is steadily sent to the second conveying unit 7 and then to the downstream sheet conveying path, regardless of the rigidity of the sheet S.

As described above, the belt-type conveying unit 8 is disposed along the outer side of the first sheet conveying path PA formed between the first conveying unit 6 and the second conveying unit 7. The belt-type conveying unit 8 may serve as the belt-type sheet conveying unit for moving and guiding the sheet S toward the second conveying unit 7 while keeping the leading edge of the sheet S in contact with the belt.

In this example, the belt-type conveying unit 8 serving as the belt-type sheet conveying unit may also have a function of changing, with the conveyor belt 82, the traveling direction of the sheet S into a direction toward the sheet holding section or nip contact of the second conveying unit 7.

Next, with reference to FIG. 5, results of a comparative test on an example of the present patent application with reference to FIGS. 1 through 3 are described.

A comparative test was conducted to compare the sheet conveying or passing properties of a copier according to this example to which the present patent application is applied (indicated as "BELT METHOD" in Table 1) and a copier according to a known method (indicated as "EXAMPLE METHOD" in Table 1).

Among the components of "imagio Neo453" manufactured by RICOH, only a sheet feeding device was modified to be used for the "BELT METHOD" of this comparative test. The modified sheet feeding device used for the "BELT METHOD" basically has the same configurations and specifications as that of the sheet conveying device 5 of the sheet feeding device 3 shown in FIGS. 1 through 3.

For the "EXAMPLE METHOD", "imagio Neo453" manufactured by RICOH including a sheet feeding device with a known sheet conveying device was used. Specifically, the known sheet conveying device corresponds to the sheet conveying device 5' of the sheet feeding device 3 shown in FIG. 1. That is, the sheet conveying device for "EXAMPLE METHOD" is different from the sheet conveying device for "BELT METHOD" according to the above-described example embodiment with reference to FIGS. 1 through 3, and includes the roller-type pulley 83 to be the only rotary conveyance member facing and contacting the grip roller 81 and does not include the conveyor belt 82 and the roller-type pulley 84.

Details of the belt-type conveying unit 8 and peripheral components used for this comparative test in the belt method are described below (components commonly applied to the example method can be included as well):

Material of the conveyor belt 82: ethylene propylene rubber (EPDM);

Hardness of the conveyor belt 82: JIS K6253 A type 40 degrees;

Frictional coefficient of the conveyor belt 82 with respect to sheet: 2.6;

Wall thickness of the conveyor belt 82: 1.5 mm;

Diameter of the roller-type pulley 83: 13 mm;

Diameter of the roller-type pulley 84: 7 mm;

Gap or distance between the roller-type pulleys 83 and 84: 13 mm (distance between axes of pulley shafts 83*a* and 84*a*);

Extension factor of the conveyor belt 82: 7%; and

Diameter of the rollers 60, 61, 62, and 81: all 20 mm.

As the basic test conditions, the weight of a sheet (meter basis weight or grams per square meter ($g/m^2$)) was employed to represent the stiffness (rigidity) of the sheet. Six types of sheets with different weights were passed through the above copies from sheet feeding trays corresponding to the same stages under an environment of normal temperature (23 degree Celsius, relative humidity 50%). Other test conditions described below with reference to FIG. 4 were also applied to test differences in conveying time between the different types of sheets. The test results indicating the differences in conveying time are shown in FIG. 5, and Table 1 indicates a summary of the sheet passing properties based on the test results shown in FIG. 5.

The sheet conveying device 5 shown in FIG. 4 further includes a sheet feeding sensor 88 and a vertical conveyance sensor 89. The sheet feeding sensor 88 detects the leading edge of the sheet S picked up by the pickup roller 60, and the vertical conveyance sensor 89 detects the leading edge of the sheet S conveyed by the second conveying unit 7 for "BELT METHOD" or the pair of the grip roller 81 and the roller-type pulley 83 for "EXAMPLE METHOD". The sheet feeding sensor 88 and the vertical conveyance sensor 89 are both reflection type photo-sensors.

The conveying path length (sheet conveying distance) between the positions at which the sheet feeding sensor 88 and the vertical conveyance sensor 89 are disposed is 57 mm for both in the belt method and the example method. The conveying path length between the position at which the sheet feeding sensor 88 is disposed and the nip contact between the feed roller 61 and the reverse roller 62 is 10 mm. The conveying path length between the nip contact between the feed roller 61 and the reverse roller 62 and the nip contact of the second conveying unit 7 for "BELT METHOD" or between the nip contact between the feed roller 61 and the reverse roller 62 and the nip contact between the grip roller 81 and the roller-type pulley 83 for "EXAMPLE METHOD" is 38 mm for both methods. And, the conveying path length between the nip contact of the second conveying unit 7 for "BELT METHOD" and the position where the vertical conveyance sensor 89 is disposed or between the nip contact between the grip roller 81 and the roller-type pulley 83 for "EXAMPLE METHOD" and the position where the vertical conveyance sensor 89 is disposed to 9 mm for both methods. Accordingly, the total conveying path length is 57 mm for both methods.

The curvature radius at the center of the curved sheet conveying path or first sheet conveying path PA between the first conveying unit 6 and the second conveying unit 7 of the sheet conveying device 5 is approximately 20 mm for both the belt method and the example method.

For both the belt method and the example method, tests were conducted for two different values of a parameter including the pickup pressure or sheet feeding pressure of the pickup roller 60, namely 1.1N and 2.2N. The linear speed of both the feed roller 61 on the driving side and the grip roller 81 on the driving side was 154 mm/s. The time required for the leading edge of the sheet S to be conveyed from the sheet feeding sensor 88 to the vertical conveyance sensor 89, corresponding to 57 mm of the conveying path, was measured for five different types of paper with an oscilloscope. Results indicating differences between the conveyance times between different types of paper are shown in the graph of FIG. 5.

The graph of the test results in FIG. 5 show that in the example method, if the sheet is 256 $g/m^2$ meter basis weight or more, the conveyance time considerably changes or becomes long or the amount of variations in the conveyance time is great, and the sheet is caused to slip considerably. Meanwhile, in the belt method to which the present patent application is applied, even if the sheet is 256 $g/m^2$ meter basis weight or more, the conveyance time changes only scarcely or does not become as long as the example method or the amount of variations in the conveyance time is small, and the sheet is caused to slip only scarcely. Furthermore, if the pickup pressure is reduced, the conveying force decreases. However, in the belt method to which the present patent application is applied, the conveying force may not be affected as much even if the pickup pressure is reduced. This means that the pickup pressure can be made smaller by employing the belt method to which the present patent application is applied, and therefore, the power of the driving motor can be reduced. As a result, the apparatus can be made compact.

Table 1 summarizes the sheet passing properties based on the test results shown in FIG. 5.

In Table 1, "meter basis weight" corresponds to the weight (grams) of a sheet per one square meter. In general, a sheet with a small meter basis weight is "light paper" or "thin paper", and a sheet with a large meter basis weight is "heavy paper" or "thick paper."

In the first test results shown in Table 1, "GOOD" indicates that "sheet passing property is good."

Specifically, "GOOD" means that the leading edge of the sheet S reached the vertical conveyance sensor 89 within a given time after the sheet feeding sensor 88 had turned on and detected the leading edge of the sheet S. Conversely, "POOR" indicates that "sheet passing property is unacceptable."Specifically, "POOR" means that the leading edge of the sheet S did not reach the vertical conveyance sensor 89 within a given time after the sheet feeding sensor 88 had turned on and detected the leading edge of the sheet S.

TABLE 1

| METER BASIS WEIGHT | EXAMPLE METHOD | BELT METHOD |
|---|---|---|
| 80 g/m$^2$ | GOOD | GOOD |
| 100 g/m$^2$ | GOOD | GOOD |
| 170 g/m$^2$ | GOOD | GOOD |
| 210 g/m$^2$ | GOOD | GOOD |
| 256 g/m$^2$ | POOR | GOOD |
| 300 g/m$^2$ | POOR | GOOD |

GOOD: sheet passing good; and
POOR: sheet passing unacceptable.

In the first test results shown in Table 1, if the paper type is 256 g/m$^2$ meter basis weight or more, the results were "POOR" in the example method, whereas all of the results were "GOOD" in the belt method according to the this example to which the present patent application is applied shown in FIGS. 1 through 4.

By comparing the sheet passing and conveying properties observed in the test, the inventors have found that, in the example method, if the paper type is 256 g/m$^2$ meter basis weight or more, the sheet may be too stiff to bend along the curved sheet conveying path. Hence, the leading edge of the sheet S may be disadvantageously crushed against the roller-type pulley 83 that faces and contacts the grip roller 81 (see FIGS. 1 through 4).

Furthermore, tests were conducted with sheets of 256 g/m$^2$ meter basis weight or more with coated surfaces and uncoated surfaces to observe whether it makes a difference in sheet passing and conveying properties. However, no particular results distinguishable from those of the first test shown in Table 1 were obtained.

The conclusions described below can be made from the tests results observed in the above-described example embodiment. That is, when a highly rigid sheet that is 256 g/m$^2$ meter basis weight or more is conveyed from the first conveying unit 6 to the conveying surface 82*a* of the belt-type conveying unit 8 via the first sheet conveying path PA, the following configuration can be achieved. For example, because the highly rigid sheet is capable of being conveyed in a rectilinear manner, various guiding members including the first sheet conveying path PA can be made to have simplified shapes so as to reduce the conveyance load resistance, or the various guiding members can be completely omitted.

Therefore, in the sheet conveying device dedicated for conveying the sheet S with a relatively high rigidity, the essential components are the first conveying unit 6, the second conveying unit 7, and the belt-type conveying unit 8 (moving and guiding unit) for guiding the sheet to the second conveying unit 7 while keeping the leading edge of the sheet S in contact with the belt-type conveying unit 8. The belt-type conveying unit 8 is disposed along the outer side of the first sheet conveying path PA (in this case, guiding members are unnecessary) formed between the first conveying unit 6 and the second conveying unit 7.

For the above-described reasons, the various guiding members forming the first sheet conveying path PA are necessary for conveying a sheet S with a relatively low rigidity, such as plain paper (PPC). As such a PPC sheet S cannot be conveyed in a rectilinear manner compared to the case of a highly rigid sheet S such as a cardboard recording paper, the various guiding members of the first sheet conveying path PA are necessary to compensate for this disadvantage in guiding the sheet S to the conveying surface 82*a* of the belt-type conveying unit 8. That is, as the rigidity of the sheet S becomes lower, the sheet S moves in a less rectilinear manner. Therefore, to assist the sheet S to move in a rectilinear manner, guiding surfaces of the various guiding members in the first sheet conveying path PA may need to have appropriate shapes so as to ensure that the leading edge of the sheet S abuts against the abdominal portion of the conveying surface 82*a* of the conveyor belt 82.

This means that the higher the rigidity of the sheet S (more meter basis weight) becomes, the more flexible the design of the shapes and positions of the various guide members including the sheet conveying path with a curved section of a relatively small curvature radius can be obtained.

The material of the conveyor belt 82 is not limited to that of the above-described comparative test. That is, the material can be, for example, chloroprene rubber, urethane rubber, or silicon rubber. The hardness of the rubber of the conveyor belt 82 can be JIS K6253 A type in a range from 40 degrees to 80 degrees (JIS: Japan Industrial Standard).

It is noted that the present patent application is not limited to show that a sheet having a great meter basis weight, which is a relatively rigid paper, can be transferred without causing any transfer failure. For example, Table 1 described in the present patent application proves that, by the use of the belt-type conveying unit 8, even a sheet having a great meter basis weight can be transferred.

According to the results of the above-described comparative test, the curvature radius of the first sheet conveying path PA can be formed relatively small. Therefore, the sheet conveying device 5 shown in FIGS. 1 through 4 and the copier 1 including the sheet conveying device 5 can provide a configuration thereof that is compact and space-saving in the width direction of the main body 2 of the copier 1, simple, low-cost, and capable of conveying various sheet types. The basic configuration can be made by adding the belt-type conveying unit 8 provided with a conveyor belt stretched around rollers included in the second conveying unit 7, and a driving source dedicated to the belt-type conveying unit 8 can be omitted. Therefore, it is possible to realize a sheet conveying device or the sheet conveying device 5 in an image forming apparatus or the copier 1 that has a simple configuration that is thus low-cost.

In the configuration provided for a known sheet conveying device, a conveyance failure may occur when a highly rigid type of sheet is conveyed. The failure can be caused by a large conveyance resistance generated as the sheet contacts the conveying guiding member 70, or by a conveyance load in the first sheet conveying path PA between the first conveying unit 6 and the second conveying unit 7. In the configuration provided for a known sheet conveying device, a conveyance failure may occur when a highly rigid type of sheet is conveyed. The failure can be caused by a large conveyance resistance generated as the sheet contacts the conveying guiding member 70, or by a conveyance load in the first sheet conveying path PA between the first conveying unit 6 and the second conveying unit 7. However, the sheet conveying device 5 according to this example of the present patent application can convey highly rigid sheets without failures, and can thus convey various sheet types.

That is, the known configuration merely provides a fixed member for guiding a sheet, and thus does not eliminate the sheet difference between the conveyed sheet, which is a mobile object, and the fixed guiding member. As a result, a conveyance resistance is constantly generated.

By contrast, in the sheet conveying device 5 and the copier 1 according to this example with reference to FIGS. 1 through 4 of the present patent application, the conveyance resistance can be substantially completely eliminated. In addition, the sheet can be guided by actively applying a conveying and propelling force to move the sheet in the downstream direction or the conveying force of the second conveying unit 7 may be applied to the sheet in addition to the conveying force of the first conveying unit 6 so as to counter the conveyance load in the first sheet conveying path PA between the first conveying unit 6 and the second conveying unit 7 and move the sheet in the downstream direction.

In the sheet conveying device 5, the frictional resistance between the sheet S and the conveyor belt 82 may not obstruct the sheet S from being conveyed. Further, the frictional resistance may function as a negative resistance to apply a conveying and propelling force to the sheet S. That is, the frictional resistance may not obstruct the sheet S from being conveyed, but may be converted into an advantageous negative resistance to apply a conveying and propelling force to the sheet S.

Furthermore, in the conveying direction of the sheet S, as the leading edge of the sheet S abuts against the moving surface or conveying surface 82*a* of the conveyor belt 82 and is then conveyed forward by the conveyor belt 82, the leading edge of the sheet S gradually may overlap the outer circumferential surface 82*a* of the conveyor belt 82, even though there may be differences according to the rigidity of the sheet type. As a result, the area of the sheet in contact with the moving surface of the belt gradually can increase. Thus, the resistance between the sheet and the outer circumferential surface 82*a* of the conveyor belt 82 may increase as the contact area increases. Therefore, an even larger conveying and propelling force for moving the sheet S in the conveying direction can be applied from the conveyor belt 82 to the sheet S. Further, the conveyor belt 82 can change the direction of the sheet S in a direction toward the nip contact between the grip roller 81 and the conveyor belt 82. This configuration can ensure a steady increase of the conveying and propelling force transmitted from the outer circumferential surface or conveying surface 82*a* of the conveyor belt 82 to the sheet surface.

Therefore, even if the sheet S is highly rigid, it is possible to overcome this rigidity and appropriately deform or bend the sheet S in its thickness direction, and thereby ensuring that the sheet S is steadily conveyed toward the sheet holding section of the second conveying unit 7 in the downstream direction. In this manner, it is possible to address the factors of major conveyance failures caused by the fact that the sheet S is highly rigid. Therefore, it is ensured that the sheet S can be steadily conveyed after the leading edge of the sheet S reaches the sheet holding section of the second conveying unit 7. As a result, the sheet conveying device 5 can convey various types of sheets and achieve excellent sheet conveying properties.

Figure 6A:
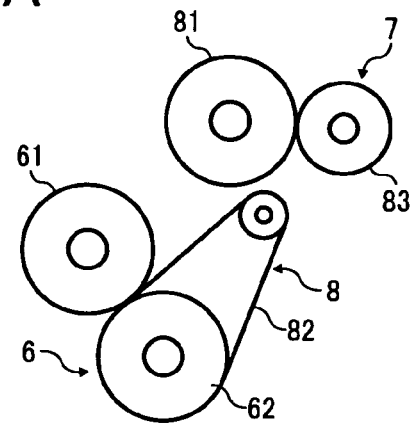
FIGS. 6A, 6B, and 6C are modification examples of the sheet conveying device of FIG. 2.
Figure 6B:
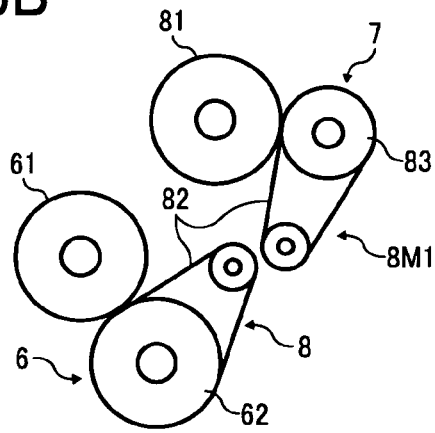
Figure 6C:
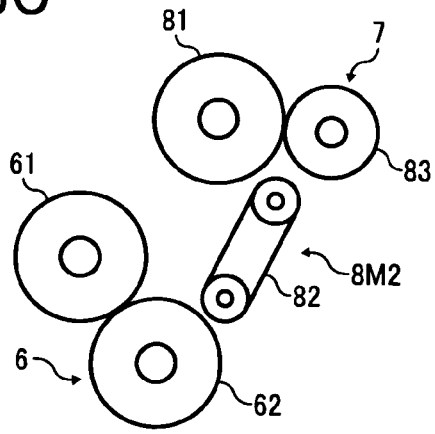

Next, FIGS. 6A through 6C show modification examples of the above-described example with reference to FIGS. 1 through 5 to which the present invention is applied.

As shown in FIG. 6A, one member of the pair of rollers facing and contacting each other in the first conveying unit 6 can be the belt-type conveying unit 8. Furthermore, as shown in FIG. 6B, one member of the pair of rollers facing and contacting each other in the first conveying unit 6 and one member of the pair of rollers facing and contacting each other in the second conveying unit 7 can be the belt conveying unit 8 and a belt-type conveying unit 8M1, respectively. Furthermore, as shown in FIG. 6C, a separate and independent belt-type conveying unit 8M2 can be provided as a belt-type sheet conveying unit alternative to one member of the pair of rollers in the first conveying unit 6 arranged on the upstream side or one member of the pair of rollers in the second conveying unit 7 arranged on the downstream side, and arranged between the first conveying unit 6 and the second conveying unit 7.

In the belt-type conveying unit 8 of the modification examples shown in FIG. 6A and at the lower side of FIG. 6B, there is provided an intermediate roller-type pulley with an outside diameter somewhat smaller than the outside diameter of the reverse roller 62. The reverse roller 62 may be divided into a shish-kebab-like structure in its axial direction, and the intermediate roller-type pulley is arranged inside the divided reverse roller 62 (at a position where the reverse roller 62 does not exist) via a rolling bearing, not shown, on the outer circumference of a shaft holding the reverse roller 62. The intermediate roller-type pulley is arranged so as not to affect the separating function of the reverse roller 62 (rotation in the anticlockwise direction for returning the sheet S). By providing this intermediate roller-type pulley, the conveyor belt 82 can be moved and/or rotated in the clockwise direction to convey the sheet S to the second conveying unit 7 or the belt-type conveying unit 8M1 at the downstream side of the conveying path. The conveyor belt 82 is one step lower than the circumferential surface of the reverse roller 62 so that the conveyor belt 82 does not form part of the nip contact between the feed roller 61 and the reverse roller 62. Accordingly, after the sheet S is separated from the rest of the sheets at the nip contact between the feed roller 61 and the reverse roller 62, the conveyor belt 82 can provide the above-described functions.

Hence, in any of the above-described modification examples, the same effects as those of the above-described example with reference to FIGS. 1 through 5 can be achieved.

Figure 7:
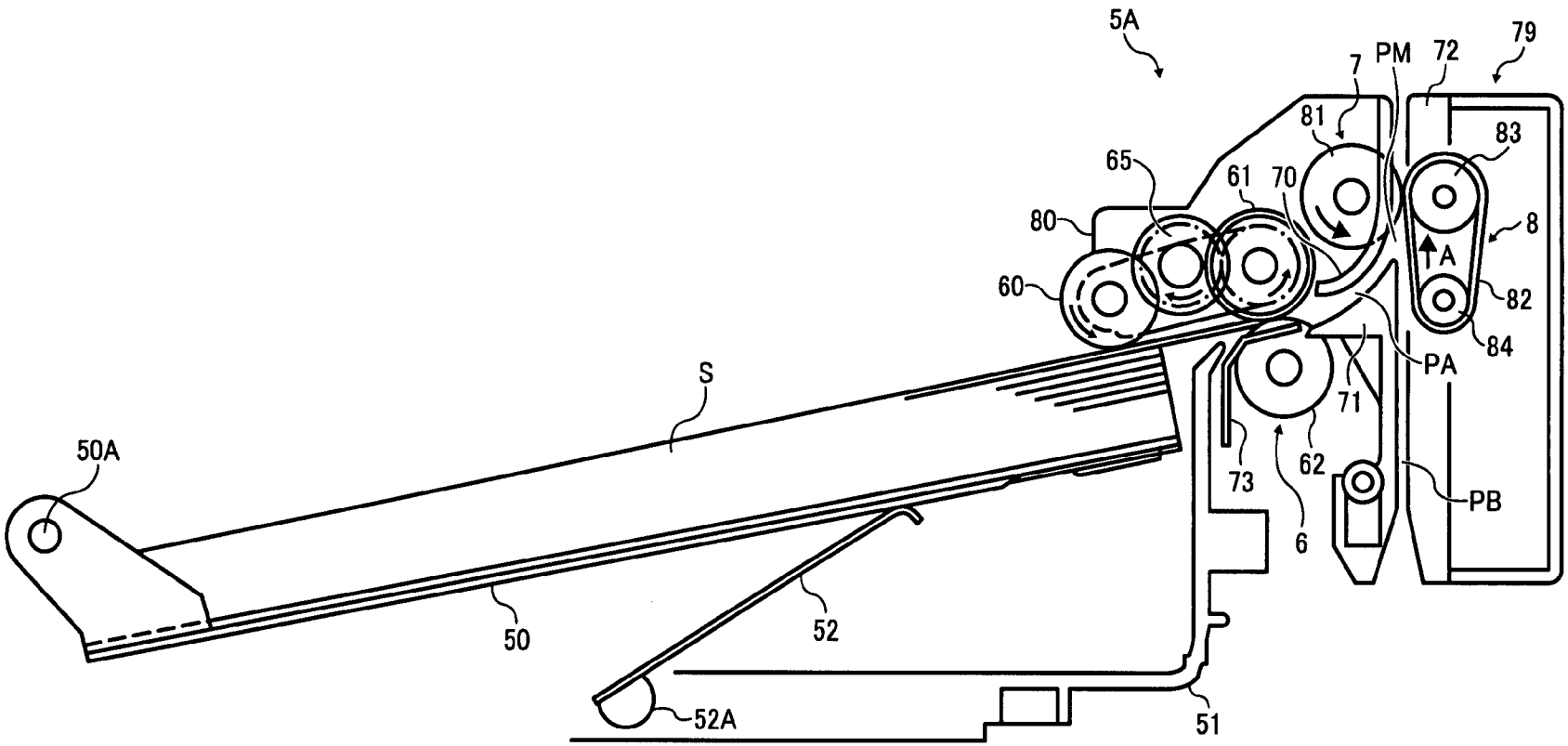
FIG. 7 is a cross-sectional view of another sheet conveying device according to an example embodiment of the present patent application.
Figure 8:
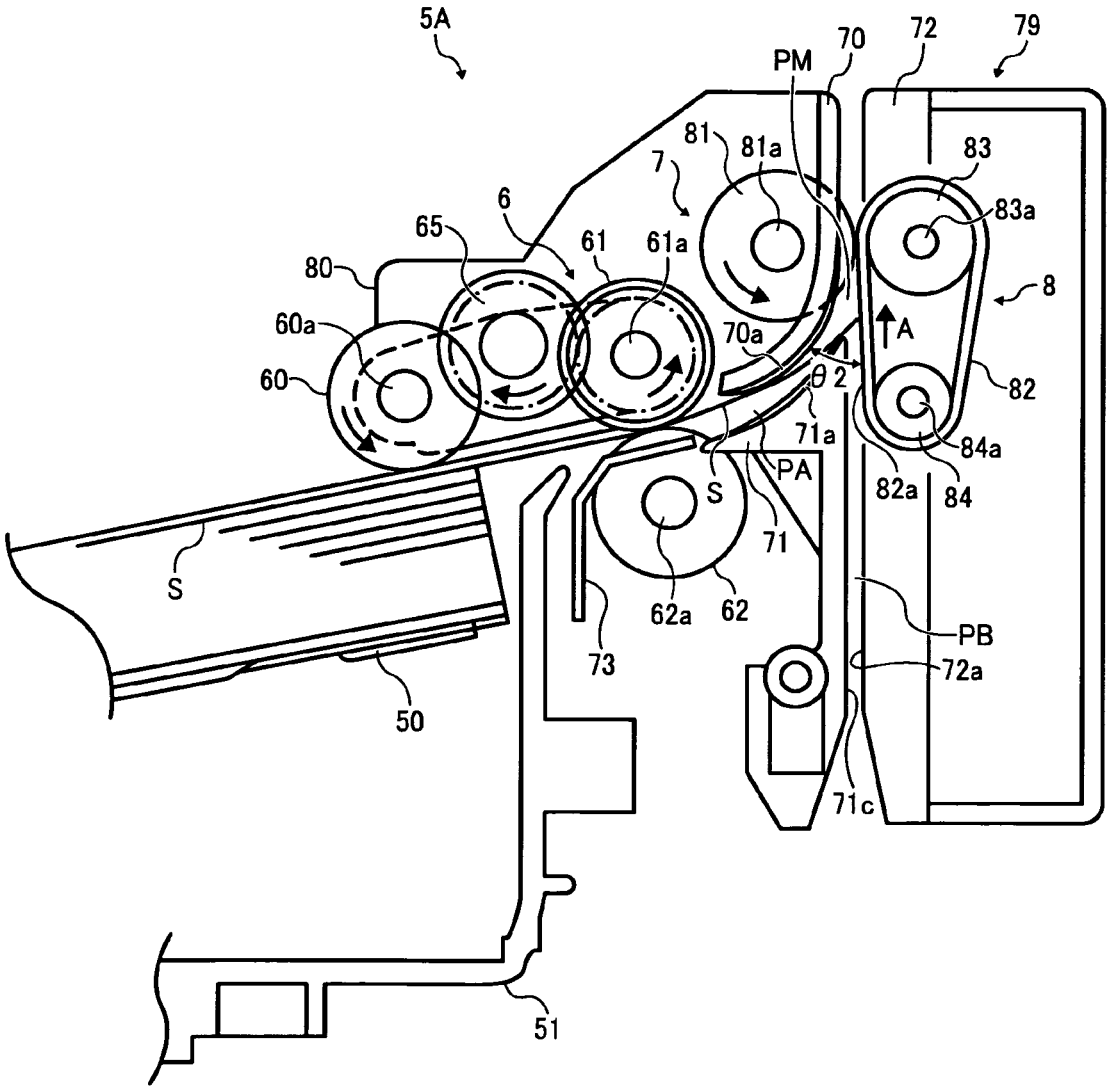
FIG. 8 is an enlarged cross-sectional view showing one state of the sheet conveying device of FIG. 7.
Figure 9:
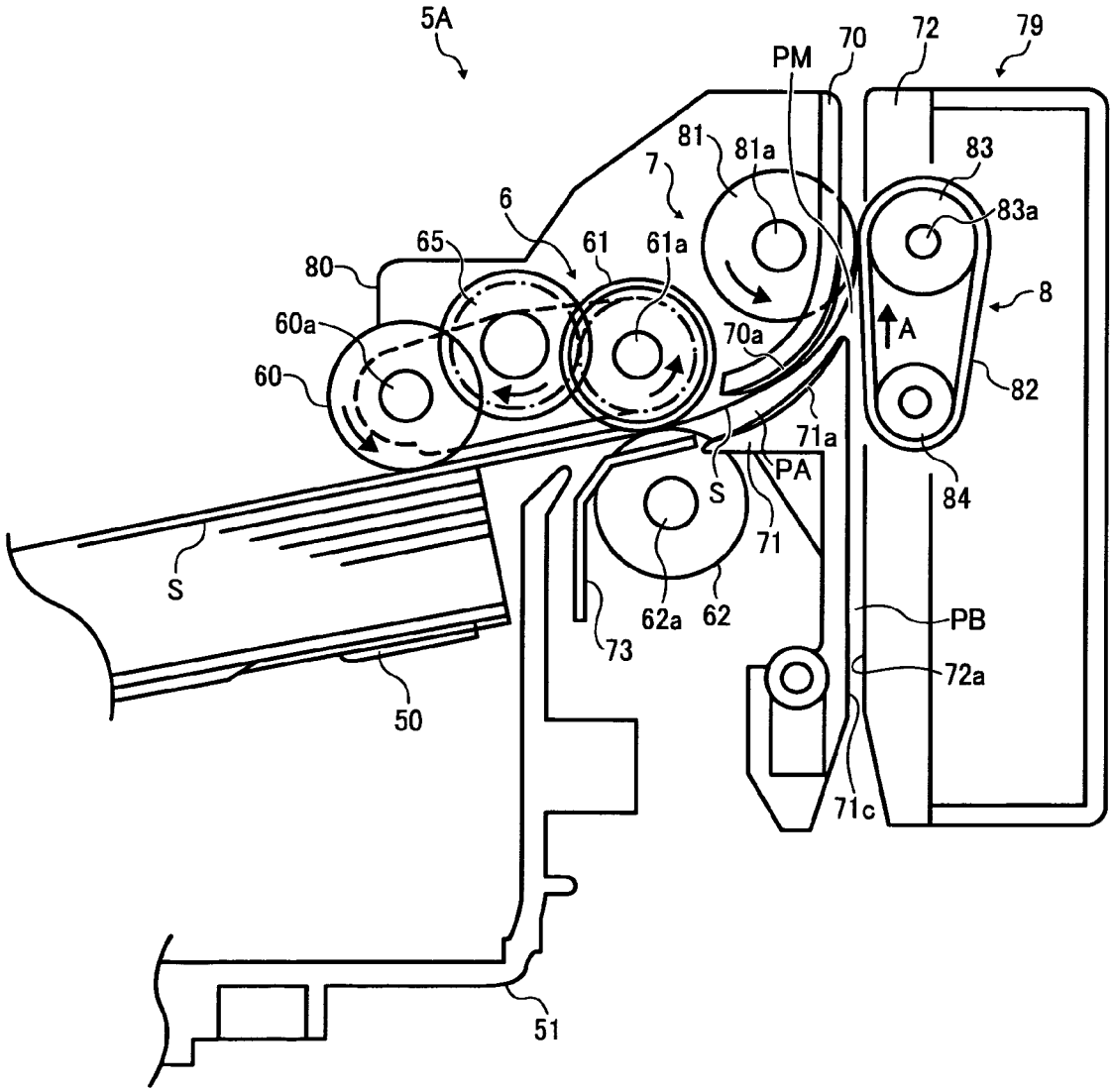
FIG. 9 is an enlarged cross-sectional view showing another state of the sheet conveying device of FIG. 7.

Next, referring to FIGS. 7 through 9, schematic configuration and functions of a sheet conveying device 5A according to an example of the present patent application is described.

Elements and members corresponding to those of the sheet conveying device 5 of the example shown in FIGS. 1 through 4 are denoted by the same reference numerals and descriptions thereof are omitted or summarized. Although not particularly described, configurations of the sheet conveying device 5A, etc., and operations that are not particularly described in this example are the same as those of the sheet conveying device 5 of the example previously described with reference to FIGS. 1 through 4.

The main differences between the sheet conveying device 5 shown in FIGS. 1 through 4 according to the previously described example and the sheet conveying device 5A shown in FIGS. 7 through 9 according to this example are as follows.

In addition to the first sheet conveying path PA serving as a first sheet conveying path formed between the first conveying unit 6 and the second conveying unit 7, a second sheet conveying path PB serving as a second sheet conveying path is provided. The second sheet conveying path PB, which is different and separate from the first sheet conveying path PA, may be formed by a guide surface 71*c* of the conveying guide member 71 and the guide surface 72*a* of the conveying guide member 72 and extend from an upstream position of the second conveying unit 7 to the second conveying unit 7. The first sheet conveying path PA and the second sheet conveying path PB may merge at an upstream side of the second conveying unit 7, thereby forming a common conveying path PM. The belt-type conveying unit 8, which is one of the members of the second conveying unit 7, is disposed along the outer side of the first sheet conveying path PA and the second sheet conveying path PB. Apart from these differences, the sheet conveying device 5A according to the above-described example described with reference to FIGS. 7 through 9 is the same as the sheet conveying device 5 according to the previously described example with reference to FIGS. 1 through 4.

That is, the pulley 84 around which the conveyor belt 82 is stretched in the belt-type conveying unit 8. The pulley 84 is one member of the pair of roller-type pulleys 83 and 84, axially rotatably supported by the housing 80, and disposed beneath the pulley 83 with a space therebetween. Therefore, it can be ensured that the leading edge of the sheet S conveyed by the first conveying unit 6 into the first sheet conveying path PA abuts against the conveying surface 82*a* of the conveyor belt 82, and that the sheet S conveyed along the second sheet conveying path PB by a conveying unit, not shown, is not obstructed from reaching the second conveying unit 7.

The main difference between the conveying guide member 71 according to the example with reference to FIGS. 1 through 4 and the conveying guide member 71 according to this example in FIGS. 7 through 9 is that the conveying guide member 71 according to this example includes a vertical guide surface 71*c* on the right side of FIGS. 8 and 9.

The main difference between the conveying guide member 72 according to the example with reference to FIGS. 1 through 4 and the conveying guide member 72 according to this example in FIGS. 7 through 9 is that the conveying member 72 according to this example is disposed along an outer side of the second sheet conveying path PB that is downwardly extending from the above-described second conveying unit 7. The conveying guide member 72 according to both of the examples includes a vertical guide surface 72*a* to guide a sheet S conveyed from an upstream side to the conveying surface 82*a* of the conveyor belt 82.

As described above, the second sheet conveying path PB includes the vertical guide surface 71*c* of the conveying guide member 71 and the vertical guide surface 72*a* of the conveying guide member 72. The vertical guide surface 72*a* of the conveying guide member 72 faces the vertical guide surface 71*c* of the conveying guide member 71 with a given gap to form the second sheet conveying path PB.

Next, the conveying operations of the sheet conveying device 5A according to the above-described example with reference to FIGS. 7 through 9 are described.

The sheet S may be extracted and conveyed from a stack of sheets stacked horizontally in the sheet feeding cassette 51. Therefore, the sheet conveying direction in the sheet feeding and separating mechanism of the first conveying unit 6 is a substantially horizontal direction. Subsequently, the sheet S may be conveyed upward an image forming section of the main body 2 of the copier 1 positioned above. Therefore, the sheet S may need to be conveyed in a substantially vertical and upward direction, which is orthogonal or perpendicular to the substantially horizontal direction.

Thus, as shown in FIG. 8, after the sheets S have been separated one by one in the sheet feeding and separating mechanism, the sheet S may bend moderately while being conveyed to reduce the conveyance resistance, and then the leading edge of the sheet S may abut against the conveyor belt 82.

The conveyor belt 82 may move in a substantially vertically upward direction or substantially directly upward direction as indicated by arrow "A" in FIGS. 7 through 9. The leading edge of the sheet S abutting the conveyor belt 82 may be conveyed to the sheet holding section or nip contact between the grip roller 81 and the conveyor belt 82, and then be conveyed to the downstream side in the substantially directly upward direction by the grip roller 81 and the conveyor belt 82 while being held therebetween. As described above, a conveying and propelling force may be transmitted from the conveyor belt 82 to the sheet S for moving the sheet S in the conveying direction. Moreover, the conveyor belt 82 may change the direction of the sheet S toward the nip contact between the grip roller 81 and the conveyor belt 82. Accordingly, even a highly rigid sheet S can be steadily conveyed without causing conveyance failures.

With the above-described configuration and conveying operations, the sheet conveying device 5A provided with the common conveying path PM shown in FIGS. 7 through 9 can provide the same effects as those of the sheet conveying device 5 according to the example with reference to FIGS. 1 through 4. That is, a highly rigid sheet such as a cardboard recording paper can be steadily conveyed, and thereby achieving preferable sheet conveying properties. Moreover, the sheet conveying device 5A of this example may have multiple sheet conveying paths, at least the first sheet conveying path PA and the second sheet conveying path PB, so as to be applied to a wider range of machine types.

The above-described example with reference to FIGS. 7 through 9 is not limited to the above-described configuration that includes the belt-type conveying unit 8 with the second pair of rotary feed members, which are the grip roller 81 and the conveyor belt 82 including the roller-type pulleys 83 and 84, but also applicable to a different configuration. For example, similar to the belt-type conveying unit 8M2 according to the modification example shown in FIG. 6C, a different belt-type conveying unit separate from the second pair of rotary feed members may be applied to the above-described example with reference to FIGS. 7 through 9.

Next, an example to which the present patent application is applied is described with reference to FIG. 10, which shows a schematic configuration of a sheet conveying device 5B.

Elements and members corresponding to those of the previously described example with reference to FIGS. 7 through 9 are denoted by the same reference numerals and descriptions thereof are omitted or summarized. Although not particularly described, configurations of the sheet conveying device 5B, etc. and operations that are not particularly described in this example are the same as those of the sheet conveying apparatus 5A of the previously described example with reference to FIGS. 7 through 9.

Figure 10:
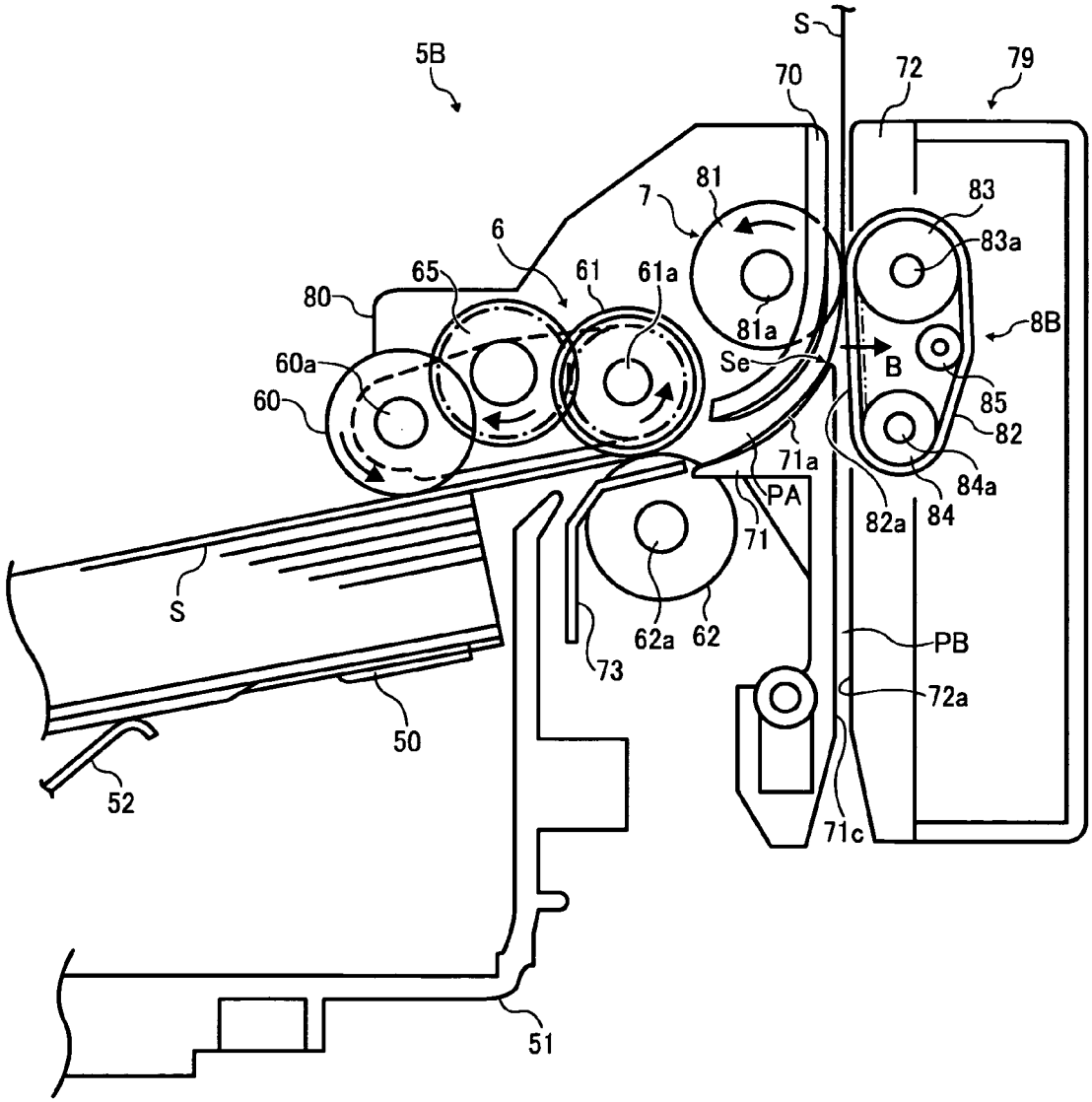
FIG. 10 is an enlarged cross-sectional view showing another state of the sheet conveying device of FIG. 7.

As shown in FIG. 10, when a trailing edge Se of the sheet S that is bent while being conveyed is released from the conveying guiding member 71, the reaction force of the bent sheet S may cause the trailing edge Se of the sheet S to move in a direction indicated by arrow B shown in FIG. 10, i.e., may cause a flipping phenomenon. Particularly if the sheet S is stiff or highly rigid such as a cardboard recording paper, the reaction force may be larger, and therefore, a sudden noise caused by this flipping phenomenon may become a problem.

For example, in the process of that the sheet S is conveyed, the sheet S is held at two or more supporting points and is forcibly bent. When the trailing edge Se of the sheet S is released from the sheet holding section of the first conveying unit 6 or the conveying guiding member 71 acting as one of the supporting points, the sheet S may be supported only at the leading edge. Thus, an elastic restoring force of the belt sheet S may cause the trailing edge of the sheet S to immediately collide against the conveying surface 82*a* of the conveyor belt 82. The impact of the collision may become larger as the rigidity of the sheet S becomes greater or higher. Accordingly, the sudden noise, which is made when the trailing edge Se of the sheet S is caused to collide against the conveying belt 82 by the flipping phenomenon, may not only be unpleasant for the user but may also cause the user to have a misperception that a failure has occurred. That is, even if the sheets S are being conveyed normally, regardless of whether the sheet S is a regular type or a highly rigid type, the above-described sudden noises may give the wrong impression to the user that the copier 1 is malfunctioning.

To address this issue, as shown in a belt-type conveying unit 8B in FIG. 10, a tension roller 85 serving as a contacting member may be disposed away from the side of the conveying surface 82*a* of the conveyor belt 82. The tension roller 85 is a member that contacts the conveyor belt 82, together with the grip roller 81, the pair of roller-type pulleys 83 and 84 around which the conveyor belt 82 is stretched. Accordingly, the portion of the conveying surface 82*a* of the conveyor belt 82 may be made to have appropriate elasticity, so that the impact caused by the flipping phenomenon of the trailing edge Se of the sheet S can be absorbed by the elastic property of the conveyor belt 82. Thus, the sheet conveying device 5B can remain silent even while a highly rigid sheet S such as a cardboard recording paper is being conveyed.

Among the two linear portions of the conveyor belt 82 stretched around the pair of roller-type pulleys 83 and 84, the tension roller 85 may not be arranged on the side of the conveying surface 82*a* of the conveyor belt 82, but on the opposite side and in contact with the inside perimeter of the conveyor belt 82. Furthermore, the tension roller 85 may axially be supported so as to be movable in an outward direction from inside the conveyor belt 82, and be pressed outward in the right direction as viewed in FIG. 10 by a forcing unit, not shown. Therefore, the tension roller 85 may be caused to rotate by the movement of the conveyor belt 82, and contact the inside perimeter of the conveyor belt 82 while constantly receiving a given pressing force in an outward direction, so that the conveyor belt 82 can maintain a fixed tension without slackening in its circumferential direction.

Accordingly, in the sheet conveying device 5B of this example of the present patent application, the following advantage is achieved. That is, as the leading edge of the sheet S in the sheet travel direction is held and conveyed by the second conveying unit 7, the trailing edge Se of the sheet S may be released from being supported by the conveying guiding member 71 and may be made to collide against the conveying surface 82*a* of the conveyor belt 82. However, the conveying surface 82*a* of the conveyor belt 82 can elastically deform sufficiently and change its position in the direction of collision as indicated by the chain double-dashed line in FIG. 10. Accordingly, the impact caused by the flipping phenomenon of the trailing edge Se of the sheet S can be absorbed, and the noise caused by the impact can be reduced, so that abnormal noises can be reduced and mitigated during the operation of the sheet conveying device 5B.

As described above, in the sheet conveying device 5B of the example with reference to FIG. 10, as one of the contacting members to support the conveyor belt 82, the tension roller 85 may be provided in contact with the conveyor belt 82 where the trailing edge Se of the conveyed sheet S does not come in contact with the conveying surface 82*a* of the conveyor belt 82. When the sheet S that is bent to a given extent is conveyed and the trailing edge Se of the sheet S is released from either one of the nip contact of the first conveying unit 6 or the conveying guiding member 71, the trailing edge Se of the sheet S may collide against the conveying surface 82*a* of the conveyor belt 82. However, the portion of the conveyor belt 82 where this collision occurs may elastically bend sufficiently to absorb the impact of the collision. Therefore, the sudden noise or flipping noise caused by the collision can be reduced. That is, when the trailing edge Se of the sheet S contacts the conveying surface 82*a* of the conveyor belt 82, the contacting member, i.e., the tension roller 85, may not obstruct the deforming motion of the conveyor belt 82 where it is contacted by the trailing edge Se of the sheet S. Thus, the conveyor belt 82 may sufficiently bend in the same direction as the direction in which the trailing edge Se of the sheet S contacts the conveyor belt 82.

Particularly, when a highly rigid sheet S such as a cardboard recording paper is being conveyed and the trailing edge Se of the sheet S in the sheet travel direction strongly collides against the conveyor belt 82, the elastic deforming motion of the conveyor belt 82 may absorb and reduce the impact caused by the collision so that an impulsive noise can sufficiently be reduced.

Accordingly, as sudden noises is reduced while conveying the sheet S, the operations may be performed quietly so that unpleasant noises can be reduced or prevented, if possible, and misperceptions that a failure has occurred may not be created. This may result in advantageous usability of the sheet conveying device 5B.

In the process of conveying the sheet S, even if a sudden noise is not generated when the leading edge of the sheet S firstly contacts the conveying surface 82*a* of the conveyor belt 82, the above-described configuration may still have an advantageous effect. That is, as the conveyor belt 82 elastically deforms to some extent, the leading edge of the sheet S may be prevented from bouncing back from the conveying surface 82*a* of the conveyor belt 82. Instead, the leading edge of the sheet S softly may abut the conveying surface 82*a* and stay in contact with the conveying surface 82*a* of the conveyor belt 82. For example, when the leading edge of the sheet S conveyed by the first conveying unit 6 first abuts the conveying surface 82*a* of the conveyor belt 82 moving in the sheet conveying direction at an oblique collision angle θ2 (see FIG. 8), the leading edge of the sheet S may be prevented from bouncing back from the conveying surface 82*a* of the conveyor belt 82. Rather, the leading edge of the sheet S may be caused to follow the direction of movement of the conveying surface 82*a* of the conveyor belt 82 and change its direction to that of the conveyor belt 82.

This example with reference to FIG. 10 is not limited but can be applied to any other structure as long as the conveyor belt 82 can be deformed in such a manner that a sheet conveying device operates sufficiently quietly. For example, among the two substantially linear belt moving surfaces of the conveyor belt 82 stretched around the pair of roller-type pulleys 83 and 84 spaced apart in a given manner, the tension roller 85 is not limited to being provided on the linear surface opposite to the conveying side of the conveyor belt 82, i.e., the side not facing the first conveying unit 6. Alternatively, the tension roller 85 can be provided on the belt moving surface facing the first conveying unit 6. That is, regardless of the rigidity of the sheet S in its thickness direction, the trailing edge of the sheet S can constantly contact the substantially same position of the belt conveying surface. Accordingly, the tension roller 85 is to be arranged in contact with the conveyor belt 82 at a position sufficiently spaced apart from where the trailing edge Se of the sheet S contacts the belt conveying surface so as to allow the conveyor belt 85 to deform.

In the sheet conveying device 5B of this example with reference to FIG. 10, the tension roller 85 may be arranged at a position defined as above to apply a pressing force from inside to stretch the conveyor belt 82 outward. Conversely, the tension roller 85 can be arranged so as to apply a pressing force from outside the conveyor belt 85 to stretch the conveyor belt 82 inward.

In such a configuration, the tension roller 85 can also have a function of cleaning the outer circumferential surface or conveying surface 82*a* of the conveyor belt 82 in addition to the function of applying tension to the conveyor belt 82. With such a tension roller having functions of applying pressure to the conveyor belt 82 and cleaning the belt conveying surface, the belt conveying surface can be maintained in a clean condition, which may improve the image quality. Furthermore, at a position defined as above, a tension roller and a cleaning roller can be provided separately, or only a cleaning roller that primarily functions as a cleaning unit and does not primarily function as a tensioning unit can be provided.

As described above, the conveyor belt 82 of the sheet conveying device 5 shown in FIGS. 1 through 4, of the sheet conveying device 5A shown in FIGS. 7 through 9, and of the sheet conveying device 5B shown in FIG. 10 have a width of the conveyor belt 82 in the sheet width direction "Y" that is at least substantially equal to the width of a maximum-size sheet to be conveyed. That is, the belt width of the conveyor belt 82 extends across the entire width of the sheet, so as to be substantially equal to or greater than the width of a maximum-size sheet to be conveyed. The pulleys 83 and 84 around which the conveyor belt 82 is stretched and the grip roller 81 facing and contacting the conveyor belt 82 may extend across the entire width of the sheet, in which a manner that their sizes in the sheet width direction "Y" (axial length wise direction) are equal to or larger than the above-described width of the conveyor belt 82. Hence, it is ensured that the entire width of the sheet S sent out from the first conveying unit 6 contacts the conveyor belt 82, so that the contact area therebetween can be increased. Accordingly, it is possible to transmit the maximum conveying and propelling force possible applied by the conveyor belt 82 moving in the sheet travel direction for constantly conveying the sheet S in the conveying direction.

By contrast, the following example embodiment has a different configuration from the above-described configurations of the sheet conveying devices 5, 5A, and 5B.

Next, referring to FIGS. 11 through 27, a sheet conveying device 500 according to an example embodiment of the present invention is described.

Elements having the same functions and shapes are denoted by the same reference numerals throughout the specification and redundant descriptions are omitted.

FIGS. 11 and 12 schematically show a driving mechanism 22 acting as a driving force transmitting unit of a sheet feeding driving unit (sheet feeding driving system) of the first conveying unit 6 and the second conveying unit 7 in the sheet conveying device 500 according to an example embodiment of the present invention. FIGS. 11 and 12 illustrate the surroundings of multiple belt-type conveying units 800 of the second conveying unit 7 in the sheet conveying device 500 according to an example embodiment of the present invention with reference to FIGS. 11 through 27.

The primary differences of the sheet conveying device 500 with reference to FIGS. 11 through 27 from the sheet conveying device 5 with reference to FIGS. 1 through 4, the sheet conveying device 5A with reference to FIGS. 7 through 9, and the sheet conveying device 5B with reference to FIG. 10 are described below.

In the sheet conveying device 500 of this example embodiment, the relationship between the driving member and the subordinately driven member of the second conveying unit 7 that holds and conveys the sheet S is clearly defined. Furthermore, the multiple belt-type conveying units 800 are employed instead of the belt-type conveying unit 8. Respective elements of the belt-type conveying units 800, each including the conveyor belt 82, are arranged in a discontinuous manner (i.e., in a spaced-apart manner) along the sheet width direction "Y" so as to contact not entirely but partially with the sheet S in the sheet width direction "Y." In other words, it is not that the belt-type conveying units 800 and their elements are in contact with the entire range of the sheet width. Further, the sheet conveying device 500 of this example embodiment employs a specific positioning control mechanism, which will be described below. Furthermore, the sheet conveying device 500 includes at least one example embodiment regarding a configuration to prevent a positional deviation or variation of the conveyor belt 82 and a coming off of the conveyor belt 82 over the pulley 84.

Apart from these differences, the sheet conveying device 500 according to the example embodiment of the present patent application, with reference to FIGS. 11 through 27, is same as the sheet conveying devices 5B shown in FIGS. 7 through 10 and the copier 1 shown in FIG. 1.

Specifically, in the second conveying unit 7 of the sheet conveying device 500, the nip contact or the sheet holding section is formed by pairs of members facing each other, namely, the grip rollers 81 and the belt-type conveying units 800 facing the respective grip rollers 81. Each of the grip roller 81 disposed facing the corresponding belt-type conveying unit 800 in the second conveying unit 7 serves as a rotary conveyance driving unit or member that can transmit a driving force by its rotation. Each of the belt-type conveying units 800 serving as a belt-type sheet conveying member and including the conveyor belt 82, which is the other member of the pair, is arranged along the outer side of the sheet conveying path corresponding to the first sheet conveying path PA, formed between the first conveying unit 6 and the second conveying unit 7. The conveyor belt 82 directly contacts the grip roller 81, and is caused to rotate following the rotation of the grip roller 81. The conveyor belt 82 conveys (moves and guides) the sheet S to the nip contact of the second conveying unit 7 while keeping the leading edge of the sheet S in contact with the conveyor belt 82.

In the sheet conveying devices 5, 5A, and 5B shown in FIGS. 1 through 4 and FIGS. 7 through 10, the width of the conveyor belt 82 is equal to or greater than the width of a maximum-size sheet to be conveyed, and the pulleys 83 and 84 and the grip roller 81 are formed across the entire sheet width direction "Y" so that their sizes are equal to or greater than the above-described belt width of the conveyor belt 82. Instead of that configuration, the sheet conveying device 500 according to this example embodiment of the present invention includes the multiple belt-type conveying units 800. As previously described, each of the respective elements of the belt-type conveying units 800 includes the conveyor belt 82. The belt-type conveying units 800 are arranged in a discontinuous manner along the sheet width direction "Y" so as to contact not entirely but partially with a leading edge of the sheet S in the sheet width direction "Y" (the leading edge section includes the leading edge, the sheet surface around the leading edge, the corners and edges at the leading edge).

The grip roller 81 includes multiple rotary feed drive members fixed and arranged in a discontinuous manner along the rotational driving shaft 81*a* in the sheet width direction "Y" in a shish-kebab-like structure. Meanwhile, the conveyor belt 82 and the pulleys 83 and 84 in each of the belt-type conveying units 800 are arranged facing at least one of the multiple grip rollers 81, which may form at least one pair of facing members. To be more specific, in the sheet conveying device 500 shown in FIGS. 11 through 15 and FIG. 22, there are three grip rollers 81 arranged along the rotational driving shaft 81*a* in the second conveying unit 7 acting as the holding and conveying unit. Three conveyor belts 82 are arranged facing the corresponding ones of the three grip rollers 81, having a substantially equal width to that of the center grip roller 81.

The grip rollers 81 positioned at the outermost edges in the sheet width direction "Y" are arranged so that their outer edges can be within the width of a minimum-sized sheet S (a sheet size in the sheet width direction "Y") used in the copier 1 provided with the sheet conveying device 500. The detailed description of the configuration will be described below.

In FIG. 11, as a matter of convenience in describing the driving mechanism 22 of the sheet conveying device 500, the grip rollers 81 are purposely arranged with irregular intervals in the direction of the rotational driving shaft 81*a*. However, in reality, the grip rollers 81 are equally spaced apart at positions facing the conveyor belt 82 and the pulleys 83, as a matter of course.

As shown in FIGS. 11 and 12, the sheet conveying device 5 further includes the driving mechanism 22 that drives the grip roller 81. The driving mechanism 22 primarily includes a sheet feeding motor 23, a motor gear 24, an idler gear 25, a feed roller driving gear 61B, an idler gear 26, a grip roller driving gear 81A, a feed roller gear 61A, the idler gear 65, and a pickup roller gear 60A.

The sheet feeding motor 23 is a stepping motor serving as the single driving source or driving unit.

The motor gear 24 is fixed on an output shaft of the sheet feeding motor 23.

The idler gear 25 is engaged with the motor gear 24.

The feed roller driving gear 61B is engaged with the idler gear 25 and fixed to one end of the shaft 61*a* of the feed roller 61.

The idler gear 26 is engaged with the feed roller driving gear 61B.

The grip roller driving gear 81A is engaged with the idler gear 26 and fixed to one end of the rotational driving shaft 81*a* of the grip rollers 81.

The feed roller gear 61A is fixed to the other end of the shaft 61*a* near the feed roller 61.

The idler gear 65 is engaged with the feed roller gear 61A.

The pickup roller gear 60A in engagement with the idler gear 65 and fixed to the other end of the shaft 60*a* near the pickup roller 60.

The sheet feeding motor 23 is fixed to the housing 80. The idler gears 25, 26, and 65 are rotatably supported by the housing 80.

As described above, the sheet conveying device 5 according this example embodiment may be compact and space-saving by making the first sheet conveying path PA have a curved section of a relatively small curvature radius as later described example embodiments. The sheet feeding motor 23 is the single driving source provided for driving both the first conveying unit 6 and the second conveying unit 7, which also contributes in reducing the size of the device.

The reverse roller 62 may be driven by a different system including, for example, a solenoid for releasing pressure from the feed roller 61.

As shown in FIG. 11, the sheet conveying device 5 further includes the torque limiter that corresponds to a torque limiter 62*b*.

In the example shown in FIGS. 1 through 4, the rotating and driving relationship between the pickup roller 60 and the feed roller 61 is described only briefly. In reality, as shown in an enlarged view of FIG. 12, the respective shafts 60*a* and 61*a* of the pickup roller 60 and the feed roller 61, respectively, may be connected by a pickup arm member 64. Accordingly, for the pickup action, a combination of a solenoid, not shown, and a spring, not shown, causes the pickup roller 60 to pivot or move about the shaft 61*a* of the feed roller 61 via the pickup arm member 64.

In the actual driving mechanism 22, there are many driving force transmitting members such as gears and timing belts disposed between the sheet feeding motor 23 and the feed roller 61. However, the configuration of the driving mechanism 22 is shown only schematically in FIG. 5 for the sake of clearly indicating that the grip rollers 81 serve as rotary conveyance driving members.

As a matter of course, the driving mechanism 22 can be applied to the sheet conveying devices 5, 5A, and 5B as shown in FIGS. 1 through 4 and FIGS. 7 through 10. Further, it should be noted that a substantially same driving mechanism as the driving mechanism 22 is employed in the copier 1 according to the above-described example embodiment with reference to FIGS. 11 through 27.

Alternatively, a rotary conveyance driving unit of a driving mechanism can be removed to leave the grip roller 81 to serve as a subordinate roller and a different driving unit can be provided to drive the conveyor belt 82.

Figure 23:
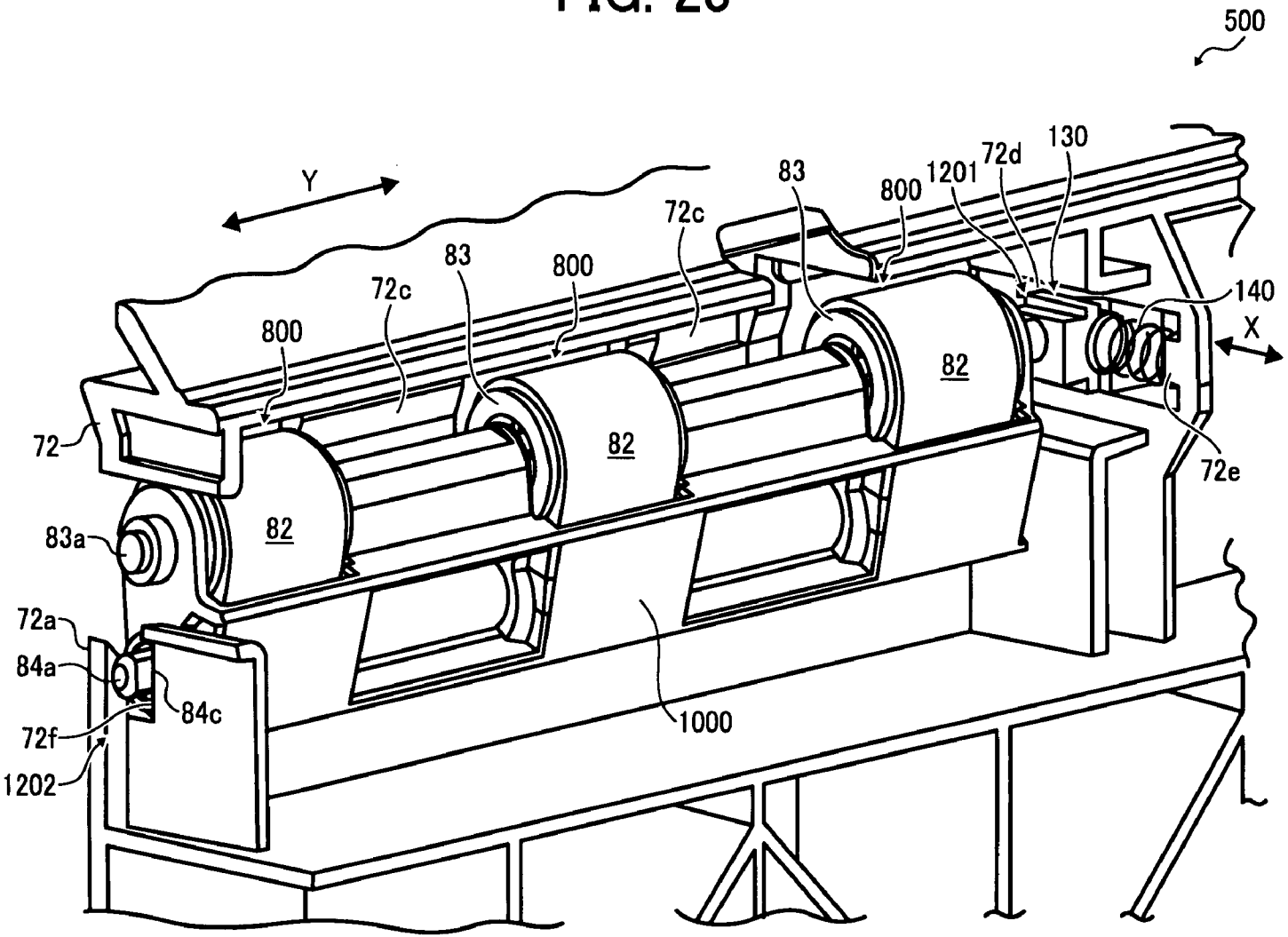
FIG. 23 is a perspective view of the belt-type conveying units of FIG. 14, viewed from the back side thereof.

In addition, a spring 140 shown in FIG. 23 may be provided to serve as a pressing elastic member to press the pulley 83 via the conveyor belt 82 of the belt-type conveying unit 8 against the grip roller 81 serving a rotary feed drive member to drive the conveyor belt 82. The conveyor belt 82 may directly contact the grip roller 81 so that the driving mechanism 22 may cause the grip roller 81 to drive the conveyor belt 82 to rotate with the rotation of the grip roller 81. Therefore, when compared to the case in which the conveyor belt 82 is driven to rotate the grip roller 81, driving the grip roller 81 to rotate the conveyor belt 82 can further reduce variations in the linear velocity of the conveyor belt 82. By so doing, the following advantages can be achieved by arranging the conveyor belt 82 along the outer side of the turning or curved section of the first sheet conveying path PA. The conveyor belt 82 may rotate to the sheet holding section of the second conveying unit 7. That is, it is possible to enhance sheet conveying properties for conveying relatively rigid sheets such as a cardboard recording paper at the turning section of the first sheet conveying path PA. Furthermore, by causing the conveyor belt 82 to rotate following the rotation of the grip roller 81 that faces and directly contacts the conveyor belt 82, the sheet S can be conveyed at a steady linear velocity beyond the second conveying unit 7.

For example, when driving the grip roller 81 to rotate, the linear velocity of the grip roller 81 may depend only on the outer diameter and speed of revolution of the grip roller 81. By contrast, when driving the conveyor belt 82 to rotate, it is general to use the pulley 83, which is a belt driving roller or main pulley, disposed in contact with an inner surface of the conveyor belt 82.

In this case, the linear velocity of the conveyor belt 82 may depend on the outer diameter and speed of revolution of the pulley 83, the variations in thickness of the conveyor belt 82 due to variation of component, the changes in thickness of the conveyor belt 82 due to abrasion, or the slipping or sliding of the pulley 83 on the conveyor belt 82. Accordingly, it is more effective to drive the grip roller 81 than the conveyor belt 82 to reduce the linear velocity of the conveyor belt 82.

Now, as shown in FIGS. 13A and 13B, the sheet feeding device 3 includes a main body 78 having the opening and closing guide 79 serving as an opening and closing unit. The opening and closing guide 79 may separate a vertical conveying path directing vertically upward, which serves as a common conveying path corresponding to the second sheet conveying path PB shown in FIGS. 7 through 10 according to the following examples to be described later. The opening and closing guide 79 may then cause the opening and closing guide 79 to open and close with respect to the main body 78 in respective directions indicated by arrows C and D in FIGS. 8A and 8B by pivoting around a fulcrum shaft 76 disposed below the main body 78. Therefore, the opening and closing guide 79 of the sheet feeding device 3 having the configuration shown in FIGS. 13A and 13B may make it easier for a user to resolve a paper jam in the first sheet conveying path PA or the vertical conveying path extending substantially upward and can effectively remove a jammed paper or papers therefrom.

A description is given of a detailed configuration around the belt-type conveying units 800, with reference to FIGS. 14 through 27.

Figure 14:
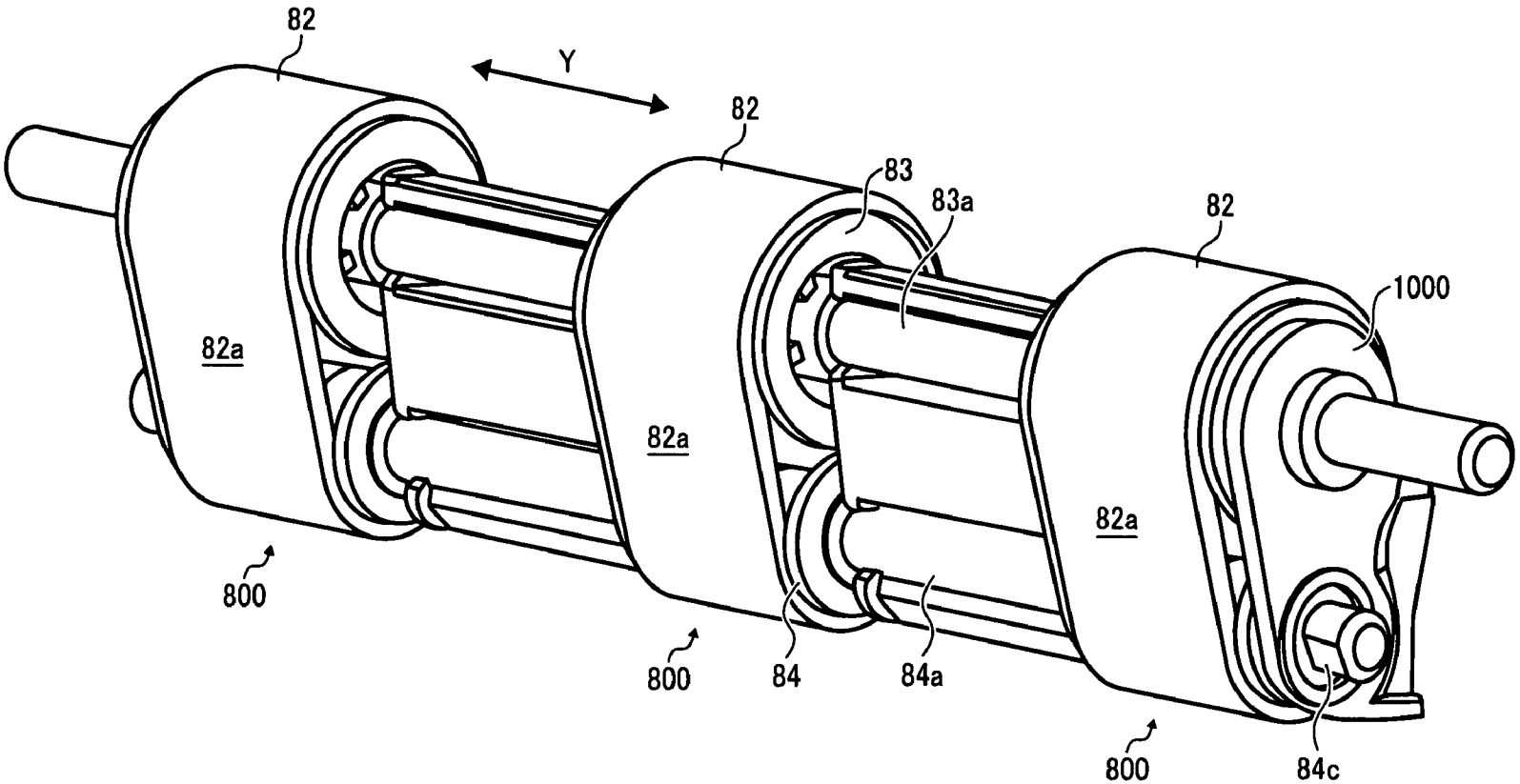
FIG. 14 is a perspective view of a belt-type conveying units, viewed from a contact side with respect to a grip roller.

FIG. 14 shows the belt-type conveying units 800, viewed from a contact side where the respective grip rollers 81 and the respective conveying belts 82 are held in contact.

Figure 15:
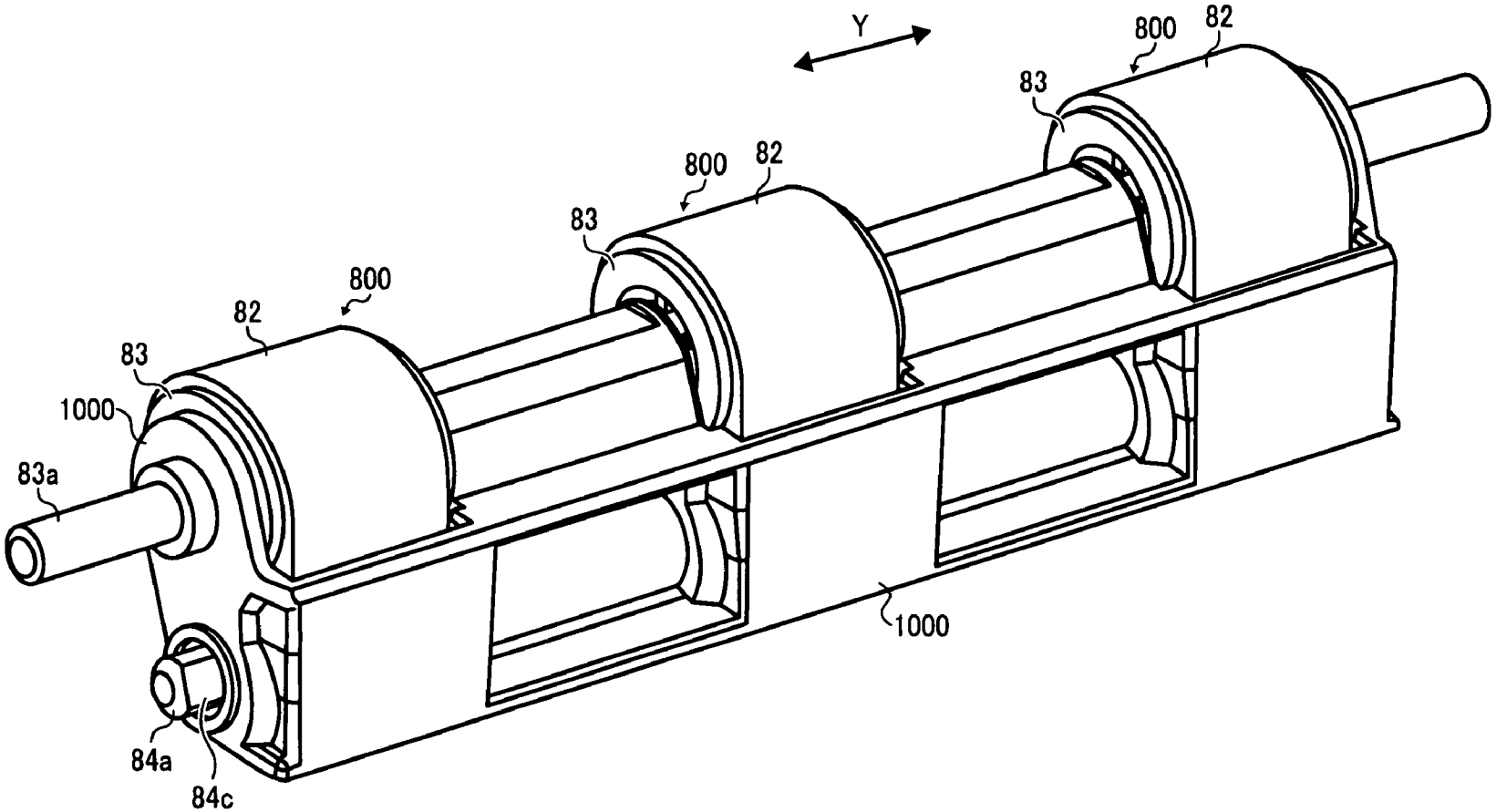
FIG. 15 is a perspective view of the belt-type conveying units of FIG. 14 set in a holder, viewed from an opposite side to the contact side.

FIG. 15 shows the belt-type conveying units 800 shown in FIG. 14, viewed from a back side of a holder 1000 or an opposite side to the above-described contact side.

As shown in FIG. 14, each of the belt-type conveying units 800 includes the roller-type pulley 83 corresponding to or serving as a first rotary belt holding member, the roller-type pulley 84 corresponding to or serving as a second rotary belt holding member, the pulley shaft 83*a* corresponding to or serving as a first supporting member, the conveyor belt 82, the pulley shaft 84 corresponding to or serving as a second supporting member, and the holder 1000 corresponding to or serving as a case or housing integrally mounted thereon.

Although not particularly described, the configuration of the sheet conveying device 500 including the conveyor belt 82, etc., and operations that are not particularly described in this example embodiment are the same as those of the sheet conveying devices 5, 5A, and 5B of the example previously described with reference to FIGS. 1 through 4 and FIGS. 7 through 10. Therefore, these elements and members of the sheet conveying device 500 of this example embodiment shown in FIGS. 11 through 27 are omitted or summarized.

It is obvious that the basic effects same as those applied to the above-described examples with reference to FIGS. 1 through 9 may be applied to this example embodiment of the sheet conveying device 500 of this example embodiment.

The pulleys 83 and the pulleys 84 of the belt-type conveying units 800 are made of a resin material such as polyacetal resin that has good lubricity, abrasion resistance, and durability, and are thus light-weight. The pulleys 83 and the pulleys 84 are fabricated in such a manner that the pulley shaft 83*a* can be inserted through the pulleys 83 and the pulley shaft 84*a* can be inserted through the pulleys 84. The pulleys 83 and the pulleys 84 are rotatably attached to and/or supported by the pulley shaft 83*a* and the pulley shaft 84*a*, respectively.

The belt-type conveying units 800 according to this example embodiment includes multiple separate units (three units in this example embodiment) disposed discontinuously in a sheet width direction Y, each of the conveyor belts 82 may be spanned around the roller-type pulley 83 and the roller-type pulley 84. The separate belt-type conveying units 800 may be set in a holder 1000 and passed therethrough by the pulley shafts 83*a* and 84*a*. By so doing, the separate units may be integrally mounted.

The detailed structure of the holder 100 is described with reference to FIG. 15.

In FIGS. 14 and 15, the pulley shaft 84*a* may include a cut part 84*c* at the leading edge of one end thereof. The cut part 84*c* of the pulley shaft 84*a* may serve as a second moving member or sliding member.

Figure 16:
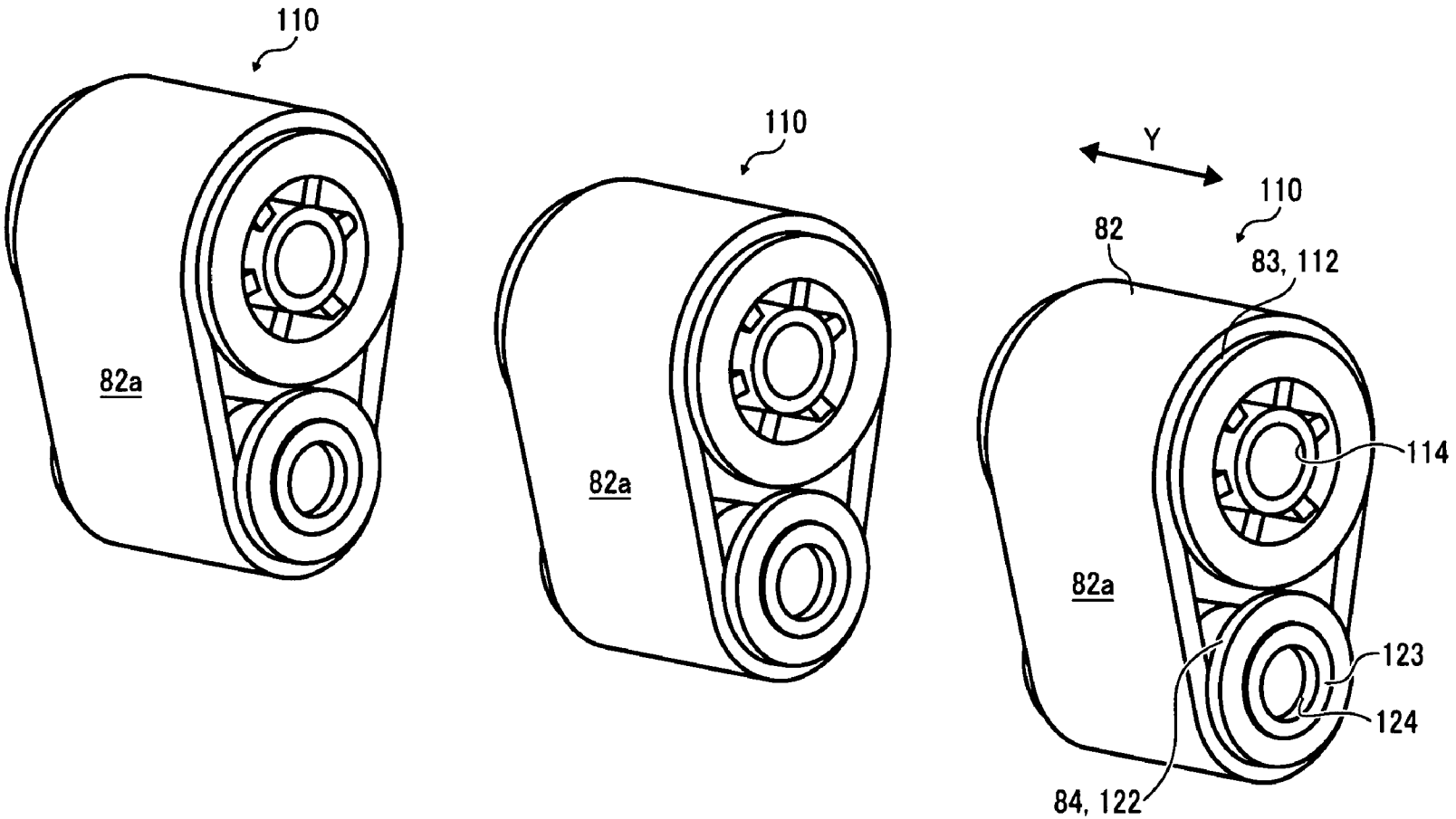
FIG. 16 is a perspective view of trial belt units of the belt-type conveying units of FIG. 14.

FIG. 16 is a perspective view of trial belt units 110. The trial belt units 110 correspond to the belt-type conveying units 800 in trial assembly or on a trial basis. The conveyor belt 82 may be spanned around the pulley 83 and the pulley 84 of each of the trial belt units 110. However, the pulley shaft 83*a* and the pulley shaft 84*a* do not hold the trial belt units 110, which is a main difference from the belt-type conveying units 800.

Figure 17:
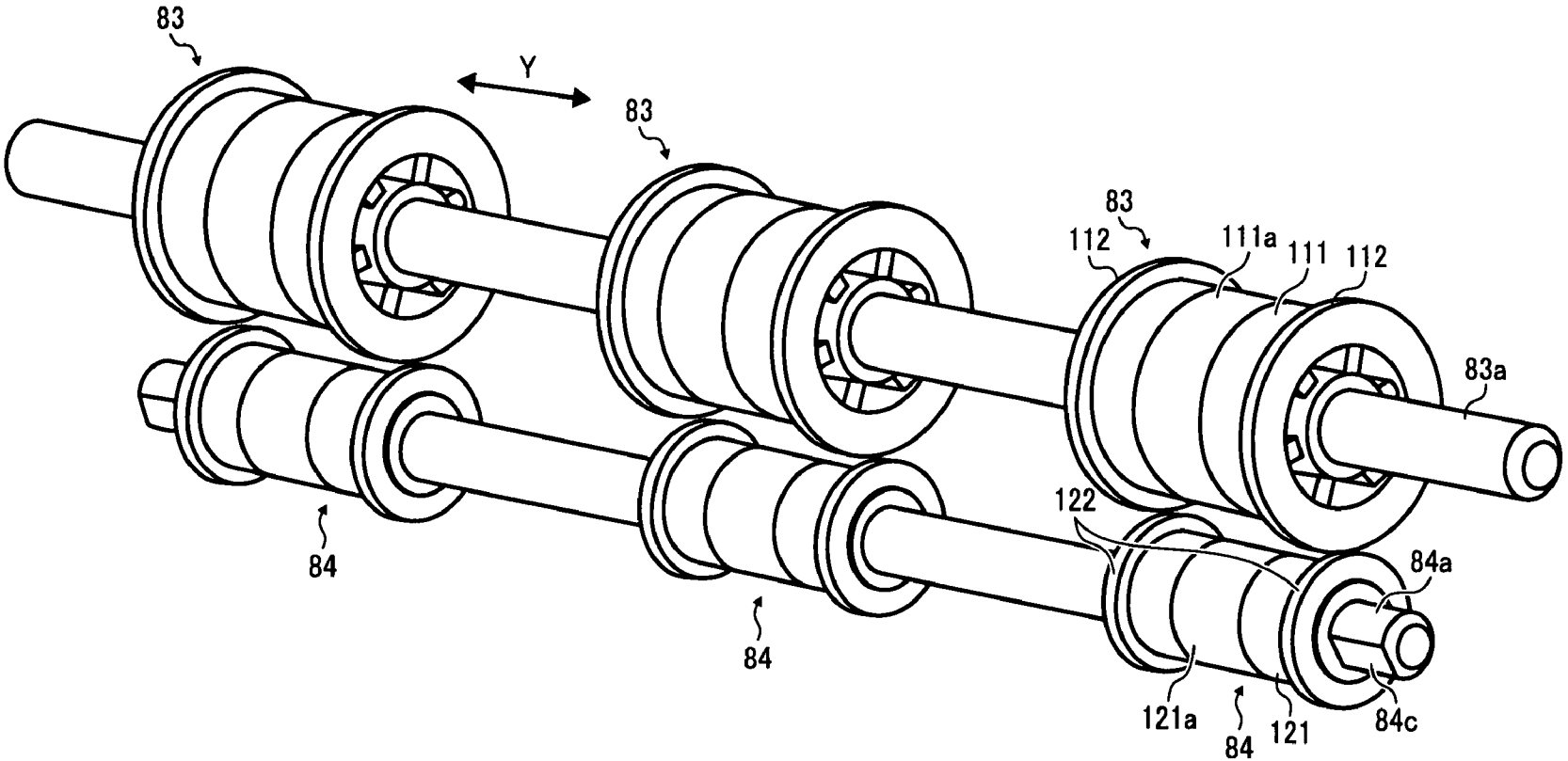
FIG. 17 is a perspective view of the trial belt units of FIG. 15, without a belt attached.

FIG. 17 is another perspective view of the trial belt units 110, without the conveyor belts 82, shown in FIG. 16. In FIG. 17, the conveyor belts 82 are respectively removed or dismounted from the trial belt units 110, the pulley shaft 83*a* is inserted through the pulleys 83, and the pulley shaft 84*a* is inserted through the pulleys 84.

As shown in FIGS. 16 and 17, each of the pulleys 83 includes an outer circumferential surface 111, flanges 112, and a through hole 114.

The outer circumferential surface 111 may be covered by the conveyor belt 82.

The flanges 112 may serve as first projecting members and be attached to the pulley 83 in a projecting manner. The flanges 112 may be integrally mounted to respective end portions in a longitudinal direction or axial direction of the pulley shaft 83*a* of the pulley 83. That is, one of the flanges 112 may be integrally mounted to one end of the pulley 83 and the other may be integrally mounted to the other end of the pulley 83.

The through hole 114 runs through the pulley 83 to cause the pulley shaft 83*a* to be inserted therethrough.

Perimeters at both ends of the through hole 114 may be more projecting than the width of the circumferential surface 111 of the pulley 83 in a direction perpendicular to a longitudinal direction of the pulley shaft 83*a*. In addition, a height of radius of each of the flanges 112 may be more projected or greater than a height or radius of the outer circumferential surface 111 of the pulley 83 from the center to the outer circumferential surface 111.

Similarly, each of the pulleys 84 includes an outer circumferential surface 121, flanges 122, and a through hole 124.

The outer circumferential surface 121 may be covered by the conveyor belt 82.

The flanges 122 may serve as first projecting members and be attached to the pulley 84 in a projecting manner. The flanges 122 may be integrally mounted to respective end portions in a longitudinal direction or axial direction of the pulley shaft 84*a* of the pulley 84. That is, one of the flanges 122 may be integrally mounted to one end of the pulley 84 and the other may be integrally mounted to the other end of the pulley 84.

The through hole 124 runs through the pulley 84 to cause the pulley shaft 84*a* to be inserted therethrough.

Perimeters at both ends of the through hole 124 may be more projecting than the width of the circumferential surface 121 of the pulley 84 in a direction perpendicular to a longitudinal direction of the pulley shaft 84*a*. In addition, a height of radius of each of the flanges 122 may be more projected or greater than a height or radius of the outer circumferential surface 121 of the pulley 84 from the center to the outer circumferential surface 121.

Figure 22:
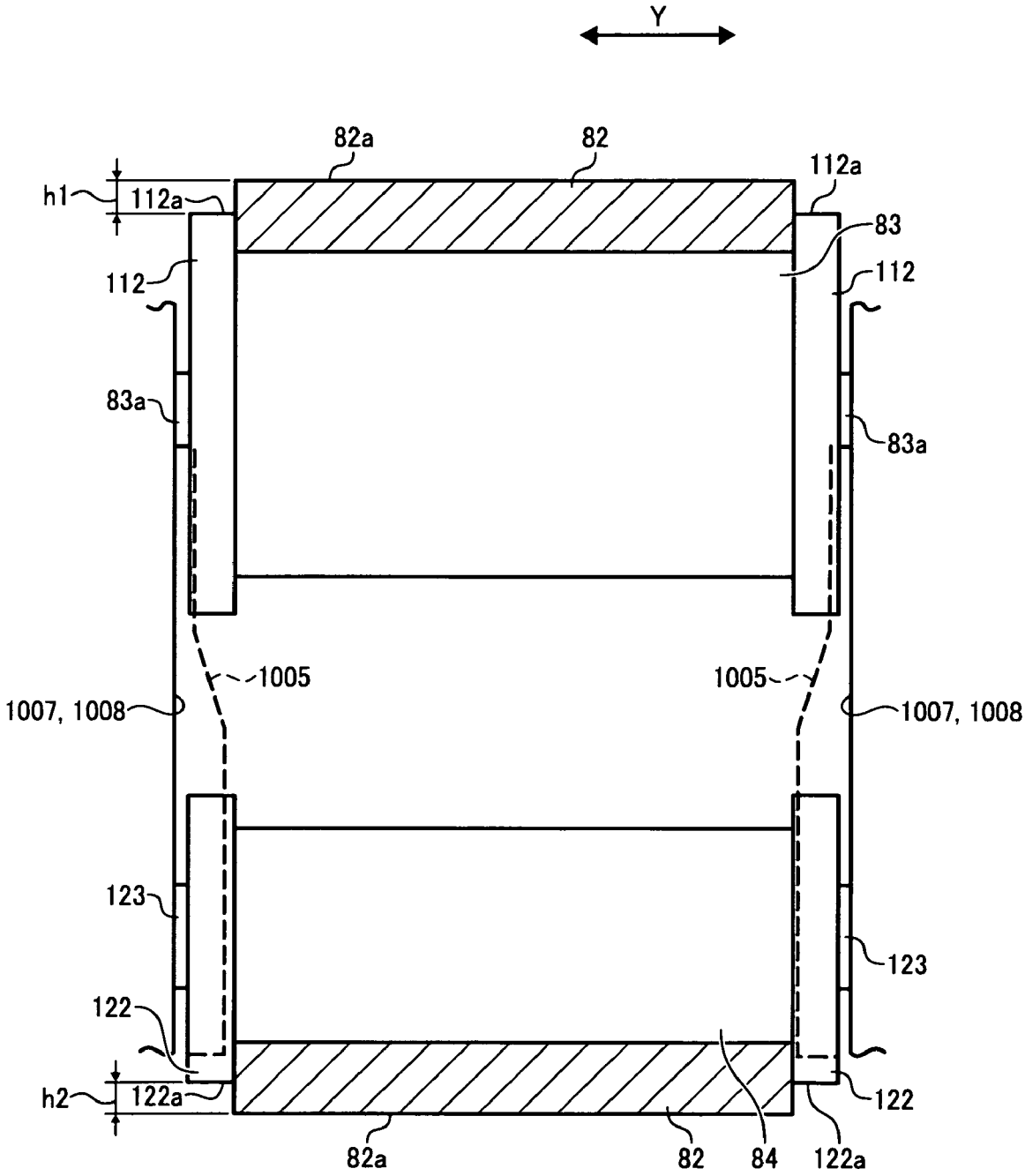
FIG. 22 is a cross-sectional view of one of the belt-type conveying units, viewed from a direction perpendicular to the axes of the pulleys of FIG. 19.

As obviously shown in FIGS. 16 and 22, the heights and outer diameters of the flanges 112 through which the pulley shaft 83*a* is inserted and the flanges 122 through which the pulley shaft 84*a* is inserted are designed to be smaller than the thickness of the conveyor belt 82 when wound around the outer circumferential surfaces 111 and 121, respectively.

For details, FIG. 22 shows a cross-sectional view of one of the belt unit 110 when the conveyor belt 82 is wound around the pulleys 83 and 84. As shown in FIG. 22, the height or thickness of the conveying surface 82*a* of the conveyor belt 82 mounted on the pulley 83 projects outward than the height of an outer circumferential surface 112*a* of the flange 112 by a height h1, and the conveying surface 82*a* of the conveyor belt 82 mounted on the pulley 84 projects outward than the higher of an outer circumferential surface 122*a* of the flange 122 by a height h2. In other words, the height of the flange 112 from the center of the pulley shaft 83*a* is smaller than the height of the conveyor belt 82 on the pulley 83 and the height of the flange 122 from the center of the pulley shaft 84*a* is smaller than the height of the conveyor belt 82 on the pulley 84.

As described above, by spanning the conveyor belt 82 over the outer circumferential surface 111 of the pulley 83 and the outer circumferential surface 121 of the pulley 84 having the above-described structure, the positional deviation of the conveyor belt 82 during rotation can be reduced. Further, by reducing the height and outer diameter of the flanges 112 and 122 to be smaller than the thickness of the conveyor belt 82 on the pulleys 83 and 84 as shown in the above-described structure, the leading edge of the sheet S may not abut against the flange 112 and/or the flange 122 but can surely abut against the conveying surface 82*a* of the conveyor belt 82.

Further, as shown in FIG. 17, the outer circumferential surfaces 111 of the pulley 83 includes a projecting part 111*a* and the outer circumferential surfaces 121 of the pulley 84 includes a projecting part 121*a*. The projecting part 111*a* of the pulley 83 and the projecting part 121*a* of the pulley 84 are ring-shaped and projecting by a given height so as to avoid the positional deviation of the conveyor belt 82.

Figure 18:
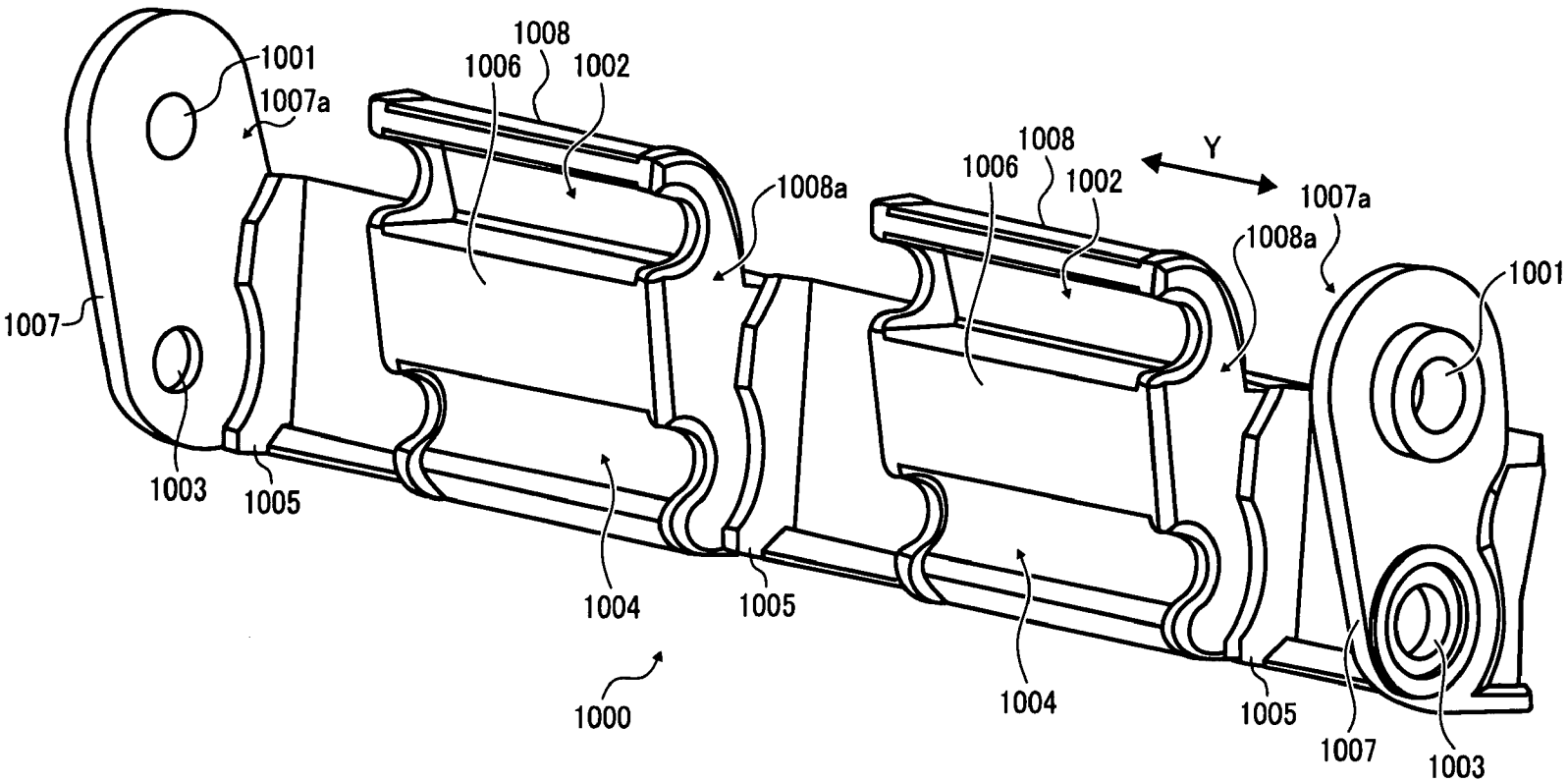
FIG. 18 is a perspective view of an inner structure of the holder of FIG. 15.

FIG. 18 is a perspective view of an inner structure of the holder 1000 shown in FIG. 14. In FIG. 18, the conveyor belt 82, the pulleys 83, the pulley shaft 83*a*, the pulleys 84, and the pulley shaft 84*a* are removed from the belt-type conveying units 800.

The holder 1000 shown in FIG. 18 includes spacing members 1007 and 1008, auxiliary bearings 1002 and 1004, belt guides 1005, and isolation parts 1006. These parts are integrally mounted to the holder 1000.

The spacing members 1007 are disposed at both ends of the holder 1000 along a longitudinal or axial direction of the pulley shafts 83*a* and 84*a*. The spacing members 1008 are disposed at one or both sides of the trial belt units 110 shown in FIG. 16. The spacing members 1007 and 1008 may be provided to hold the pulleys 83 and 84 to be spaced at a given constant interval, so as to regulate the movements of the trial belt units 110 or prevent the positional deviations of the trial belt units 110 in the longitudinal direction of the pulley shafts 83*a* and 84*a* or the sheet width direction Y in the holder 1000.

Each of the spacing members 1007 includes an inner wall 1007*a* and each of the spacing members 1008 includes an inner wall 1008*a*.

The auxiliary bearings 1002 may receive and auxiliary support the pulley shaft 83*a* the auxiliary bearings 1004 may receive and auxiliary support the pulley shaft 84*a*. The auxiliary bearings 1002 and 1004 also prevent distortion or warpage of the holder 1000.

The belt guides 1005 may be disposed on a surface of the spacing members 1007 and 1008 facing corresponding end surfaces of the pulleys 83 and 84. The belt guides 1005 may correspond to and serve as a regulation member to regulate the movement or positional deviation of the conveyor belt 82, not shown in FIG. 18, in the sheet width direction Y.

The isolation parts 1006 may be disposed to isolate the auxiliary bearings 1002 and 1004 and prevent distortion or warpage of the holder 1000.

Each of the spacing members 1007 may serve as a holding member to fixedly hold each of the pulleys 83 and each of the pulleys 84 with given intervals via the pulley shafts 83*a* and 84*a*. Through holes 1001 and 1003 are formed on each of the spacing members 1007 so that the pulley shafts 83*a* and 84*a* can pass through the through holes 1001 and 1003 to fixedly support the pulley shafts 83*a* and 84*a* at given intervals. Each of the spacing members 1008 may also serve as a holding member.

In this example embodiment, the spacing members 1007 also serve as fixing member to fix the pulleys shafts 83*a* and 84*a* with given intervals. "Fixing member" generally includes a fixing part, fixing member, and the like. For example, the spacing members 1007 serving as a "fixing member" can rotatably support the pulley shafts 83*a* and 84*a* via an integrally-mounted bearing or a different bearing. Each of the spacing members 1008 may also serve as a fixing member in this example embodiment.

The belt guides 1005 may be integrally disposed on the holder 1000 to be projected inwardly from the respective inner walls 1007*a* and 1008*a* and to be formed along the circumferences of the pulleys 83 and 84 in a manner that integrally mounted on the holder 1000.

When the pulley shafts 83*a* and 84*a* are inserted into the through hole 114 of the pulley 83 of the trial belt unit 110 and the through hole 124 of the pulley 84 of the trial belt unit 110, respectively, in the holder 1000, a small clearance may be provided between the auxiliary bearings 1002 and the pulleys 83 and between the auxiliary bearings 1004 and the pulleys. Therefore, the auxiliary bearings 1002 may not contact the pulley shaft 83*a* and the auxiliary bearings 1004 may not contact the pulley shaft 84*a* in the holder 1000.

As described above, the holder 1000 including the above-described parts and members integrally mounted on the holder 1000 is also a single component with and made of a resin material such as polyacetal resin that has good lubricity, abrasion resistance, and durability, and is thus light-weight. Further, the holder 1000 in this example embodiment does not include portions or areas that slide with other components and/or parts. Therefore, the holder 1000 may alternatively include ABS (acrylonitrile-butadiene-styrene) resin or the like to integrally mount the components and/or parts.

The holder 1000 includes a surface on which a black coating or a resin of a black colorant is applied. A jam detection sensor, not shown, including a reflective photo sensor may be disposed at a position close to a fed sheet and opposite to the top surface of the holder 1000. Therefore, by applying a black coating or a resin of black colorant to the surface of the holder 1000, diffuse reflection on the topmost surface of the holder 1000 due to incident light emitted from the jam detection sensor can be reduced or prevented, if possible, thereby making the detection of the leading or trailing edge of the sheet easier.

Figure 19:
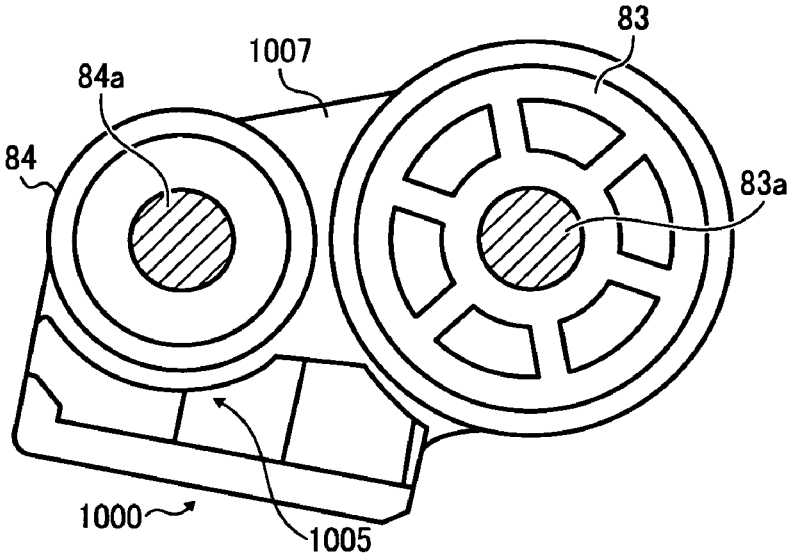
FIG. 19 is a cross-sectional view showing a positional relation of pulleys and a belt guide of the belt-type conveying units, viewed from a same direction as axes of the pulleys.

FIG. 19 is a cross-sectional view showing a positional relation of the pulleys 83 and 84 and the belt guide 1005, viewed from a same direction as the pulley shaft 83*a* and the pulley shaft 84*a*. As shown in FIG. 19, a given gap is provided between the belt guide 1005 and the circumference of the pulley 84. In other words, the belt guide 1005 may remain from coming in contact with the outer circumference of the pulley 84.

In FIG. 19, the conveyor belt 82 is removed from the pulleys 83 and 84 so that the positional relation of the pulleys 83 and 84 and the belt guide 1005 can clearly be shown.

Figure 20:
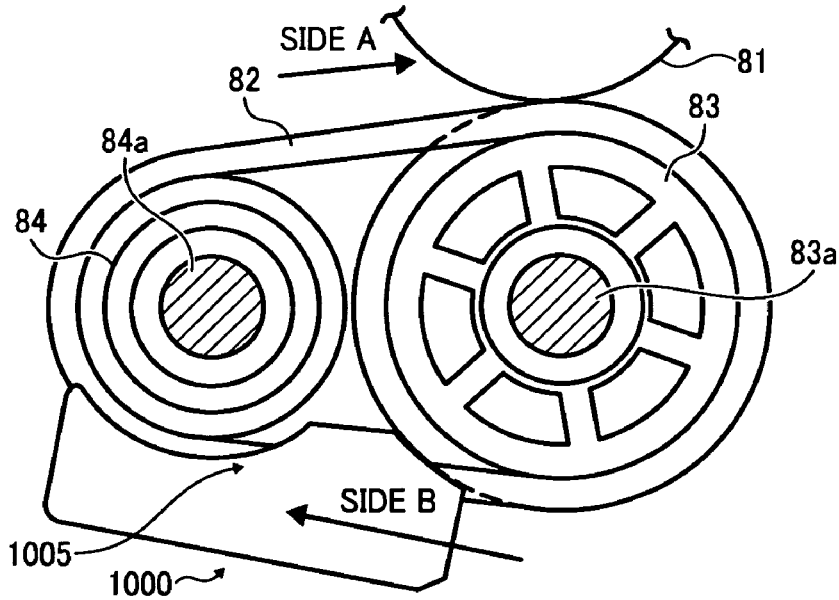
FIG. 20 is a cross-sectional view showing a positional relation of the pulleys and the belt guide of FIG. 19 when the belt is attached on the pulleys.

By contrast, FIG. 20 is a cross-sectional view showing a positional relation of the pulleys 83 and 84 and the belt guide 1005 when the conveyor belt 82 is attached on the pulleys 83 and 84. That is, in FIG. 20, the conveyor belt 82 is added to the above-described configuration of FIG. 19.

In FIG. 20, the circumference of the conveyor belt 82 on the pulley 84 is disposed at a position to overlay with the belt guide 1005.

The above-described positions of the conveyor belt 82 and the belt guide 1005 are employed so that the conveyor belt 82 may not easily come off the pulley 84.

When a failure such as a paper jam is caused, a user who is not familiar with the operations of the image forming apparatus tends to strongly pull a jammed paper out to remove from the apparatus. Such an external force to pull out a jammed paper may cause the conveyor belt 82 on the pulley 84 to come off. Therefore, the above-described positions are employed not to cause such inconvenience.

In addition, the conveyor belt 82 rotates in a clockwise direction in FIG. 20. On side A in FIG. 20, when the grip roller 81 rotates, the pulley 83 may rotate with the grip roller 81 via the conveyor belt 82. Accordingly, the conveyor belt 82 may extend between the pulleys 83 and 84. By contrast, on side B in FIG. 20, the pulley 84 rotates with the pulley 83 and the conveyor belt 82. Therefore, the conveyor belt 82 may not be extended and a small amount of looseness may be produced. When an external force is exerted to cause the conveyor belt 82 to come off the pulley 84 under the above-described condition, the inner circumferential surface of the conveyor belt 82 and the outer circumferential surfaces of the pulleys 83 and 84 on side B may separate. As a result, the conveyor belt 82 may come off the pulley 84 over the flange 122 shown in FIG. 16. Therefore, by overlaying the belt guide 1005 and the conveyor belt 82 at the position shown in FIG. 20, the belt guide 1005 can contribute to the regulation of the conveyor belt 82. The looseness of the conveyor belt 82 on side B may converge near the pulley 84. Therefore, it is advantageous to mount the belt guide 1005 in the vicinity of the pulley 84.

It is also advantageous that, as shown with dotted lines in FIG. 22, the belt guide 1005 is disposed at a significantly close position with respect to the conveyor belt 82 on the pulley 84 by making the clearance smaller so that the belt guide 1005 can be tapered extending toward the pulley 83.

In this example embodiment, the belt guide 1005 may prevent the positional deviation of the conveyor belt 82. However, a member to prevent the positional deviation of the conveyor belt 82 is not limited to the belt guide 1005. For example, a roller-type rotary member rotating in a direction perpendicular to a side surface of the conveyor belt 82 may be mounted on an inner wall of the spacing member 1007.

Figure 21:
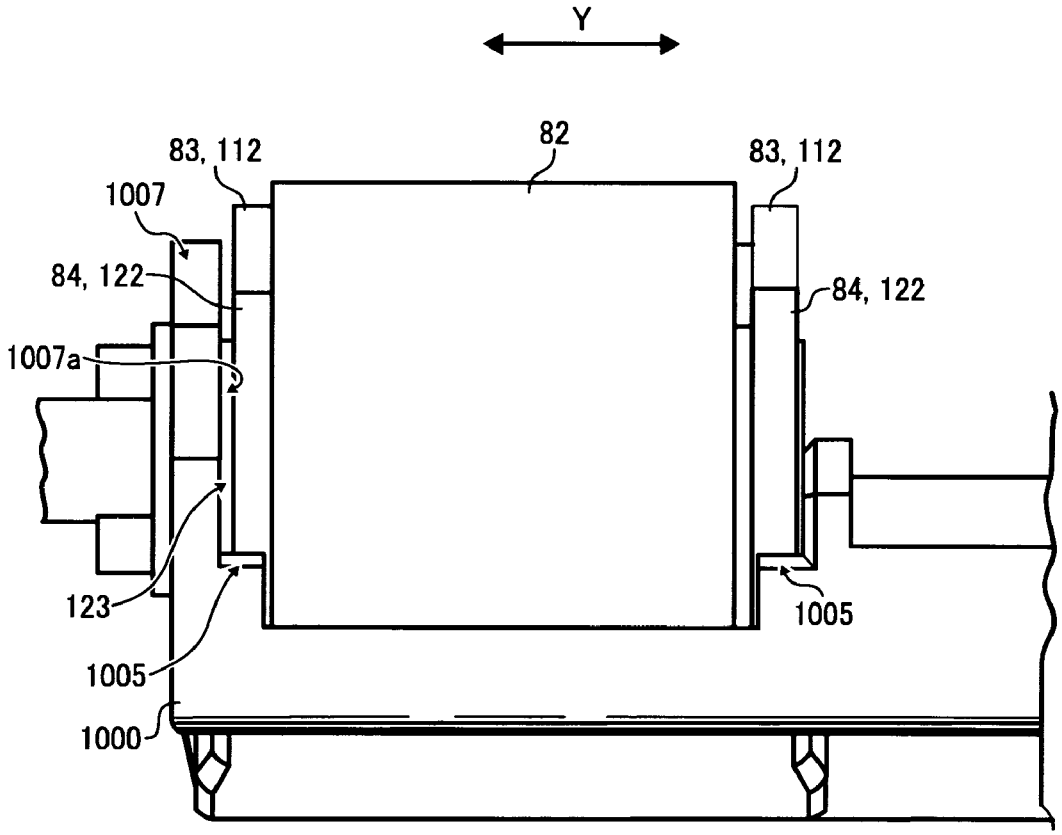
FIG. 21 is an enlarged front view of a leftmost one of the belt-type conveying units set in the holder of FIG. 15, viewed from the bottom of the holder.

As shown in FIG. 21, regarding the size and positional relation of the pulleys 83 and 84 with respect to the belt guide 1005 in the sheet width direction Y when the components are set in the holder 1000, a width or distance in the sheet width direction of the belt guide 1005 is set to be smaller than the sum of a width or distance in the sheet width direction of an outer end flange 123, which serves as a second projecting member, and a width or distance in the sheet width direction of the flange 122. In other words, a width or distance in the sheet width direction of the belt guide 1005 is smaller than a distance between an inner surface of the spacing member 1007 and a side end surface of the conveyor belt 82 in the sheet width direction. Therefore, in FIG. 21, both ends of the conveyor belt 82 may not interfere with the belt guide 1005, so that the conveyor belt 82 can stably rotate. Further, even when the conveyor belt 82 shifts in a horizontal direction or in a right or left direction in FIG. 21, the belt guide 1005 may prevent the conveyor 82 from a further movement or shift.

Further, the flange 112 serving as a first projecting member regulating the movement of the conveyor belt 82 on the pulley 83 can be removed. In this case, the height of the flange 122 on the side of the pulley 84 shown in FIGS. 16 and 22 can be formed greater. The above-described alternative configuration may not cause any specific failure such as damage on a sheet S conveyed from the second sheet conveying path PB caused by the leading edge of the sheet S abutting against the conveyor belt 82.

Further, the leading edge of the sheet S conveyed from the first sheet conveying path PA may be disposed so that the leading edge of the sheet S may collide with the abdominal portion (i.e., an "effective conveying portion") of the conveyor belt 82, thereby causing no specific damage or failure.

Figure 24:
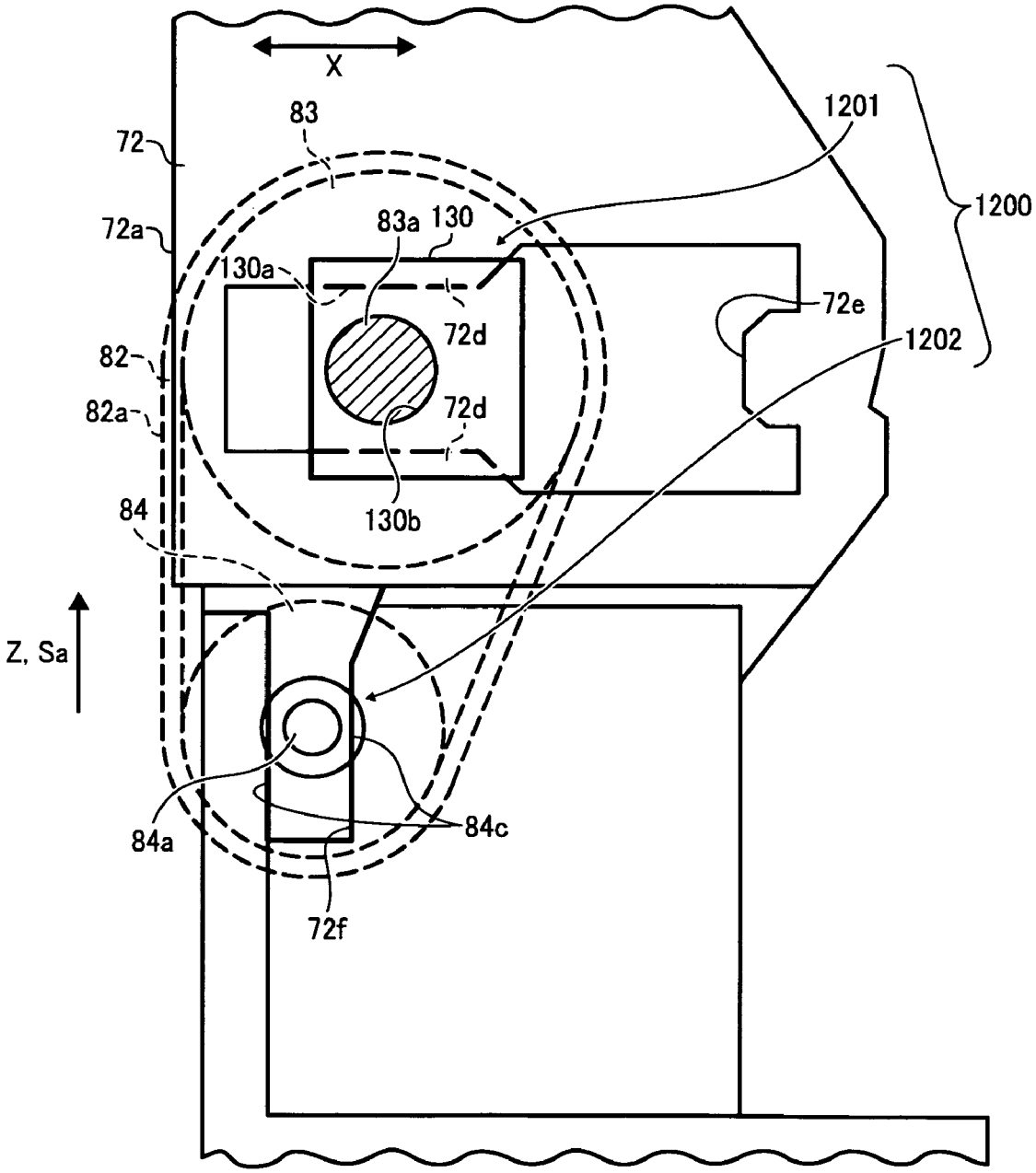
FIG. 24 is a partial cross-sectional view of the belt-type conveying units for explaining a positioning control mechanism.
Figure 26:
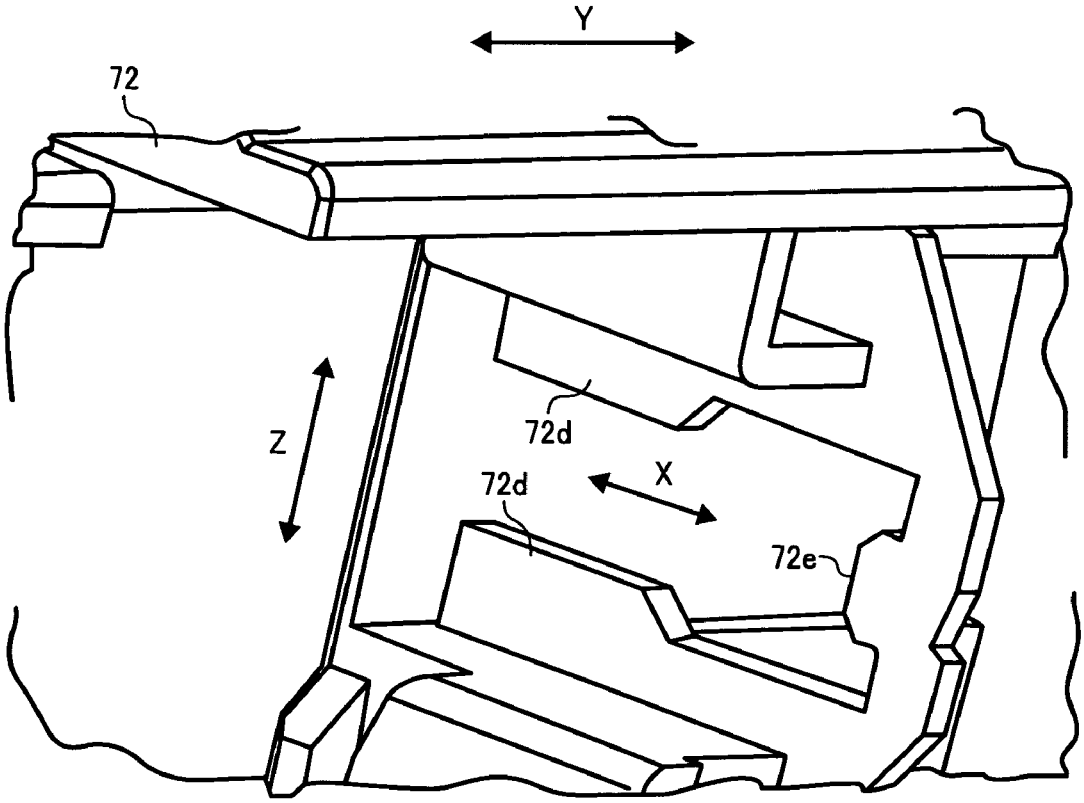
FIG. 26 is a perspective view of a part of a conveying guide attached to the sheet conveying device of FIG. 2.
Figure 27:
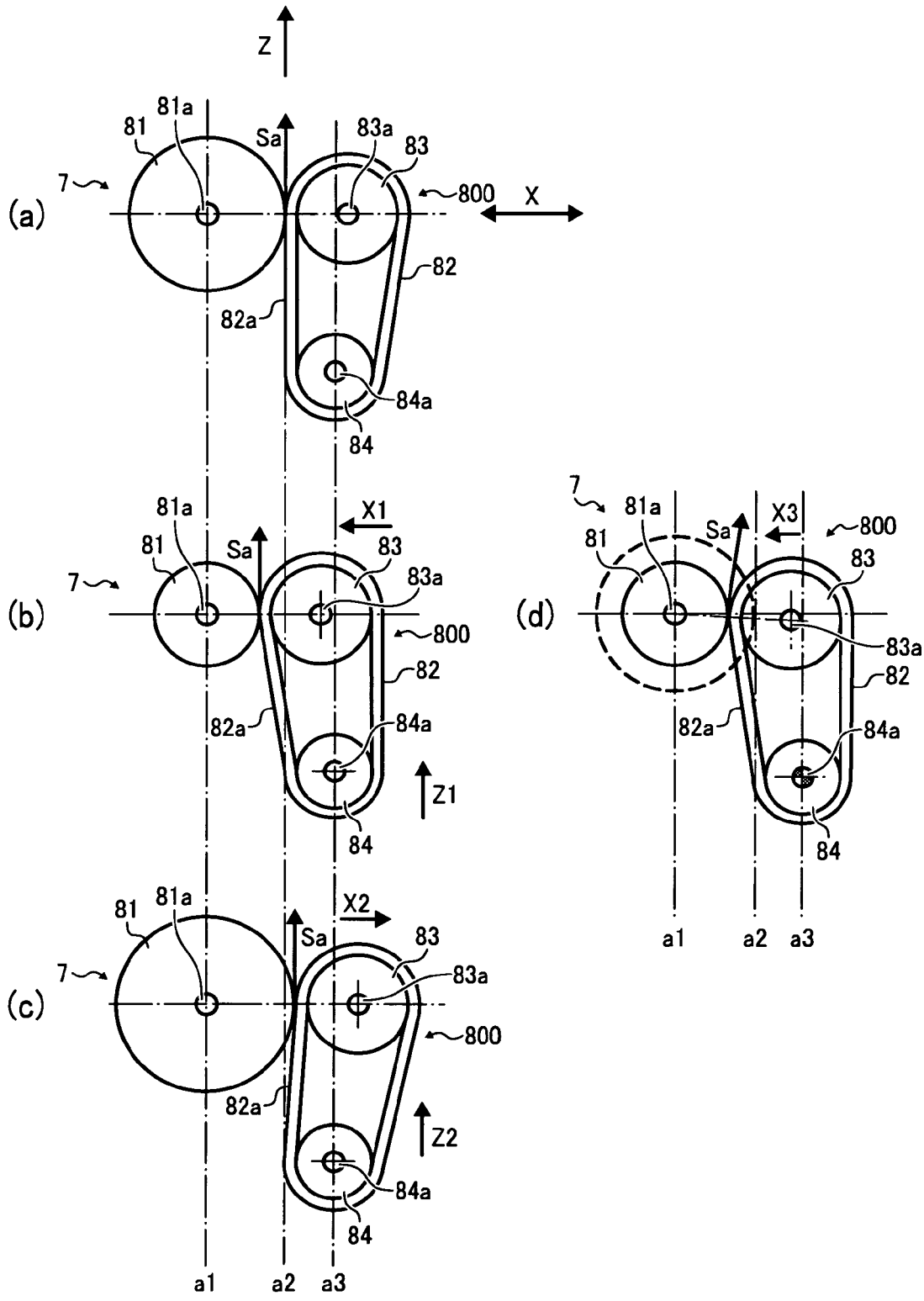
FIGS. 27A, 27B, 27C, and 27D are schematic views of the belt-type conveying units for explaining the actions of the positioning control mechanism of FIG. 24.

Different from the conveying guide member 72 with reference to FIG. 8, the conveying guide member 72 shown in FIGS. 23, 24, and 26 includes a conveying guide lib 72*b*, openings 72*c*, slide guide parts 72*d*, a spring latching part 72*e*, and a slit 72*f*.

The conveying guide lib 72*b* may serve as a substantial guide surface in a projecting shape from the vertical guide surface 72*a* to the center of the second sheet conveying path PB.

The openings 72*c* may be exposed to the conveyor belt 82 of the belt-type conveying unit 800.

The slide guide parts 72*d* may serve as a first positioning adjusting member, which will be described below.

The slit 72*f* may serve as a second positioning adjusting member, which will be described below.

The above-described components and parts may be formed by appropriate resin materials and be integrally mounted on the conveying guide member 72.

As shown in FIGS. 23, 24, 25A, and 25B, a bearing slider 130 is also provided to the sheet conveying device 500.

The bearing slider 130 may integrally be formed by polyacetal resin, for example, for weight saving. Polyacetal resin has preferable lubricating performance, abrasion resistance, and durability.

The bearing slider 130 may includes groove 130*a*, an engaging hole 130*b*, and a spring latching part 130*c* to be integrally mounted thereon.

The grooves 130*a* may form a first positioning control part 1201, which will be described below. The first positioning control part 1201 is formed on an upper side and a lower side of the bearing slider 130.

The engaging hole 130*b* may engage one end of the pulley shaft 83*a*.

The spring latching part 130*c* may attach and latch one end of the spring 140.

Next, a description is given of a method of assembling the belt-type conveying units 800.

(1) Put the components together to assemble each of the trial belt units 110 as shown in FIG. 16.

(2) Set the trial belt units 110 on trial fitting in the holder 1000 shown in FIG. 18.

(3) Put the pulley shaft 83*a* through the through hole 114 of the pulley 83 and the pulley shaft 84*a* through the through hole 124 of the pulley 84, respectively, of each of the trial belt units 110.

(4) Insert the leading edge of one end of the pulley shaft 83*a*, as shown on the right side of FIG. 23, of the belt-type conveying units 800 into the engaging hole 130*b* of the bearing slider 130 from the right side behind the slide guide part 72*d* in FIG. 23, and slide the bearing slider 130 in a pressing direction "X" that is perpendicular to the sheet width direction "Y" and a vertical direction "Z", so that the slide guide part 72*d* can be engaged with the grooves 130*a* of the bearing slider 130. The leading edge of the pulley shaft 83*a* and the engaging hole 130*b* of the bearing slider 130 are designed to be engaged with each other by application of a pressure force with which the bearing slider 130 may not fall off the pulley shaft 83*a* easily.

(5) Insert the cut part 84*c* formed on the leading edge of the other end of the pulley shaft 84*a* into the slit 72*f* formed on the left-side wall on the conveying guide member 72 in FIG. 23.

(6) Attach the spring 140, which serves as an elastic member, between the spring latching part 130*c* of the bearing slider 130 and the spring latching part 72*e* of the conveying guide member 72.

Next, referring to FIGS. 23 and 24, a description is given of a positioning adjustment of the belt-type conveying units 800.

As described above, the nip contact may be formed by applying the pressure force of the spring 140 (compression spring) to the pulley 83 to be held in contact and pressed against the grip roller 81 via the conveyor belt 82.

In this example embodiment, as shown in FIGS. 23 and 24, the sheet conveying device 500 may further include a positioning control mechanism 1200 so as to constantly keep the pressing direction "X" applied to the above-described nip contact.

The positioning control mechanism 1200 may have a specific configuration that can position the pulley shaft 83*a* and the pulley shaft 84*a* in different directions from each other.

For example, the positioning control mechanism 1200 includes a first positioning control part 1201 and a second positioning control part 1202.

The first positioning control part 1201 may position the pulley 83*a* and the second positioning control part 1202 may position the pulley 84*a*.

The first positioning control part 1201 may be formed by the bearing slider 130 and the slide guide part 72*d*.

Figure 25A:
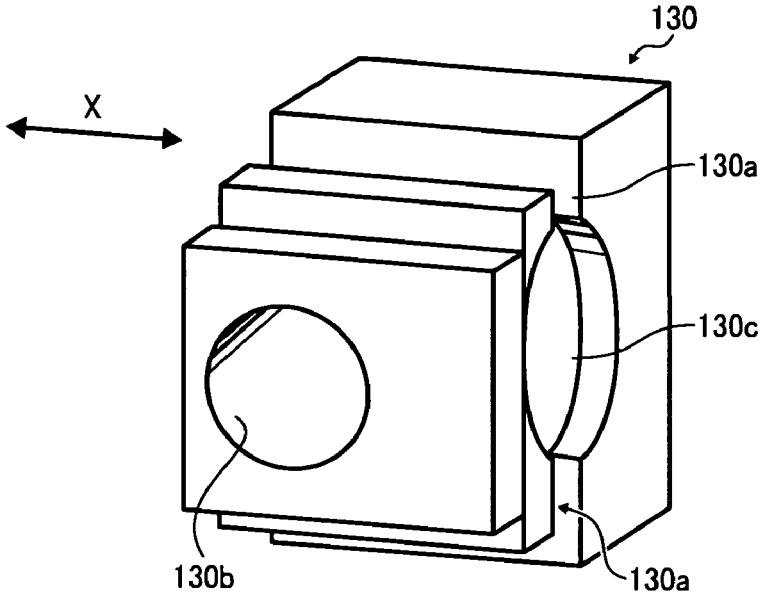
FIG. 25A is a perspective view of a bearing slider to be attached to the sheet conveying device of FIG. 2.
Figure 25B:
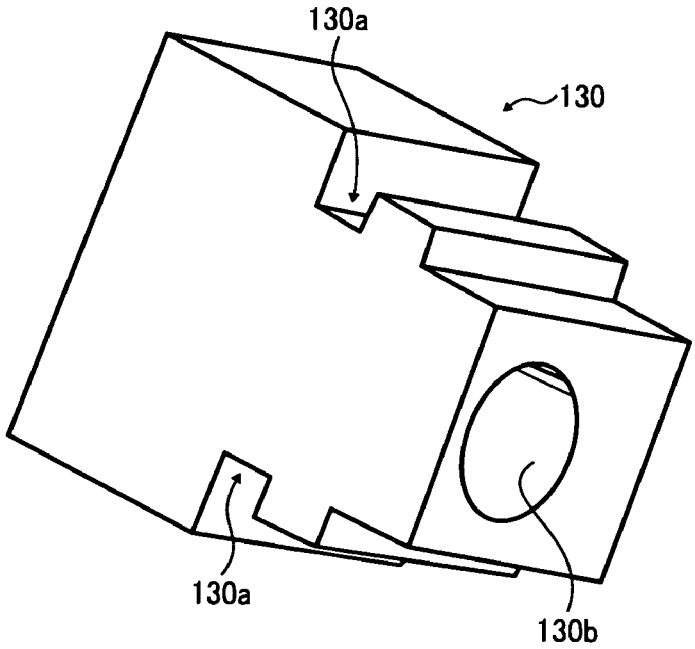
FIG. 25B is a perspective view of the bearing slider of FIG. 25A, viewed from a different angle.

As previously described, the bearing slider 130 may serve as a first moving member or sliding member. The bearing slider 130 may be disposed between the grooves 130 slidably arranged on the upper and lower sides thereof along the pressing direction "X", as shown in FIGS. 25A and 25B, and be engaged with one end of the pulley shaft 83*a*. The slide guide part 72*d* may serve as a first guide member or first guide unit to guide the pulley shaft 83*a* via the bearing slider 130 in the pressing direction "X", without rotating the pulley shaft 83*a*, as shown in FIG. 23.

The second positioning control part 1202 may be formed by the pulley shaft 83*a* and the slit 72*f*. The pulley shaft 84*a* may be formed to be movable along the vertical direction "Z" that is perpendicular to the pressing direction "X", as shown in FIG. 23. The pulley shaft 84*a* may include the cut part 84*c* serving as a second moving member or sliding member. The slit 72*f* may serve as a second guide member or second guide unit to guide the pulley shaft 84*a* in the vertical direction "Z", without rotating the pulley shaft 84*a*.

As described above, the first positioning control part 1201 and the second positioning control part 1202 respectively include a linear motion conversion mechanism having a relatively simple configuration while keeping the axial distance between the pulley shaft 83*a* and the pulley shaft 84*a*. For example, the first positioning control part 1201 may move in a direction perpendicular to a direction where the second positioning control part 1202 may move. That is, the pulley shaft 83*a* and the pulley shaft 84*a* may move in respective directions different from each other with a constant axial distance therebetween so as to position the pulley shafts 83*a* and 84*a*.

According to the above description, the second positioning control part 1202 shown in FIGS. 23, 24, 27A, 27B, and 27C can position and control a position in the vertical direction "Z" that is perpendicular to the pressing direction "X" along an extension of a line segment connecting an axial center of the rotary driving shaft 81*a* of the grip roller 81 and an axial center of the pulley shaft 83*a* of the pulley 83.

From another point of view, as shown in FIGS. 23 and 24, the conveying surfaces 82*a* of the belt-type conveying units 800 are disposed along the second sheet conveying path PB and aligned in parallel with the vertical guide surface 27*a* that forms the second sheet conveying path PB. Therefore, it may be regarded that the slit 72*f* is arranged in parallel with the vertical guide surface 27*a*. Accordingly, as shown in FIGS. 27A, 27B, and 27C, the second positioning control part 1202 can position and control the position of the pulley shaft 84*a* in a sheet conveying direction Sa, along which a sheet S is conveyed from the second conveying path PB located in parallel with the vertical guide surface 27*a* or the vertical direction "Z". That is, the second positioning control part 1202 can position and control the position of the pulley shaft 84*a* in parallel to the conveying surface 82*a* of the conveyor belt 82.

From a further different point of view, as shown in FIGS. 23, 24, 27A, 27B, and 27C, it can be described that the first positioning control part 1201 can position and control the pulley 83 with respect to the grip roller 81 along the pressing direction "X".

Further, from yet another different point of view, as shown in FIGS. 8, 23, 24, 27A, 27B, and 27C, it can also be described that the first positioning control part 1201 can perform a positioning control while keeping the collision angle θ2 of the leading edge of the sheet S to the conveying surface 82*a* to be an acute angle.

Further, even when the pulley shaft 84*a* moves on the topmost of the second positioning control part 1202, the second positioning control part 1202 may not be positioned above the height of the downstream end of the conveying guide member 71, as shown in FIG. 8.

Next, referring to FIGS. 27A through 27D, a description is given of operations of the above-described positioning control mechanism 1200 with one of the grip rollers 81 and a corresponding one of the belt-type conveying units 800.

FIG. 27A shows the grip roller 81 and the belt-type conveying unit 800 of the second conveying unit 7 in a normal condition. In FIG. 27A, "a1" represents an axial center of the rotational driving shaft 81*a* of the grip roller 81, "a2" represents the nip contact of the conveyor belt 82 of the belt-type conveying unit 800 and the grip roller 81, and "a3" represents an axial center of the pulley shaft 84*a* of the pulley 84. An alternate long and short dash line indicating "a1" is a line showing the position of the axial center of the grip roller 81 in FIG. 27A for comparing the positions of the axial centers of the grip rollers 81 shown in FIGS. 27B through 27D, an alternate long and short dash lines indicating "a2" is a line showing the position of the nip contact of the grip roller and the conveyor belt 82 of the belt-type conveying unit 800 in FIG. 27A for comparing the positions of the nip contact shown in FIGS. 27B through 27D, and an alternate long and short dash line indicating "a3" is a line showing the position of the axial center of the pulley shaft 84*a* in FIG. 27A for comparing the positions of the axial centers of the pulley shafts 84*a* shown in FIGS. 27B through 27D. Arrow Sa provided at a downstream side of the nip contact of the conveyor belt 82 of the belt-type conveying unit 800 and the grip roller 81 indicates a sheet conveying direction after a sheet passes the nip contact.

FIGS. 27B and 27C show operations of the positioning control mechanism 1200 according to the example embodiment of the present patent application. FIG. 27D shows operations of a positioning control method of a comparative example.

The operations of the positioning control mechanism are described with reference to FIGS. 27A through 27D while employing the operations shown in FIG. 27A as a reference operation. It should be noted that the conditions of the grip roller 81 shown in FIGS. 27B through 27D are illustrated in an exaggerated form so as to easily clarify the operations of the positioning control mechanism. Normally, the hardness of the grip roller 81, which generally works as a driving member, formed by an EPDM rubber material is set to a higher amount than the hardness of the conveyor belt 82.

The grip roller 81 shown in FIG. 27B has been abraded, and therefore, has a smaller outer diameter than the grip roller 81 shown in FIG. 27A. In this case, the pulley shaft 83*a* of the pulley 83 moves in a direction "X1" that is in parallel with arrow indicating the pressing direction "X" as shown in FIG. 27B, and the pulley shaft 84*a* of the pulley 84 moves upward in parallel along the line "a3" with arrow indicating the vertical direction "Z1". Therefore, the positioning control mechanism may have the same pressing direction "X" as the positioning control shown in FIG. 27A. Accordingly, the sheet that has passed through the nip contact may be conveyed in a direction parallel with the sheet conveying direction Sa as shown in FIG. 27A.

The grip roller 81 shown in FIG. 27C has a greater outer diameter than the grip roller 81 shown in FIG. 27A, within a range of dimension error or tolerance. In this case, as shown in FIG. 27C, the pulley shaft 83*a* of the pulley 83 moves in parallel with the pressing direction "X2" to move away or retreat from the grip roller 81, and the pulley shaft 84*a* of the pulley 84 moves upward in parallel along the line "a3" with arrow indicating the vertical direction "Z2". Therefore, the positioning control mechanism may have the same vertical direction "Z" as the positioning control shown in FIG. 27A. Accordingly, a sheet that has passed through the nip contact may be conveyed in a direction parallel with the sheet conveying direction Sa as shown in FIG. 27A.

In FIGS. 27A through 27C, respective inclinations of the conveyor belts 82 are different. It is advantageous that the collision angle of the leading edge of a sheet with respect to the conveying surface 82*a* of the conveyor belt 82 is set to an acute angle.

Other than the above-described positioning control mechanism, a different configuration may be employed. For example, in a configuration shown in FIG. 27D, the pulley shaft 84*a* of the pulley 84 is fixed and not movable and the pulley shaft 83*a* of the pulley 83 is movable. In this case, as the outer diameter of the grip roller 81 shown in a dashed line in FIG. 27D becomes smaller due to abrasion to the size shown in a solid line in FIG. 27D, the belt-type conveying unit 800 may pivot about the pulley shaft 84*a* in a direction "X3" or a counterclockwise direction in FIG. 27D and the axial center of the pulley shaft 83*a* of the pulley 83 may move in a downward direction. In this case, the position of the nip contact may move downwardly from the position in FIG. 27A, which may change the pressing direction. Therefore, the sheet conveying direction Sa of the sheet S passing through the nip contact may be changed. According to the above-described change, the conveyance of the sheet to the pair of registration rollers disposed at a downstream side of the nip contact, for example, may be adversely affected, and as a result, a stable sheet conveyance cannot be maintained.

As a matter of course, the main structure of the sheet conveying device 500 shown in FIGS. 11 through 27 is applicable to the example shown in FIGS. 1 through 10.

Further, the main structure of the sheet conveying device 500 is applicable to a fixed-type sheet conveying apparatus that does not include an opening and closing unit such as the opening and closing guide 79. The opening and closing guide 79 shown in FIG. 13 may perform a positioning operation with respect to the main body 78 so as to fit within a given dimensional tolerance.

As described above, according to the above-described structure shown in the example embodiment of the present patent application, a sheet can stably be guided and conveyed, even in changes by aging of components such as the grip roller 81 and the conveyor belt 82. Further, it is advantageous to reduce installation error or tolerance more than the apparatus shown in FIG. 1 through 10, while operability or handling ability of paper jam, and maintenance and cleaning ability increase.

Accordingly, the above-described example embodiment of the present patent application can guide and transfer a sheet stably even when the part and/or component at the holding section or nip contact of the second conveying unit 7 abrades away or becomes worn due to changes by aging.

Further, when a user who is not familiar with operations of an image forming apparatus applies an external force to the conveyor belt 82 to an off direction while handling paper jams, the above-described structure can prevent the conveyor belt 82 from causing a positional deviation or a coming off from the pulley 83 and or the pulley 84, thereby stably conveying the sheet.

As described above, the belt-type conveying units 8, 8B, and 800 of the respective sheet conveying devices 5, 5A, 5B, and 500 each serves as a belt-type sheet conveying unit for moving and guiding the sheet S toward the nip contact or sheet holding section formed with the grip roller 81 while keeping the leading edge or a leading edge section (the leading edge section has a broad meaning including the leading edge, the face at the leading edge, and the corners and edges at the leading edge) of the sheet S in contact with one member of the pair of rollers of the second conveying unit 7 or a hold and transfer unit, and gradually increasing the contact surface with the sheet S according to the rigidity of the sheet S. The moving and guiding unit is not limited to the belt-type conveying units 8, 8B, and 800 as long as it has the above-described effects can be achieved.

In the above-described examples with reference to FIGS. 1 through 10 and the above-described example embodiments with reference to FIGS. 11 through 27D, the present patent application may be applied to a sheet conveying device for conveying and feeding a sheet from a sheet storing unit (e.g., sheet feeding cassette 51) provided in the copier 1, serving as an image forming apparatus, to the main body 2 of the copier 1 as shown in FIG. 1.

However, the present patent application is not limited thereto. That is, the present patent application is applicable to a sheet conveying device in which the leading edge of a sheet S is ejected substantially upward from the top of the fixing device 11 of the main body 2 of the copier 1, and then ejected from the main body 2 to the sheet eject tray 9 in a substantially horizontal direction, as shown in FIG. 28B, for example.

The present patent application is also applicable to a sheet conveying device in which a sheet S placed on the substantially horizontal manual sheet feeding tray 67 provided outside the main body 2 of the copier 1 by a user is guided inside the main body 2 while maintaining its horizontal direction, and then the sheet S changes its direction upward to be conveyed into a vertical conveying path that extends to the image forming section in the main body 2 of the copier 1.

In the above-described examples with reference to FIGS. 1 through 10 and the above-described example embodiments with reference to FIGS. 11 through 27D, the sheet may change its direction from a substantially horizontal direction to a vertically upward direction or substantially directly upward direction. However, the present patent application is not limited thereto.

Figure 28A:
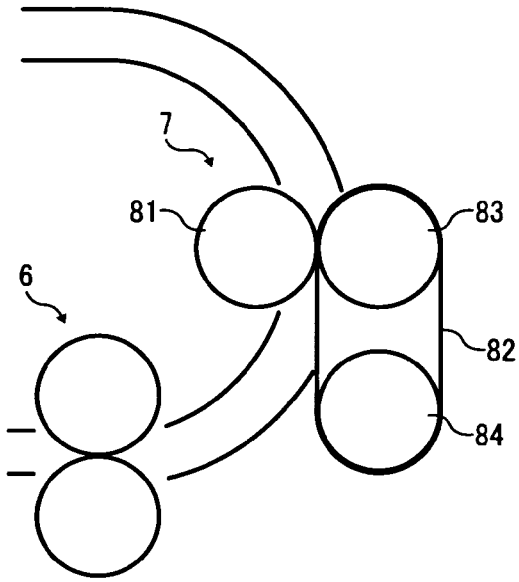
FIG. 28A is a schematic front view of conveying units applicable to the above-described sheet conveying devices.
Figure 28B:
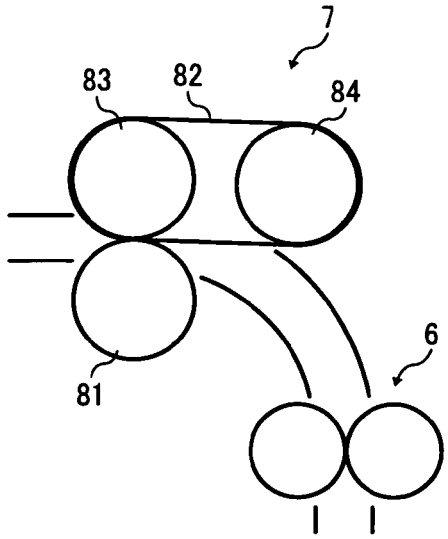
FIG. 28B is a schematic front view of different conveying units applicable to the above-described sheet conveying devices.

For example, the sheet can change its direction from a substantially horizontal direction to a vertically downward direction or substantially directly downward direction, or from a vertically downward or upward direction to a substantially horizontal direction, as shown in FIG. 28A, for example, or from an oblique direction to another oblique direction.

In the above-described examples with reference to FIGS. 1 through 10 and the above-described example embodiments with reference to FIGS. 11 through 27D, both the first conveying unit 6 and the second conveying unit 7 also serve as hold and transfer units for holding and transferring a sheet. However, depending on the conveying direction of each of the first and second conveying units 6 and 7, if it is only needed to support the bottom face of the conveying object while being conveyed, the first and second conveying units 6 and 7 may not need to be the hold and transfer units including nip contacts formed by members facing each other. In the above-described example embodiment with reference to FIGS. 11 through 27D, at least the second conveying unit 7 may be a hold and transfer unit.

The members of the first conveying unit 6, the second conveying unit 7, and the pickup roller 60 are not limited to the above. The members can be a substantially extended cylindrical roller or member with a given length in the axial lengthwise direction of the rotational axis, or a short cylindrical roller or member. Furthermore, multiple rollers can be disposed along a single rotational shaft with given equal intervals therebetween.

In the conveying paths according to the above-described example embodiments, several guiding members can be provided along the outer side or the inner side in the spaces in which rollers are not disposed so as to form guide surfaces. As long as such guide surfaces are symmetrically arranged in an orderly manner with respect to a conveying center line, the guide surfaces can be band-like guide surfaces or substantially linear guide surfaces or a combination thereof.

In the above-described examples with reference to FIGS. 1 through 10 and the above-described example embodiment with reference to FIGS. 11 through 27D, the FRR sheet separation mechanism is employed. However, the sheet separation method is not limited to the above-described method or mechanism. The present patent application can apply any sheet separation method in which, when multiple sheets are picked up from a sheet feeding cassette, one sheet is frictionally separated from the other sheets. For example, a separator or a separating claw can be applied or a friction pad serving as a fixing member can be applied.

For example, the sheet separation mechanism using a friction pad or the friction pad sheet separation mechanism separates a sheet S, which is placed on top of a stack of sheets in a sheet feeding cassette, one by one from the other sheets therein and feed the separated sheet by actions of a feed roller in rotation and a friction pad. That is, in the friction pad sheet separation mechanism, a spring provides a separation force via a slider to the friction pad that abuts against the feed roller at a given separation angle. This abutment of the friction pad against the feed roller forms a nip contact therebetween, so that the sheet S can pass the nip contact when the sheet S is conveyed. Therefore, when two or more sheets are picked up at the same time, the picked-up sheets other than a top sheet may receive the resistance from the friction pad greater than the resistance from the friction with the other picked-up sheets. This can prevent the movement of the picked-up sheets beyond the nip contact. On the other hand, the top sheet may receive the resistance from the feed roller greater than the resistance from the other picked-up sheets and the resistance from the friction pad. Accordingly, the top sheet can be conveyed in the sheet conveying direction.

The present patent application is not limited to the copiers 1 having a monochrome printing method. That is, the sheet conveying device according to the present patent application is also applicable to a color copier or an image forming apparatus connected to a printer such as a monochrome laser printer, an inkjet printer, or an ink ribbon printer.

The present patent application is similarly applicable to a color printer such as a direct transfer type tandem type color image forming apparatus in which images are sequentially transferred and superimposed onto a sheet being conveyed by a transfer member, and a tandem type image forming apparatus in which images are sequentially transferred onto an endless intermediate transfer belt serving as an intermediate transfer member and then transferred onto a sheet at once as a overlaid toner image or a color toner image.

The present patent application is also applicable to an image forming apparatus including a single, endless belt type photoconductor.

The present patent application is not limited to an image forming apparatus that employs an in-body paper eject type, that is, a sheet eject tray is located within the main body of the image forming apparatus, between an image forming unit and a scanner. Specifically, the present patent application is also applicable to an image forming apparatus with a paper eject tray provided on the side of the main body of the image forming apparatus.

In the above-described examples with reference to FIGS. 1 through 10 and the above-described example embodiment with reference to FIGS. 11 through 27D, the present patent application is not limited to a conveying path for conveying a sheet extracted from the sheet feeding device 3 substantially vertically or directly upward toward the top of the main body 2 of the copier 1. That is, the present patent application is also applicable to an image forming apparatus in which the conveying path from the sheet feeding device to the sheet eject tray is not substantially vertically or directly upward.

The present patent application is also applicable to a sheet conveying device provided in a printing machine including stencil printing machines, for conveying a sheet from a sheet storing unit or sheet feeding cassette to a printing machine main unit.

In the above-described copiers 1 serving as the image forming apparatus, an original document to be scanned may be manually set. However, in the above-described examples with reference to FIGS. 1 through 10 and the above-described example embodiment with reference to FIGS. 11 through 27D, the image forming apparatus can be a copier or a printing machine provided with an automatic document feeder or ADF for automatically scanning multiple original documents or sheets, and the sheet conveying device according to the present patent application can be provided in the ADF.

The image forming apparatus is not limited to a copier. That is, the image forming apparatus can be a facsimile machine, a printer, an inkjet recording device, or an image scanning device, provided with a scanner for scanning an image from an original document, and a multifunction peripheral combining at least two of the above. In any of the above-described apparatuses or devices, an optimum sheet conveying device can be provided for changing the sheet conveying direction in conveying various types of sheets, while saving space in the sheet conveying path.

The present patent application is not limited to providing respective sheet conveying devices to multiple sheet feeding stages. For example, the present patent application is applicable to a case in which the top sheet feeding cassette 51 and the sheet conveying device 5' including the first conveying unit 6 and the second conveying unit 7' are removed from the sheet feeding device 3 shown in FIG. 1, so that the sheet feeding device 3 can include a single sheet feeding cassette 51 and the sheet conveying device 5 including the first conveying unit 6 and the second conveying unit 7.

That is, the present patent application is applicable to an image scanning device provided with the sheet conveying device according to an example embodiment of the present patent application, and to an image forming apparatus provided with the sheet conveying device and/or the image scanning device according to an example embodiment of the present patent application. The image forming apparatus according to an example embodiment of the present patent application can be any one of a copier, a facsimile machine, a printer, a printing machine, and an inkjet recording device, or a multifunction peripheral combining at least two of the above.

Although the invention has been described with respect to a specific embodiment for a complete and clear disclosure, the appended claims are not to be limited as shown in the above-described examples with reference to FIGS. 1 through 10 and the example embodiment with reference to FIGS. 11 through 27D but are to be construed as embodying all modifications and alternative constructions that may occur to one skilled in the art that fairly fall within the basic teaching herein set forth.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present patent application, and all such modifications as would be obvious to one skilled in the art are intended to be included within the scope of the following claims.

What is claimed is:

1. A sheet conveying device, comprising:

a first conveying unit to convey a sheet in a first sheet conveying direction;

a second conveying unit, disposed on a downstream side of the first conveying unit in the first sheet conveying direction, to convey the sheet conveyed by the first conveying unit in a second sheet conveying direction different from the first sheet conveying direction, the second conveying unit provided with a sheet holding section to hold and convey the sheet;

a first sheet conveying path provided between the first conveying unit and the second conveying unit; and a belt-type sheet conveying unit, disposed on an outer side of the first sheet conveying path, to convey a sheet to the sheet holding section of the second conveying unit, the belt-type sheet conveying unit including:

a belt to convey the sheet to the sheet holding section of the second conveying unit;

a first rotary belt holding member, disposed facing the sheet holding section of the second conveying unit, to rotatably hold the belt;

a second rotary belt holding member disposed facing the first rotary belt holding member;

a first supporting member to rotatably support the first rotary belt holding member; and a second supporting member to rotatably support the second rotary belt holding member; and a positioning control mechanism to move and position the first supporting member and the second supporting member in respective directions different from each other.

2. The sheet conveying device according to claim 1, further comprising a space holding unit to hold the first supporting member and the second supporting member a given constant distance apart.

3. The sheet conveying device according to claim 1, wherein the positioning control mechanism includes:

a first positioning control part to control a positioning of the first supporting member; and a second positioning control part to control a positioning of the second supporting member, the second positioning control part controlling a position in a direction perpendicular to a line segment connecting an axial center of a rotary feed drive member of the second conveying unit disposed opposite the first rotary belt holding member, and an axial center of the first supporting member.

4. The sheet conveying device according to claim 3, wherein an angle of contact between a leading edge of a sheet and a conveying surface of the belt-type sheet conveying unit during positioning control is an acute angle.

5. The sheet conveying device according to claim 1, further comprising a second sheet conveying path, different from the first sheet conveying path and provided upstream of the second conveying unit to join the first sheet conveying path at an upstream side of the second conveying unit, the positioning control mechanism including:

a first positioning part to control a positioning of the first supporting member; and a second positioning part to control a positioning of the second supporting member, the belt of the belt-type sheet conveying unit including a conveying surface disposed along the second sheet conveying path, the second positioning control part controlling a position of the second supporting member in a direction parallel to a conveying surface of the second sheet conveying path.

6. The sheet conveying device according to claim 5, wherein an angle of contact between a leading edge of a sheet and a conveying surface of the belt-type sheet conveying unit during positioning control is an acute angle.

7. The sheet conveying device according to claim 1, wherein the positioning control mechanism includes:

a first positioning control part to control a positioning of the first supporting member; and a second positioning control part to control a positioning of the second supporting member, the first positioning control part, disposed facing the first rotary belt holding member, controlling the first rotary belt holding member with respect to the rotary feed drive member of the second conveying unit along a pressing direction.

8. The sheet conveying device according to claim 7, wherein an angle of contact between a leading edge of a sheet and a conveying surface of the belt-type sheet conveying unit during positioning control is an acute angle.

9. The sheet conveying device according to claim 1, wherein the belt-type sheet conveying unit is configured as multiple belt-type sheet conveying units disposed discontinuously in a sheet width direction, the multiple belt-type sheet conveying units being integrally mounted in a holder.

10. An image forming apparatus, comprising:

a main body unit configured to perform an image forming operation; and a sheet conveying device comprising:

a first conveying unit to convey a sheet in a first sheet conveying direction;

a second conveying unit, disposed on a downstream side of the first conveying unit in the first sheet conveying direction, to convey the sheet conveyed by the first conveying unit in a second sheet conveying direction different from the first sheet conveying direction, the second conveying unit provided with a sheet holding section to hold and convey the sheet;

a first sheet conveying path provided between the first conveying unit and the second conveying unit;

a belt-type sheet conveying unit, disposed on an outer side of the first sheet conveying path, to convey a sheet to the sheet holding section of the second conveying unit, the belt-type sheet conveying unit including:

a belt to convey the sheet to the sheet holding section of the second conveying unit;

a first rotary belt holding member disposed facing the sheet holding section of the second conveying unit to rotatably hold the belt;

a second rotary belt holding member disposed facing the first rotary belt holding member;

a first supporting member to rotatably support the first rotary belt holding member; and a second supporting member to rotatably support the second rotary belt holding member; and a positioning control mechanism to move and position the first supporting member and the second supporting member in respective directions different from each other.

11. The image forming apparatus according to claim 10, wherein the sheet conveying device further includes a space holding unit to hold the first supporting member and the second supporting member at a given constant distance apart.

12. The image forming apparatus according to claim 10, wherein the positioning control mechanism includes:

a first positioning control part to control a positioning of the first supporting member; and a second positioning control part to control a positioning of the second supporting member, the second positioning control part controlling a position in a direction perpendicular to a line segment connecting an axial center of a rotary feed drive member of the second conveying unit disposed opposite the first rotary belt holding member, and an axial center of the first supporting member.

13. The image forming apparatus according to claim 12, wherein an angle of contact between a leading edge of a sheet and the conveying sufface of the belt-type sheet conveying unit during positioning control is an acute angle.

14. The image forming apparatus according to claims 10, further comprising a second sheet conveying path different from the first sheet conveying path and provided upstream of the second conveying unit to join the first sheet conveying path at an upstream side of the second conveying unit, the positioning control mechanism including a first positioning part to control a positioning of the first supporting member; and a second positioning part to control a positioning of the second supporting member, the belt of the belt-type sheet conveying unit including a conveying surface disposed along the second sheet conveying path, the second positioning control part controlling a position of the second supporting member in a direction parallel to a conveying surface of the second sheet conveying path.

15. The image forming apparatus according to claim 14, wherein an angle of contact between a leading edge of a sheet and the conveying surface of the belt-type sheet conveying unit during positioning control is an acute angle.

16. The image forming apparatus according to claim 10, wherein the positioning control mechanism includes a first positioning control part to control a positioning of the first supporting member; and a second positioning control part to control a positioning of the second supporting member, the first positioning control part, disposed facing the first rotary belt holding member, controlling the first rotary belt holding member with respect to the rotary feed drive member of the second conveying unit along a pressing direction.

17. The image forming apparatus according to claim 16, wherein an angle of contact between a leading edge of a sheet and the conveying surface of the belt-type sheet conveying unit during positioning control is an acute angle.

18. The image forming apparatus according to claim 10, wherein the belt-type sheet conveying unit is configured as multiple belt-type sheet conveying units disposed discontinuously in a sheet width direction, the multiple belt-type sheet conveying units being integrally mounted in a holder.

* * * * *